US007945176B2

(12) United States Patent
Hoshino et al.

(10) Patent No.: US 7,945,176 B2
(45) Date of Patent: May 17, 2011

(54) IMAGE FORMING APPARATUS INCLUDING A GAP FORMING UNIT

(75) Inventors: Seiji Hoshino, Kanagawa (JP); Takashi Hashimoto, Kanagawa (JP); Toshiyuki Andoh, Kanagawa (JP); Tatsuhiko Oikawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 931 days.

(21) Appl. No.: 11/744,352

(22) Filed: May 4, 2007

(65) Prior Publication Data

US 2007/0269230 A1 Nov. 22, 2007

(30) Foreign Application Priority Data

May 19, 2006 (JP) ..... 2006-140333
May 19, 2006 (JP) ..... 2006-140403
Feb. 14, 2007 (JP) ..... 2007-033506

(51) Int. Cl.
*G03G 15/00* (2006.01)
*G03G 15/16* (2006.01)
*G03G 15/20* (2006.01)

(52) U.S. Cl. ..... 399/45; 399/66; 399/313

(58) Field of Classification Search ..... 399/45, 399/66, 302, 308, 313, 312
See application file for complete search history.

(56) References Cited

U.S. PATENT DOCUMENTS 5,966,559 A * 10/1999 May et al. ..... 399/45
6,999,698 B2 * 2/2006 Yamauchi et al. ..... 399/121

FOREIGN PATENT DOCUMENTS

| | | |
|---|---|---|
| JP | 56-47639 | 11/1981 |
| JP | 61-90167 | 5/1986 |
| JP | 4-242276 | 8/1992 |
| JP | 6-274051 | 9/1994 |
| JP | 10-83124 | 3/1998 |
| JP | 11-288177 | 10/1999 |
| JP | 2000-19864 | 1/2000 |
| JP | 2001-305890 | 11/2001 |
| JP | 2004-109706 | 4/2004 |

OTHER PUBLICATIONS

Machine Translation of JP2000-019864A1.*

* cited by examiner

*Primary Examiner* — David M Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus includes an image carrier that carries an image and rotates, a transfer member that rotates in contact with the image carrier and transfers an image formed on the image carrier to a recording medium, a conveying unit that conveys the recording medium to a contact position where the image carrier and the transfer member come into contact with each other, and a gap forming unit that forms a gap between the image carrier and the transfer member at the contact position. The gap forming unit forms the gap immediately before the recording medium enters the contact position.

20 Claims, 62 Drawing Sheets

IMMEDIATELY BEFORE TRANSFER-UNIT-GAP FORMING MEMBER ENTERS PRESS-CONTACT PORTION (a)

(b)

IMMEDIATELY AFTER TRANSFER-UNIT-GAP FORMING MEMBER ENTERS PRESS-CONTACT PORTION

IMMEDIATELY AFTER SHEET ENTERS PRESS-CONTACT PORTION

IMMEDIATELY BEFORE SHEET EXITS PRESS-CONTACT PORTION

IMMEDIATELY BEFORE TRANSFER-UNIT-GAP FORMING MEMBER EXITS PRESS-CONTACT PORTION

IMMEDIATELY AFTER TRANSFER-UNIT-GAP FORMING MEMBER EXITS PRESS-CONTACT PORTION (a)

(b)

DURING PRINT STANDBY

REGISTRATION UNIT

TURN OFF
SOLENOID DRIVING CIRCUIT

TRANSFER UNIT

TURN ON
SOLENOID DRIVING CIRCUIT

DURING ENTRANCE OF SHEET INTO TRANSFER PRESS-CONTACT PORTION

DURING EXIT OF SHEET FROM REGISTRATION-ROLLER PRESS-CONTACT PORTION

DURING EXIT OF SHEET FROM TRANSFER PRESS-CONTACT PORTION

DURING NEXT PRINT STANDBY

REGISTRATION UNIT

TURN OFF
SOLENOID DRIVING CIRCUIT

TRANSFER UNIT

TURN OFF
SOLENOID DRIVING CIRCUIT

MEDIUM THICK PAPER MODE
DURING PRINT STANDBY

TRANSFER UNIT

TURN OFF
SOLENOID DRIVING CIRCUIT

REGISTRATION UNIT

TURN OFF
SOLENOID DRIVING CIRCUIT

MEDIUM THICK PAPER MODE DURING ENTRANCE OF SHEET INTO TRANSFER PRESS-CONTACT-PORTION

MEDIUM THICK PAPER MODE DURING EXIT OF SHEET FROM REGISTRATION-ROLLER PRESS-CONTACT-PORTION

MEDIUM THICK PAPER MODE DURING EXIT OF SHEET FROM TRANSFER PRESS-CONTACT PORTION

MEDIUM THICK PAPER MODE
DURING NEXT SHEET PRINT STANDBY

THICKEST PAPER MODE
DURING PRINT STANDBY

THICKEST PAPER MODE DURING SHEET THICKNESS DETECTION
(AFTER START OF DRIVING OF INTERMEDIATE TRANSFER BELT)

THICKEST PAPER MODE
DURING START OF DRIVING OF REGISTRATION ROLLER

THICKEST PAPER MODE DURING ENTRANCE OF SHEET INTO TRANSFER PRESS-CONTACT PORTION

THICKEST PAPER MODE DURING EXIT OF SHEET FROM REGISTRATION-ROLLER PRESS-CONTACT PORTION

THICKEST PAPER MODE DURING EXIT OF SHEET FROM TRANSFER PRESS-CONTACT PORTION

THICKEST PAPER MODE DURING NEXT SHEET PRINT STANDBY

FIG. 39

THICKNESSES OF SHEET AND GAP FORMING SHEET

| | THIN | THICK |
|---|---|---|
| SHEET | 160 μm | 250 μm |
| GAP FORMING SHEET | 100 μm | 170 μm |

THRESHOLD FOR JUDGMENT ON THIN AND THICK
d1=200 μm

THICK PAPER CONTINUOUS MODE

MEDIUM THICK PAPER CONTINUOUS MODE

SWITCH FROM THICK PAPER MODE TO MEDIUM THICK PAPER MODE

SWITCH FROM MEDIUM THICK PAPER MODE TO THICK PAPER MODE

THICK PAPER CONTINUOUS MODE

MEDIUM THICK PAPER CONTINUOUS MODE

SWITCH FROM THICK PAPER MODE TO MEDIUM THICK PAPER MODE

SWITCH FROM MEDIUM THICK PAPER MODE TO THICK PAPER MODE

IMAGE FORMING APPARATUS INCLUDING A GAP FORMING UNIT

CROSS-REFERENCE TO RELATED APPLICATIONS

The present document incorporates by reference the entire contents of Japanese priority documents, 2006-140333 filed in Japan on May 19, 2006, 2006-140403 filed in Japan on May 19, 2006, and 2007-033506 filed in Japan on Feb. 14, 2007.

BACKGROUND OF THE INVENTION

1. Field of the Invention

The present invention relates to an image forming apparatus.

2. Description of the Related Art

There have been utilized image forming apparatuses that control fluctuation in speed of an image carrier and an intermediate transfer member. For example, Japanese Patent Application Laid-Open No. H6-274051 discloses a conventional image forming apparatus in which, when an image is not formed on an image carrier, at least one of the image carrier and a pressure roll is moved to separate press-contact portions therebetween with a driving force from driving means for driving to rotate the image carrier and, in synchronization with timing when a recording medium enters between the press-contact portions of the image carrier and the pressure roll, releases the separation of the press-contact portions using an urging force of urging means for bringing the image carrier and the pressure roll into press contact with each other.

Japanese Patent Application Laid-Open No. H4-242276 discloses another conventional image forming apparatus that pushes down a transfer member by a push-down amount corresponding to the thickness of a recording medium and forms a gap between an image carrier and the transfer member to control fluctuation in speed of the image carrier that occurs when the recording medium enters a press-contact portion of the image carrier and the transfer member.

Japanese Utility Model Publication No. S56-47639 discloses yet another conventional image forming apparatus in which a concave groove is provided in an image carrier or a transfer member and a gap narrower than the thickness of a recording medium is formed in a press-contact portion of the image carrier and the transfer member to control fluctuation in speed of the image carrier that occurs when the recording medium enters the press-contact portion of the image carrier and the transfer member.

Japanese Patent Application Laid-Open No. S61-90167 discloses yet another conventional image forming apparatus in which a step as a shock absorbing material is provided on a circumference of a roller of a transfer roller or a pressure roller to relax a shock.

In a press-contact portion of a transfer unit of a conventional image forming apparatus, as shown in FIGS. 67 to 70, a sheet 58 is conveyed to the press-contact portion of a counter roller 56 and a transfer roller 57 in synchronization with a leading end of a toner image on an intermediate transfer belt 52. The toner image born on the intermediate transfer belt 52 is transferred onto the sheet 58 with a pressing force by a compression spring 59 and a transfer bias (not shown). A state at the time when a leading end of the sheet 58 enters the press-contact portion of the transfer unit is shown in FIGS. 67 and 68. A state at the time when a trailing end of the sheet 58 exits the press-contact portion of the transfer unit is shown in FIGS. 69 and 70. Sectional views of the transfer unit in a width direction of the sheet 58 are shown in FIGS. 67 (*a*), 68 (*a*), 69 (*a*), and 70 (*a*). Sectional views of the transfer unit in a conveying direction of the sheet 58 are shown in FIGS. 67 (*b*), 68 (*b*), 69 (*b*), and 70 (*b*). When the leading end of the sheet 58 enters the press-contact portion of the transfer unit, as shown in FIG. 67 (*b*), the transfer roller 57 is pressed against the intermediate transfer belt 52 by the compression spring 59 and the leading end of the sheet 58 is caught between the intermediate transfer belt 52 and the transfer roller 57 and enters the press-contact portion. As shown in FIG. 68 (*b*), the transfer roller 57 is pushed down by an amount equivalent to the thickness of the sheet 58. When the trailing end of the sheet 58 exits the press-contact portion of the transfer unit, as shown in FIG. 70 (*b*), the transfer roller 57 pushed down as shown in FIG. 69 (*b*) is pushed up by a pressing force of the compression spring 59 by an amount equivalent to the thickness of the sheet 58 to come into a state after the passage of the sheet 58.

In a conventional image forming apparatus, as shown in FIG. 71, toner images are formed by image forming units 201Y, 201M, 201C, and 201BK corresponding to four colors of yellow, magenta, cyan, and black, respectively, primarily transferred onto an intermediate transfer belt 204, and carried by the intermediate transfer belt 204. The intermediate transfer belt 204 is stretched and suspended by a belt driven roller 208, a counter roller 209, a belt stretching and suspending roller 210, and the like. A belt driving roller 207 is driven by a belt driving motor 205 and a belt driving gear 206. A recording sheet 228 is conveyed by a sheet separating mechanism (not shown) and conveying means and registered by a registration roller pair 212 at desired timing and passes a recording sheet conveying path 213. A leading end of the recording sheet 228 passes a sheet registration sensor 221. The recording sheet 228 is conveyed to a secondary transfer nip section where the intermediate transfer belt 204 is nipped by the counter roller 209 and a transfer roller 215. The recording sheet 228 is heated and fixed by a fixing roller pair 214 and output.

However, in the image forming apparatus described in Japanese Patent Application Laid-Open No. H6-274051, since the press-contact portions are separated until a recording medium enters between the press-contact portions, it is possible to expect that a rotation load of the image carrier is controlled when the recording medium enters between the press-contact portions. However, when the separation of the press-contact portions is released, since the image carrier, the recording medium, and the transfer roller collide with one another because of the urging force of the urging means, a rotation load is generated in the image carrier to cause deterioration in an image. Specifically, as shown in FIG. 64, when a gap between a transfer roller 503 and an image carrier 501 is released, since the transfer roller 503 collides with the image carrier 501 because of an urging force of a spring 504 coupled to an arm 502, a rotation load is generated.

In the image forming apparatus described in Japanese Patent Application Laid-Open No. H4-242276, the transfer member is pushed down by a push-down amount corresponding to the thickness of the recording medium and the gap is formed between the image carrier and the transfer member to obtain, regardless of the thickness of the recording medium, an effect of reduction in fluctuation of speed at the time when the recording medium enters the press-contact portion. However, since a device for detecting the thickness of the recording medium has to be provided and an amount of adjustment has to be determined according to the thickness of the recording medium to drive the transfer member, the image forming apparatus is expensive and complicated. As shown in FIG. 65, since it is necessary to provide a motor 511 separately from a driving circuit for rollers to form the gap, cost is further increased.

In the image forming apparatus described in Japanese Utility Model Publication No. S56-47639, since the gap is formed using the concave groove, it is possible to expect that a rotation load of the image carrier at the time when a recording medium enters the press-contact portion is controlled. However, since the image carrier or the transfer member comes into contact with only a portion where the concave groove is provided, concentration of stress locally occurs only in that portion. Thus, it is likely that plastic deformation occurs in a long term use. Specifically, as shown in FIG. 66, since an end of a roller 521 is always in press contact with a roller 522, local concentration of stress occurs in the press-contact portion. Thus, it is likely that the rollers are deformed in a long term use.

In the image forming apparatus described in Japanese Patent Application Laid-Open No. S61-90167, since a gap is formed in a fixed size, a conveying force is insufficient when a recording sheet is thin. Thus, a slip phenomenon in which the recording sheet cannot be conveyed to a downstream side occurs. Further, deficiencies such as a skew phenomenon (skew feeding) occurs because of imbalance of frictional forces at both ends of the rollers.

In a conventional electrophotographic image forming apparatus, a transfer system may be employed for transferring an image onto a recording sheet by pressing a transfer roller against an image carrier while the recording sheet is nipped between the transfer roller and the image carrier. In general, in the image forming apparatus, a phenomenon in which conveying speed of the image carrier temporarily falls when a leading end of the recording sheet enters a press-contact portion of the transfer roller and the image carrier occurs. In particular, the phenomenon is more conspicuous as a recording sheet is thicker. In recent years, since a distance from a registration roller to the press-contact portion of the transfer roller and the image carrier is reduced according to the demand for reduction in size of apparatuses, fluctuation in speed of the image carrier imposes a problem more serious than in the past.

Because of this phenomenon, linear speed of not only a transfer process but also processes of cleaning, exposure, and development performed on a photosensitive member fluctuates. Thus, image failures called banding such as streaks in a main scanning direction, band-like density unevenness in a sub-scanning direction, and image deviation occur.

As shown in FIGS. 67 to 70, in the conventional image forming apparatus, when the leading end of the sheet 58 enters the press-contact portion of the transfer unit, a rotation torque of the counter roller 56 is used via the intermediate transfer belt 52 to push down the transfer roller 57 by an amount equivalent to the thickness of the sheet 58. Thus, a rotation load of the counter roller 56 and a traveling load of the intermediate transfer belt 52 are generated. Therefore, positional deviation occurs in a primary transfer unit between a photosensitive drum and the intermediate transfer belt 52 and image density unevenness occurs in an image formed on the sheet 58. When a distance between the two transfer units, i.e., a distance from the primary transfer unit to the secondary transfer unit is L1, the density unevenness in this case occurs between the leading end of the sheet 58 and a position of L1 from the leading end. On the other hand, when the trailing end of the sheet 58 exits the press-contact portion of the transfer unit, a load torque is generated in a rotating direction of the counter roller 56 via the intermediate transfer belt 52. Thus, the rotation of the counter roller 56 is accelerated and the traveling of the intermediate transfer belt 52 is also accelerated. Therefore, positional deviation occurs in the primary transfer unit and image density unevenness occurs in the image formed on the sheet 58. When a distance from the trailing end of the sheet 58 to a leading end of the next sheet is L2 and the length in the sub-scanning direction of the sheet 58 is L, the density unevenness in this case occurs in a position of L1-L2 from the leading end of the next sheet 58 if L2<L1<L2. The problems described above occur not only in the press-contact portion of the transfer unit but also in the press-contact portion of a registration unit located upstream in the sheet conveying direction of the transfer unit.

As shown in FIG. 71, in the conventional image forming apparatus, transfer roller shafts 215*a* at both ends of the transfer roller 215 are supported by bearings 220 and outer peripheries of the bearings 220 are supported by slide bearing holders 219. The outer sides of the slide bearing holders 219 slides in slide holes 217 opened in a main body side plate 216. Thus, the transfer roller 215 has a degree of freedom in a normal direction that is in contact with the counter roller 209. Moreover, press springs 218 including compression springs are provided between the slide bearing holders 219 and spring receiving sections 216*a*. Thus, when the leading end of the recording sheet 228 reaches the nip section, the transfer roller 215 slides to a lower side in the figure according to the thickness of the recording sheet 228. When the trailing end of the recording sheet 228 exits the nip section, the transfer roller 215 slides to an upper side in the figure according to the thickness of the recording sheet 228. Thus, when the recording sheet 228 is thick, the transfer roller 215 sharply moves up and down when the leading end and the trailing end of the recording sheet 228 pass the nip section.

SUMMARY OF THE INVENTION

It is an object of the present invention to at least partially solve the problems in the conventional technology.

According to an aspect of the present invention, an image forming apparatus includes an image carrier that carries an image and rotates, an image forming unit that forms an image on a surface of the image carrier, a transfer member that rotates in contact with the image carrier, and transfers the image formed on the surface of the image carrier to a recording medium, a conveying unit that conveys the recording medium to a contact position where the image carrier and the transfer member come into contact with each other, and a gap forming unit that forms a gap between the image carrier and the transfer member at the contact position at predetermined timing.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 39 is a table of thicknesses and thresholds of sheets in the image forming apparatus according to the third embodiment;

DETAILED DESCRIPTION OF THE PREFERRED EMBODIMENTS

Exemplary embodiments of the present invention are explained in detail below with reference to the accompanying drawings.

FIGS. 1 to 11 are diagrams of an image forming apparatus according to a first embodiment of the present invention applied to a color laser copying machine.

Figure 1:
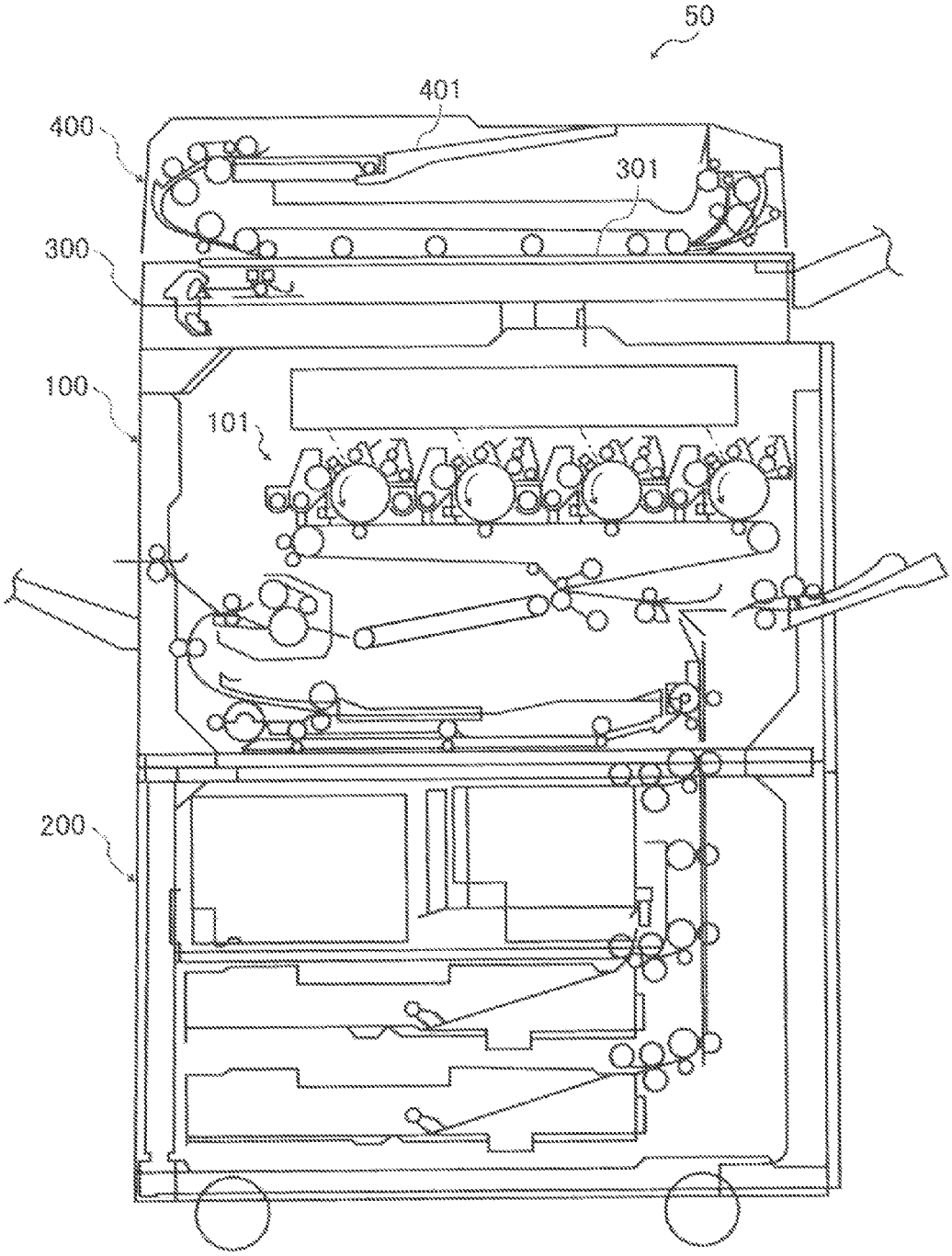
FIG. 1 is a schematic diagram of an image forming apparatus according to a first embodiment of the present invention.

FIG. 1 is a schematic diagram of an image forming apparatus 50. The image forming apparatus 50 includes a printer unit 100, a sheet feeding unit 200, a scanner unit 300, and an original automatic conveying unit 400. The image forming apparatus 50 further includes a control unit (not shown) that controls operations of these units.

The printer unit 100 includes an intermediate transfer unit 101, an exposing device, an image forming unit, a fixing unit, and a toner supplying device and forms an image on a sheet 8 (see FIG. 2) as a recording medium. The sheet feeding unit 200 includes a plurality of sheet feeding cassettes and sheet conveying paths and stores and conveys the sheet 8. The scanner unit 300 includes a contact glass 301 and reads image information of an original placed on the contact glass 301. The original automatic conveying unit 400 includes an original tray 401 and conveys an original placed on the original tray 401 onto the contact glass 301.

Figure 2:
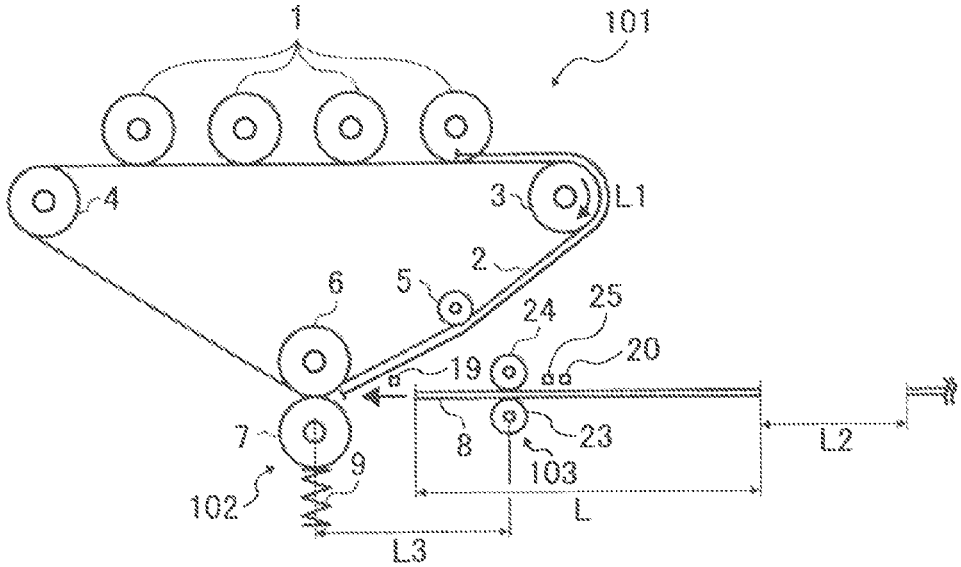
FIG. 2 is a sectional view of an intermediate transfer unit of the image forming apparatus shown in FIG. 1.

FIG. 2 is a sectional view of the intermediate transfer unit 101. The intermediate transfer unit 101 includes an intermediate transfer belt 2 as an image carrier, a driving roller 3, a driven roller 4, a tension roller 5, and a counter roller 6. The intermediate transfer belt 2 as the image carrier is stretched and suspended by the driving roller 3, the driven roller 4, the tension roller 5, and the counter roller 6 and driven clockwise in the figure by the driving roller 3. The intermediate transfer belt 2 carries toner images primarily transferred from four photosensitive drums 1 corresponding to respective colors of cyan, magenta, yellow, and black. The intermediate transfer belt 2 moves the toner images to the counter roller 6 and a transfer roller 7 provided to come into press contact with the counter roller 6. The transfer roller 7 is supported by a transfer roller shaft 10 and rotates while being in contact with the intermediate transfer belt 2 below the counter roller 6. Both ends of the transfer roller shaft 10 are urged upward by compression springs 9. The transfer roller 7 is pressed against the counter roller 6 by an urging force of the compression springs 9. The counter roller 6 and the transfer roller 7 secondarily transfer the toner images born by the intermediate transfer belt 2 to the sheet 8. A registration roller 23 and a registration pressure roller 24 that convey the sheet 8 to a press-contact portion, where the counter roller 6 and the transfer roller 7 come into press contact with the intermediate transfer belt 2, are provided on the right side of the counter roller 6 and the transfer roller 7. The registration roller 23 is driven by a motor (not shown). The registration pressure roller 24 is driven in contact with the registration roller 23. A sheet thickness sensor 20 that detects the thickness of the sheet 8 and a registration-unit-sheet-passage sensor 25 that detects passage of the sheet 8 are provided on a path on an upstream side in a sheet conveying direction of the registration roller 23 and the registration pressure roller 24. A transfer-unit-sheet-passage sensor 19 that detects the entrance of a leading end of the sheet 8 into a transfer unit 102 and detects that a trailing end of the sheet 8 has exited the transfer unit 102 is provided on a path on a downstream side in the sheet conveying direction of the registration roller 23 and the registration pressure roller 24. During a transfer operation, the sheet 8 fed from the sheet feeding unit 200 is once put on standby in a place where the registration roller 23 and the registration pressure roller 24 are set. When a toner image is transferred onto the intermediate transfer belt 2, the counter roller 6 and the transfer roller 7 are conveyed to the press-contact portion, which comes into press contact with the intermediate transfer belt 2, by the registration roller 23 and the registration pressure roller 24 in synchronization with a leading end of the toner image on the intermediate transfer belt 2. The image born by the intermediate transfer belt 2 is transferred onto the sheet 8, which is nipped by the intermediate transfer belt 2 and the transfer roller 7 in the press-contact portion, by a pressing force of the compression springs 9 and a transfer bias (not shown). In this way, the image forming apparatus 50 employs an intermediate transfer system for secondarily transferring a toner image, which is transferred onto the intermediate transfer belt 2 by primary transfer, onto the sheet 8, which is nipped and conveyed by the registration roller 23 and the registration pressure roller 24, with the transfer roller 7. The counter roller 6 and the transfer roller 7 constitute the transfer unit 102. The registration roller 23 and the registration pressure roller 24 constitute a registration unit 103. The image carrier is not limited to the intermediate transfer belt 2 and may be an intermediate transfer drum or a photosensitive drum.

Figure 3:
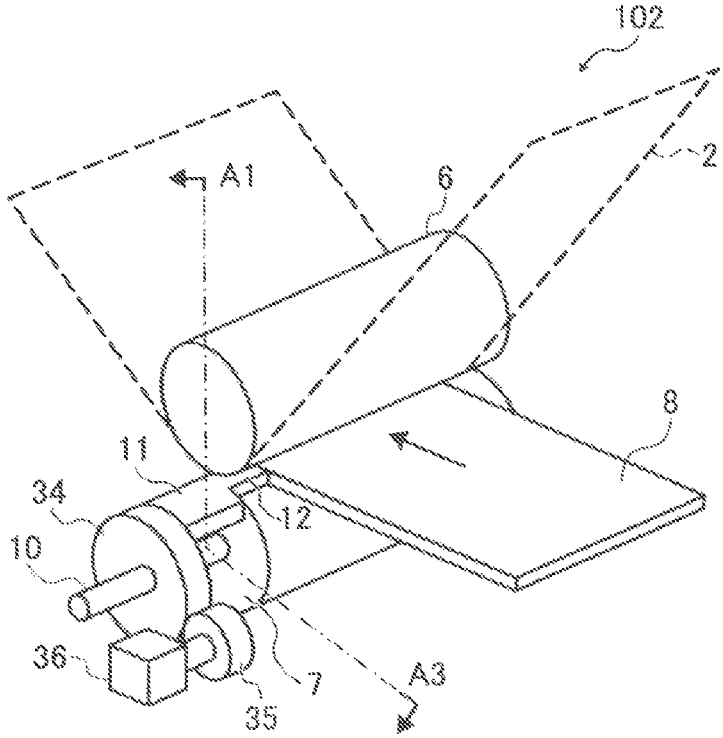
FIG. 3 is a perspective view of a transfer unit of the image forming apparatus shown in FIG. 1.
Figure 4:
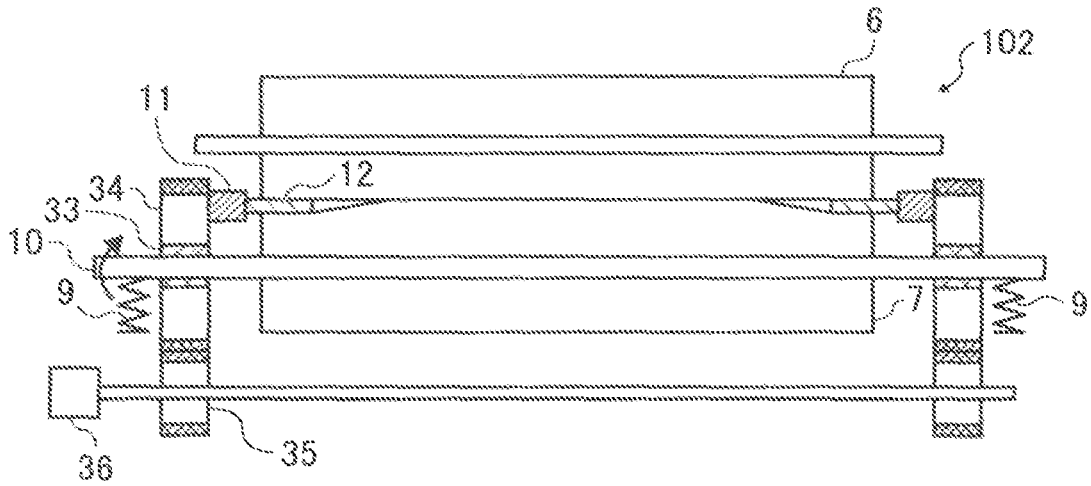
FIG. 4 is a sectional view of the transfer unit shown in FIG. 3.

FIGS. 3 and 4 are perspective view and a sectional view of the transfer unit 102, respectively. The transfer unit 102 includes, in the press-contact portion where the counter roller 6 and the transfer roller 7 come into press contact with the intermediate transfer belt 2, transfer-unit-gap forming members 12 that forms a gap at predetermined timing between the intermediate transfer belt 2 and the transfer roller 7 and transfer-unit-gap-forming-member supporting members 11 that supports the transfer-unit-gap forming members 12. The thickness of the transfer-unit-gap forming members 12 is set smaller than the thickness of the sheet 8. The transfer unit 102 further includes large gears 34 rotatably supported by the transfer roller shaft 10 via bearings 33 and attached with the transfer-unit-gap-forming-member supporting members 11, small gears 35 that mesh with the large gears 34, and a transfer-unit stepping motor 36 that drives the small gears 35. The transfer-unit stepping motor 36 drives the small gears 35 and the large gears 34 to rotate. The transfer-unit-gap-forming-member supporting members 11 set in the large gears 34 rotate around the transfer roller shaft 10. The transfer-unit-gap forming members 12 are nipped between the intermediate transfer belt 2 and the transfer roller 7. The intermediate transfer belt 2 and the transfer-unit-gap-forming-member supporting members 11 are nipped between the counter roller 6 and the transfer roller 7. The transfer-unit-gap-forming-member supporting members 11 are nipped between the intermediate transfer belt 2 and the transfer roller 7. The registration unit 103 may have a structure same as the structure of the transfer unit 102 shown in FIGS. 3 and 4.

Figure 5:
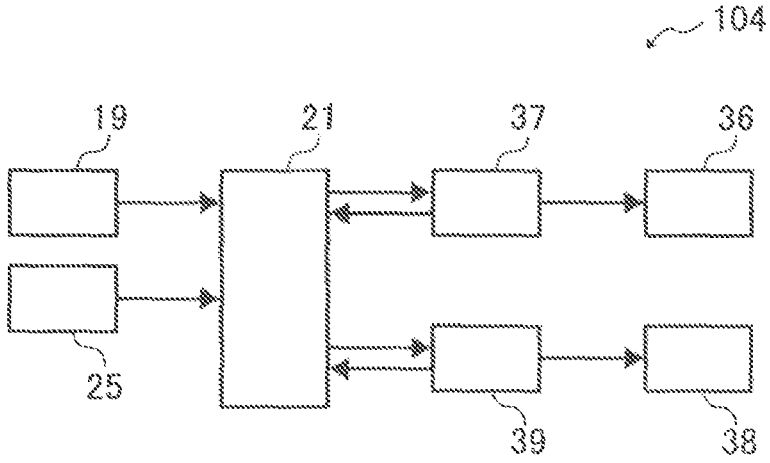
FIG. 5 is a block diagram of a control unit of the transfer unit shown in FIG. 3.

FIG. 5 is a diagram of a control unit 104 that controls driving of the transfer-unit stepping motor 36. The control unit 104 includes the transfer-unit-sheet-passage sensor 19, the registration-unit-sheet-passage sensor 25, a microprocessor 21, a transfer-unit-stepping-motor driving circuit 37, the transfer-unit stepping motor 36, a registration-unit-stepping-motor driving circuit 39, and a registration-unit stepping motor 38. The microprocessor 21 causes the transfer-unit-stepping-motor driving circuit 37 to perform one full rotation of the transfer-unit stepping motor 36 and bring the transfer-unit stepping motor 36 to a standstill when the entrance of the leading end of the sheet 8 into the transfer unit 102 is detected by the transfer-unit-sheet-passage sensor 19 and when the exit of the trailing end of the sheet 8 from the transfer unit 102 is detected by the transfer-unit-sheet-passage sensor 19. The microprocessor 21 performs one full rotation of the registration-unit stepping motor 38 and brings the registration-unit stepping motor 38 to a standstill using the registration-unit-stepping-motor driving circuit 39 when the exit of the trailing end of the sheet 8 from the registration unit 103 is detected by the registration-unit-sheet-passage sensor 25. A gap is formed in the transfer unit 102 or the registration unit 103 when the leading end of the sheet 8 enters the transfer unit 102, when the trailing end of the sheet 8 exits the transfer unit 102, and when the trailing end of the sheet 8 exits the registration unit 103. Consequently, fluctuation in speed of the intermediate transfer belt 2 is controlled. Rotation speed of the registration-unit stepping motor 38 only has to be set taking into account a reduction gear ratio such that rotation speed of the transfer-unit-gap-forming-member supporting members 11 is equal to that of the transfer roller shaft 10.

Figure 6:
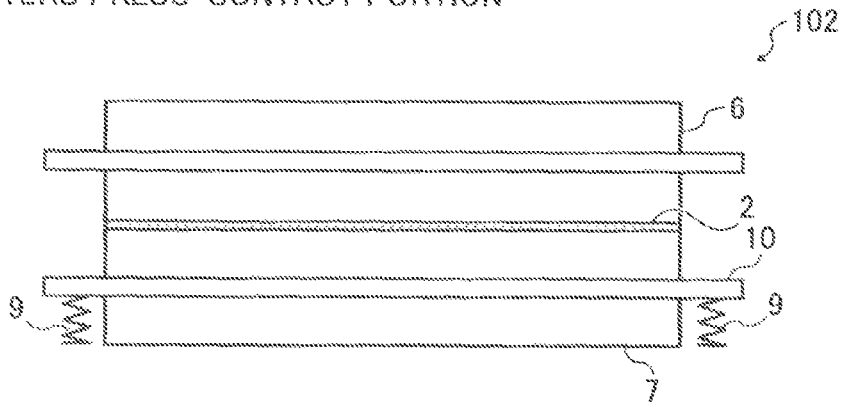
FIGS. 6 to 11 are sectional views of the transfer unit shown in FIG. 3.
Figure 6:
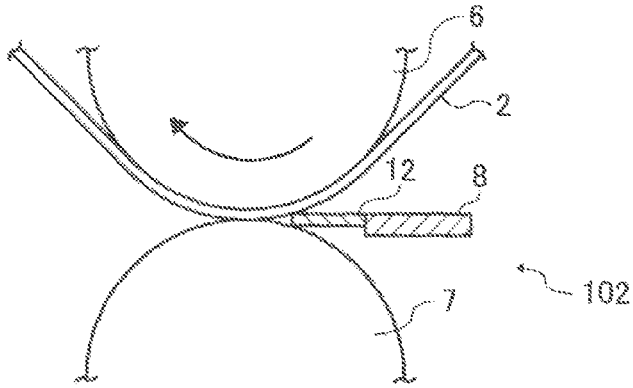
Figure 7:
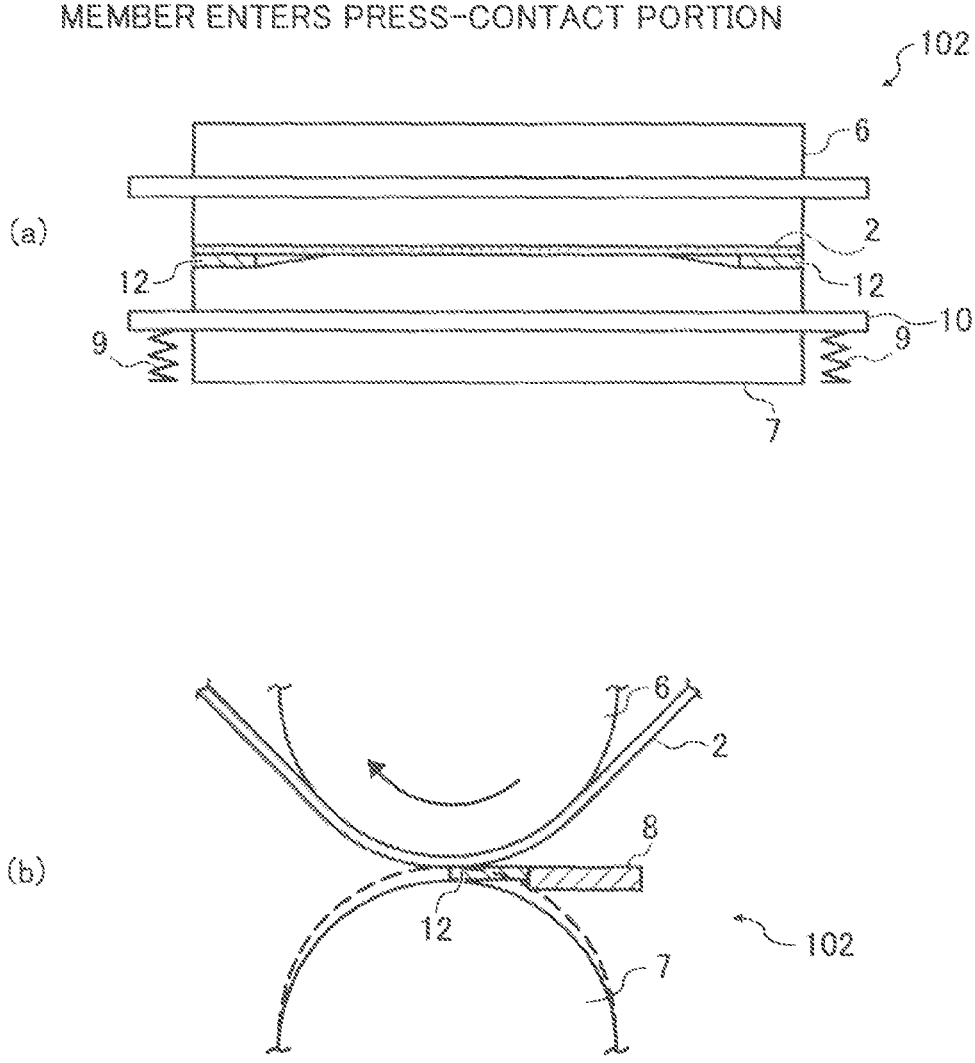
Figure 8:
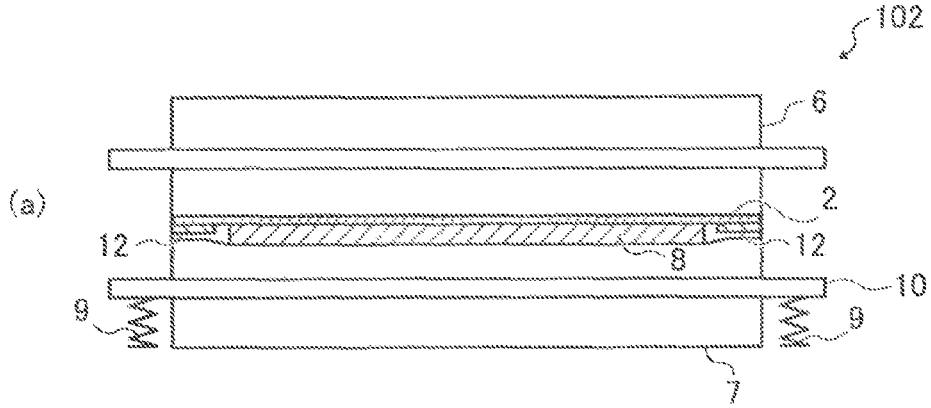
Figure 8:
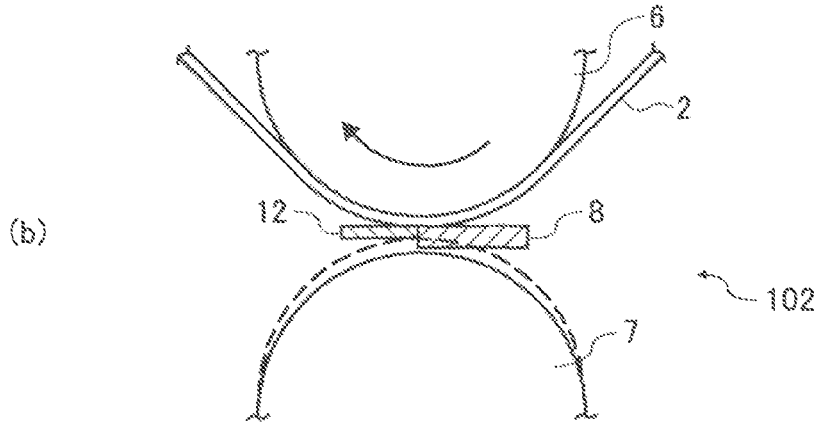

FIGS. 6 to 8 are schematic diagrams for explaining a relation of the transfer-unit-gap forming members 12, the sheet 8, the counter roller 6, the intermediate transfer belt 2, and the transfer roller 7 in a process in which the leading end of the sheet 8 passes the transfer unit 102. FIGS. 6 (*a*), 7 (*a*), and 8 (*a*) are sectional views of the transfer unit 102 in the width direction of the sheet 8, i.e., the main scanning direction. FIGS. 6 (*b*), 7 (*b*), and 8 (*b*) are sectional views of the transfer unit 102 in the conveying direction of the sheet 8, i.e., the sub-scanning direction.

FIG. 6 depicts a state immediately before the transfer-unit-gap-forming members 12 enter the press-contact portion of the transfer unit 102. In this state, the transfer roller 7 is pressed against the intermediate transfer belt 2 by the compression springs 9. The leading ends of the transfer-unit-gap forming members are caught between the intermediate transfer belt 2 and the transfer roller 7 and start to enter the press-contact portion.

FIG. 7 depicts a state immediately after the transfer-unit-gap forming members 12 have entered the press-contact portion of the transfer unit 102. In this state, the transfer roller 7 is pushed down by an amount equivalent to the thickness of the transfer-unit-gap forming members 12. The transfer roller 7 is pushed down from a position indicated by a broken line to a position indicated by a solid line in FIG. 7 (*b*).

In a process of the shift from the state in FIG. 6 to the state in FIG. 7, a rotation torque of the counter roller 6 is used via the intermediate transfer belt 2 to push down the transfer roller 7 by an amount equivalent to the thickness of the transfer-unit-gap forming members 12. Thus, a fixed amount of a rotation load is generated in the counter roller 6 and a fixed amount of a traveling load is generated in the intermediate transfer belt 2. However, in this embodiment, the thickness of the transfer-unit-gap forming members 12 is set smaller than that of the sheet 8 and the transfer-unit-gap forming members 12 are nipped between the transfer roller 7 and the intermediate transfer belt 2 only at an axial direction end of the transfer roller 7. Thus, fluctuation in speed of the intermediate transfer belt 2 is not caused so greatly as to cause image unevenness. When the transfer roller 7 is an elastic member such as rubber used in a general electrophotographic process and hardness thereof is about ASKER-C 20° to 70° used in the general electrophotographic process, after the transfer-unit-gap forming members 12 have entered the press-contact portion of the transfer unit 102, the surface of the transfer roller 7 is pushed down near the transfer-unit-gap forming members 12 at both the ends of the transfer roller 7. Near the center of the transfer roller 7, the transfer roller 7 and the counter roller 6 are come into press contact with the intermediate transfer belt 2 in a state in which a pressing force is reduced compared with that at the time when the transfer-unit-gap forming members 12 are not provided.

FIG. 8 depicts a state immediately after the sheet 8 has entered the press-contact portion of the transfer unit 102. Since a pressing force in an entrance portion of the sheet 8 is already reduced in the state shown in FIG. 7, fluctuation in speed that occurs in the intermediate transfer belt 2 in a process of the shift from the state shown in FIG. 7 to the state shown in FIG. 8 is controlled to be smaller than that in the past. When the thickness of the transfer-unit-gap forming members 12 is set without taking into account the thickness of the sheet 8, it is likely that a predetermined pressing force is not applied to the sheet 8 and desired transfer performance is not obtained unless an area of the transfer roller 7 in contact with the transfer-unit-gap forming members 12 is reduced as much as possible after the sheet 8 enters the press-contact portion of the transfer unit 102. However, in this embodiment, the thickness of the transfer-unit-gap forming members 12 is set to an appropriate value corresponding to a balance between the thickness and transfer performance, specifically, a value smaller than the thickness of the sheet 8 to solve the deficiencies. To further reduce fluctuation in speed of the intermediate transfer belt 2, it is preferable to set an axial direction length of the transfer-unit-gap forming members 12 as long as possible in a non-image forming area through which the toner image on the transfer roller 7 does not pass.

Figure 9:
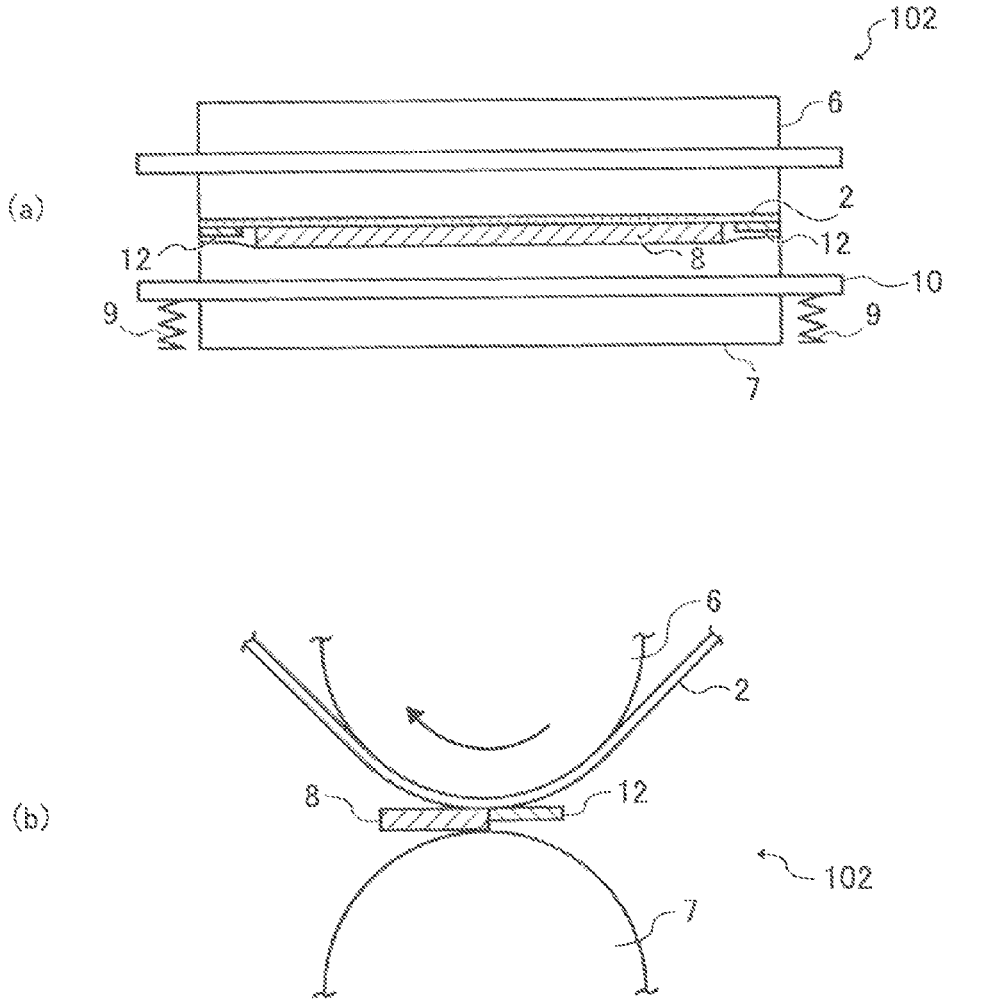
Figure 10:
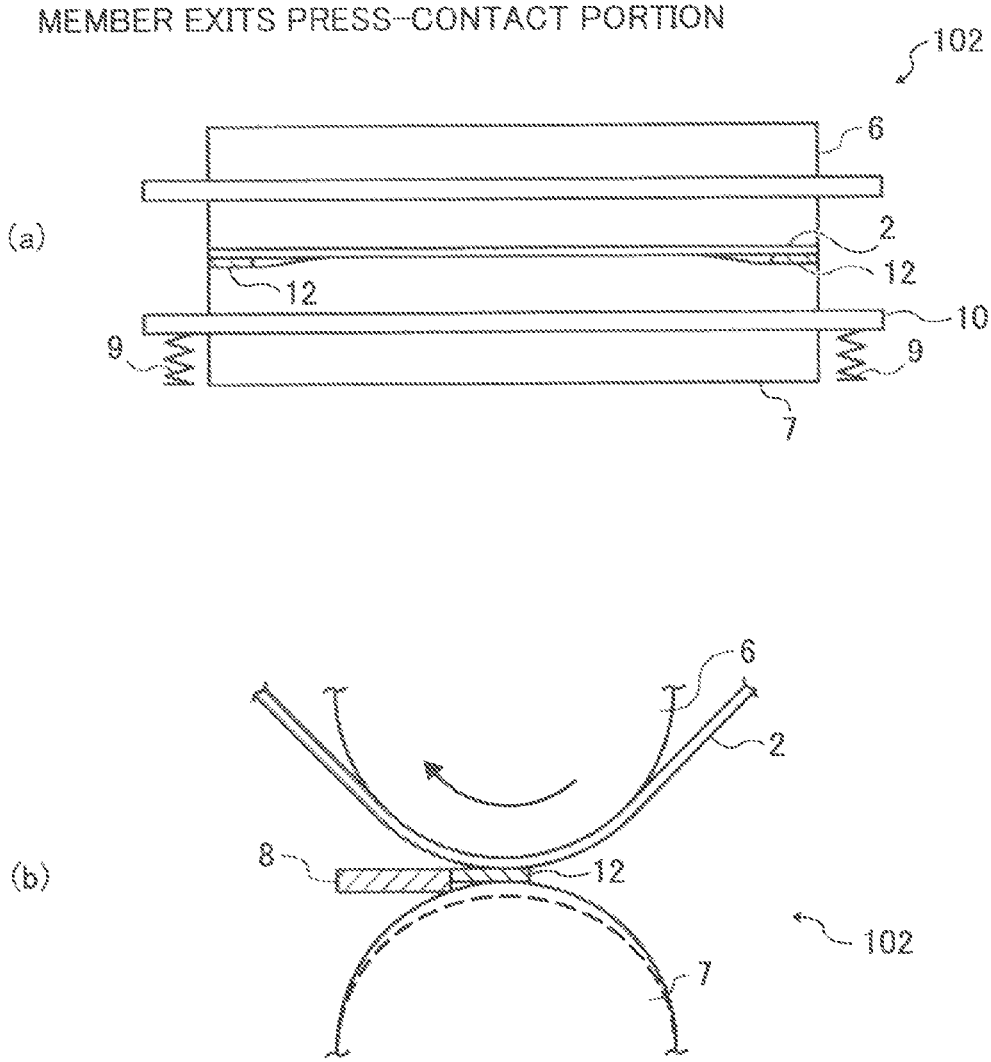
Figure 11:
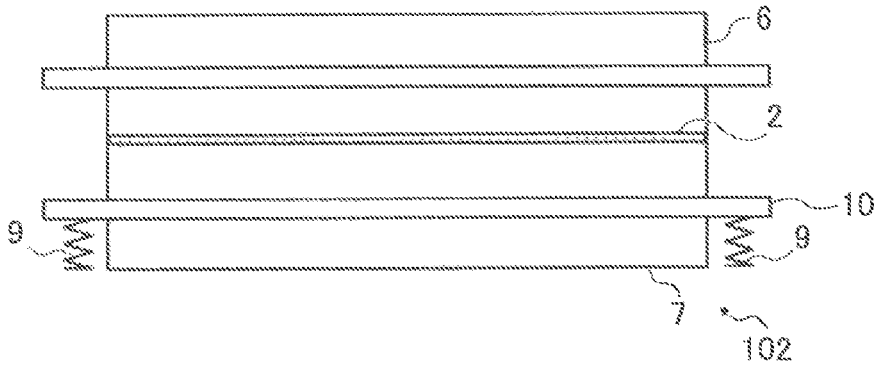
Figure 11:
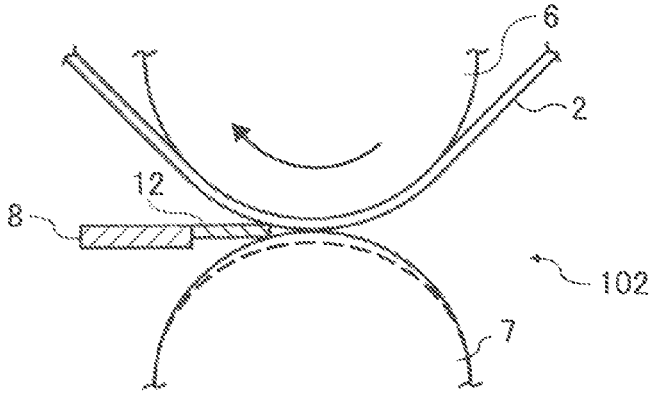

FIGS. 9 to 11 are schematic diagrams for explaining a relation among the transfer-unit-gap forming members 12, the sheet 8, the counter roller 6, the intermediate transfer belt 2, and the transfer roller 7 in a process of the passage of the trailing end of the sheet 8 through the transfer unit 102.

FIG. 9 depicts a state immediately before the sheet 8 exits the press-contact portion of the transfer unit 102. In this state, the transfer roller 7 is pushed down by an amount equivalent to the thickness of the sheet 8.

FIG. 10 depicts a state immediately before the trailing ends of the transfer-unit-gap forming members 12 exit the press-contact portion of the transfer unit 102. In a process of the shift from the state in FIG. 9 to the state in FIG. 10, the transfer roller 7 pushed down by the sheet 8 is subjected to a pressing force by the compression springs 9 and pushed up by an amount equivalent to a difference between the thickness of the sheet 8 and the thickness of the transfer-unit-gap forming members 12. The transfer roller 7 is pushed up from a position indicated by a broken line to a position indicated by a solid line in FIG. 10 (*b*). In a process of the shift from the state in FIG. 9 to the state in FIG. 10, a load torque is generated in the rotating direction of the counter roller 6 via the intermediate transfer belt 2. Thus, the rotation of the counter roller 6 is accelerated and the traveling of the intermediate transfer belt 2 is accelerated. Therefore, in this embodiment, a load torque generated is small compared with that at the time when the transfer roller 7 is pushed up by an amount equivalent to the thickness of the sheet 8 as in the past. Thus, the acceleration of the rotation of the counter roller 6 and the acceleration of the traveling of the intermediate transfer belt 2 are reduced.

FIG. 11 depicts a state immediately after the trailing ends of the transfer-unit-gap forming members 12 exit the press-contact portion of the transfer unit 102. In a process of the shift from the state in FIG. 10 to the state in FIG. 11, the transfer roller 7 pushed down is subjected to a pressing force by the compression springs 9 and pushed up by an amount equivalent to the thickness of the transfer-unit-gap forming members 12. The transfer roller 7 is pushed up from a position indicated by a broken line to a position indicated by a solid line in FIG. 11 (*b*). Therefore, in this embodiment, a load torque generated is reduced compared with that at the time when the transfer roller 7 is pushed up by an amount equivalent to the thickness of the sheet 8 as in the past. The acceleration of the rotation of the counter roller 6 and the acceleration of the traveling of the intermediate transfer belt 2 are reduced. Like the transfer unit 102, the registration unit 103 can include gap forming members. In that case, acceleration of the registration roller 23, the registration pressure roller 24, and the trailing end of the sheet 8 is reduced.

When the thickness of the transfer-unit-gap forming members 12 is reduced to a degree not increasing a rotation load applied to the intermediate transfer belt 2 and timing of the rotation of the transfer-unit-gap forming members 12 and the conveyance of the sheet 8 is controlled to prevent the trailing ends of the transfer-unit-gap forming members 12 and the leading end of the sheet 8 from colliding with each other, the transfer-unit-gap forming members 12 may overlap an image forming area in the sheet 8 through which a toner image passes.

The function of the transfer-unit-sheet-passage sensor 19 may be substituted by the registration-unit-sheet-passage sensor 25. In that case, since the passage of the sheet 8 in the transfer unit 102 is calculated from detection information of the registration-unit-sheet-passage sensor 25, the transfer-unit-sheet-passage sensor 19 is unnecessary. Thus, it is possible to reduce cost.

As described above, in this embodiment, the gap is formed in the press-contact portion in which the counter roller 6 and the transfer roller 7 come into press contact, i.e., come into contact with the intermediate transfer belt 2 at a predetermined pressure in the transfer unit 102. Thus, it is possible to reduce a rotation load generated in the intermediate transfer belt 2 when, for example, the sheet 8 enters a contact position. If the gap is always formed, it is likely that the intermediate transfer belt 2, the counter roller 6, and the transfer roller 7 are deformed by abrasion and the like. However, in this embodiment, since the gap is formed only at predetermined timing, it is possible to prevent the intermediate transfer belt 2, the counter roller 6, and the transfer roller 7 from being deformed.

In this embodiment, the gap is formed only immediately before the sheet 8 enters the press-contact portion of the transfer unit 102, only immediately before the sheet 8 exits the press-contact portion of the transfer unit 102, or only immediately before the sheet 8 exits the press-contact portion of the registration unit 103. Thus, it is possible to prevent the intermediate transfer belt 2, the counter roller 6, and the transfer roller 7 from being deformed.

In this embodiment, the transfer-unit-gap forming members 12 are rotated in the same direction as the rotating direction of the intermediate transfer belt 2, the counter roller 6, and the transfer roller 7 and inserted into and nipped in the position of the contact of the intermediate transfer belt 2 and the transfer roller 7 from the same direction as the direction of the contact. Thus, it is possible to effectively reduce a rotation load at the time when the gap is formed. If registration-unit-gap forming members 27 are inserted and nipped from the same direction as the rotating direction of the registration roller 23 and the registration pressure roller 24, it is possible to effectively reduce a rotation load at the time when the gap is formed.

The image forming apparatus 50 according to a second embodiment of the present invention is configured to eliminate the need to separately provide a driving source for driving the transfer-unit-gap-forming-member supporting members 11. In the following explanation of the image forming apparatus 50 according to the second embodiment, components similar to those in the first embodiment are denoted by the identical reference numerals and signs and explanations thereof are omitted.

Figure 12:
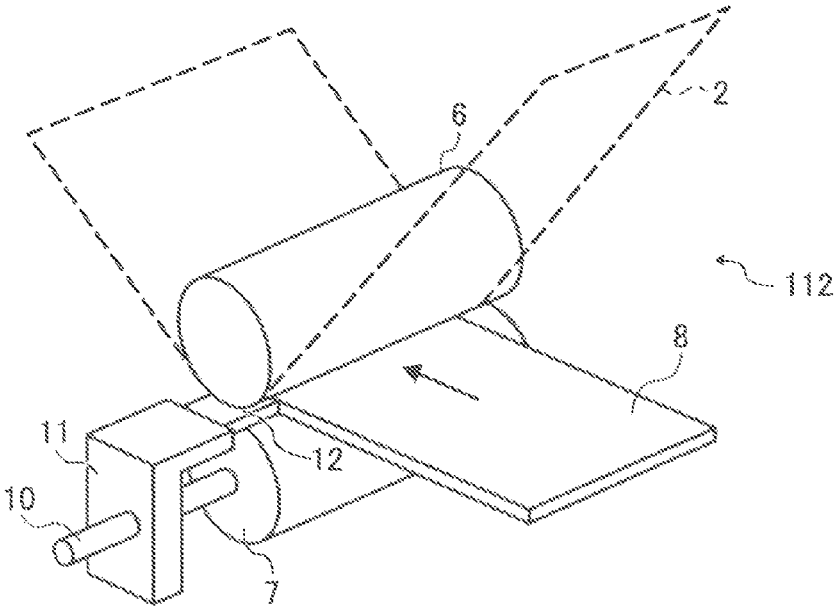
FIG. 12 is a perspective view of a transfer unit of an image forming apparatus according to a second embodiment of the present invention.
Figure 13:
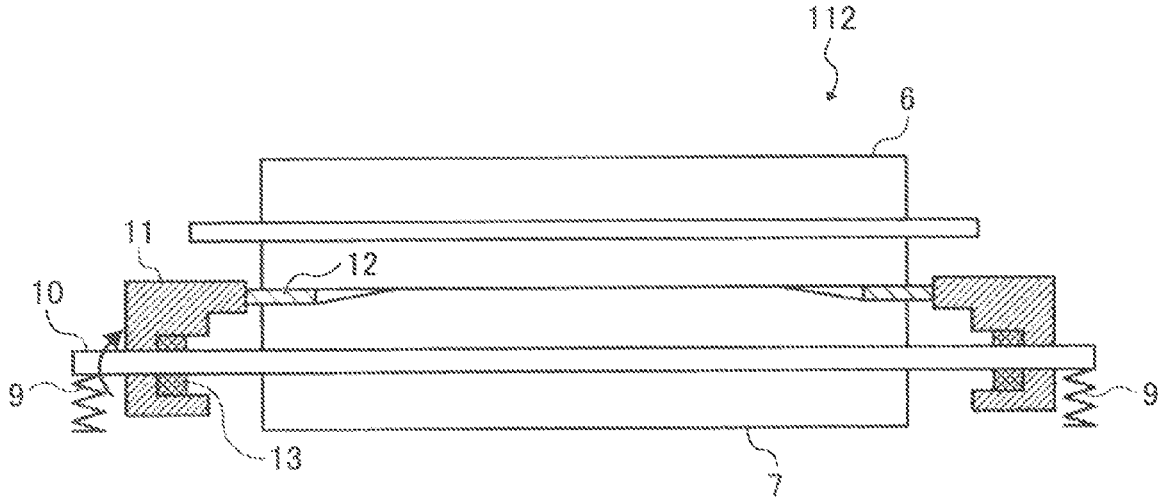
FIG. 13 is a sectional view of the transfer unit shown in FIG. 12.
Figure 15:
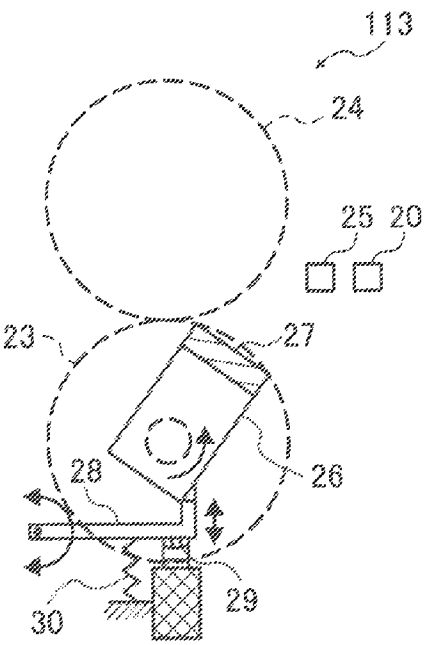
FIGS. 15 to 19 are side views of the transfer unit and a registration unit of the image forming apparatus according to the second embodiment.
Figure 15:
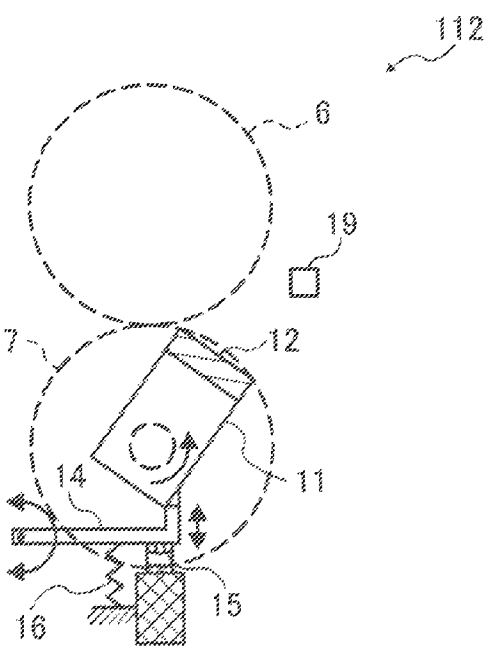
Figure 16:
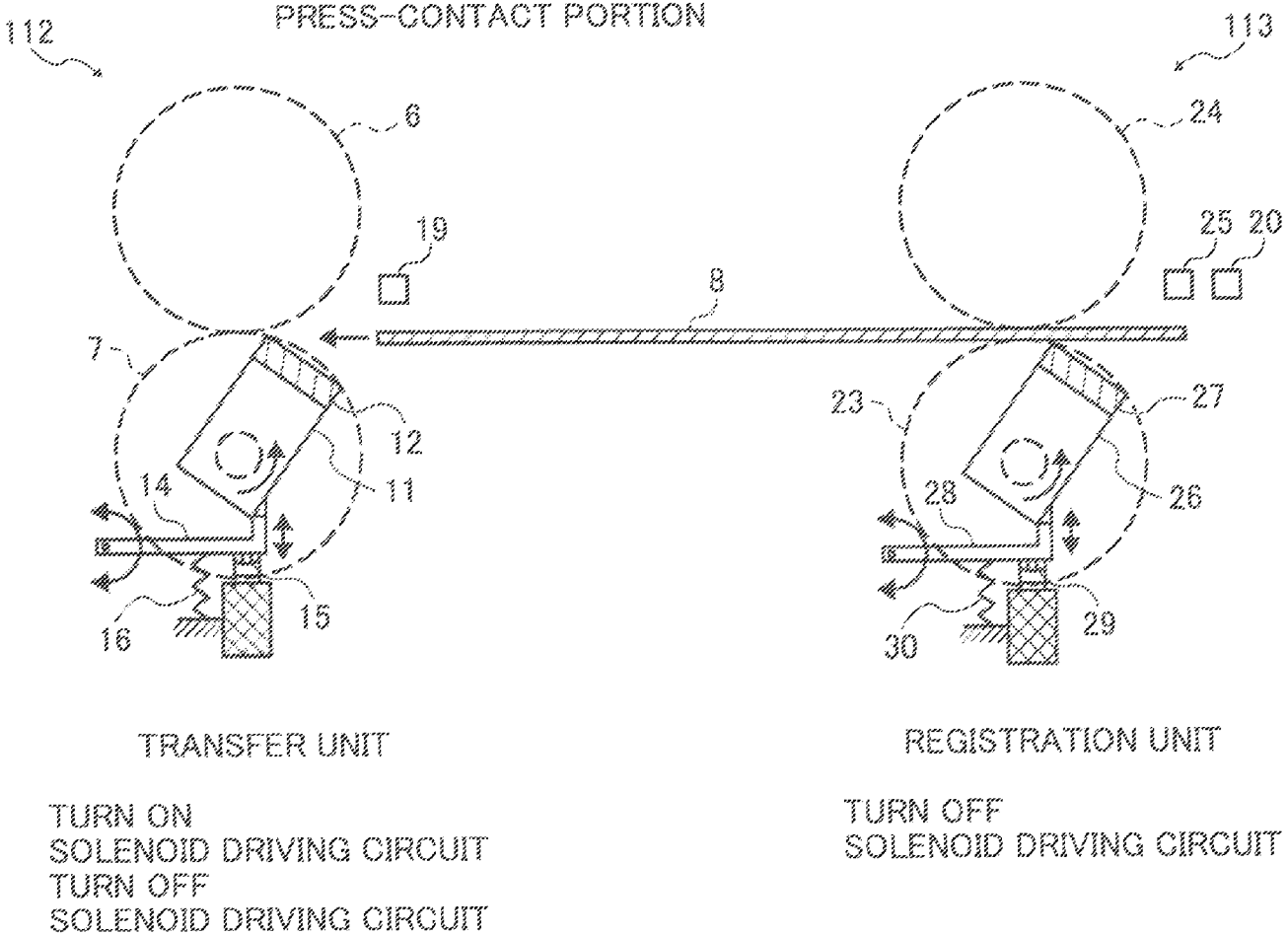

FIGS. 12 and 13 are a perspective view of a transfer unit 112 and a sectional view of the transfer unit 112 in the width direction of the sheet 8. In this embodiment, the transfer unit 112 includes transfer-unit torque limiters 13, which are transmitting members that transmit a rotation driving force of the transfer roller shaft 10 to the transfer-unit-gap-forming-member supporting members 11. The transfer unit 112 uses the transfer roller shaft 10 as a driving source for the transfer-unit-gap forming members 12. The transfer-unit torque limiters 13 are pressed into the transfer-unit-gap-forming-member supporting members 11. The transfer roller shaft 10 is inserted into the transfer-unit torque limiters 13. The rotation driving force of the transfer roller shaft 10 is transmitted to the transfer-unit-gap-forming-member supporting members 11 by the transfer-unit torque limiters 13. The transfer-unit-gap-forming-member supporting members 11 can rotate around the transfer roller shaft 10 with a driving force of the transfer roller shaft 10 if a load torque applied to the transfer-unit torque limiters 13 is equal to or smaller than a set torque. The set torque of the transfer-unit torque limiters 13 is set such that the rotation of the transfer roller shaft 10 is not affected even if a rotational motion of the transfer-unit-gap-forming-member supporting members 11 is controlled. As shown in FIG. 15, a registration unit 113 includes the registration-unit-gap forming members 27, registration-unit-gap-forming-member supporting members 26, and torque limiters (not shown) same as the transfer-unit torque limiters 13. The registration-unit-gap forming members 27 are driven by a driving source that drives the registration roller 23.

Below the transfer-unit-gap-forming-member supporting members 11, as shown in FIG. 15, a transfer unit ratchet 14 is provided to be capable of moving between a position for regulating the rotation of the transfer-unit-gap-forming-member supporting members 11, i.e., a position for controlling the rotation, and a position for allowing the rotation of the transfer-unit-gap-forming-member supporting members 11, i.e., a position for releasing the control of the rotation. A transfer unit solenoid 15 that moves the transfer unit ratchet 14 up and down is connected to a lower part of the transfer unit ratchet 14. A transfer-unit compression spring 16 that urges the transfer unit ratchet 14 upward is also connected to the lower part of the transfer unit ratchet 14. When the transfer unit solenoid 15 is not operating, the transfer unit ratchet 14 moves upward with an urging force of the transfer-unit compression spring 16 and is located in a position for regulating the rotation of the transfer-unit-gap-forming-member supporting members 11. On the other hand, when the transfer unit solenoid 15 operates and moves downward, the transfer unit ratchet 14 moves downward against the urging force of the transfer-unit compression spring 16 and moves to a position for allowing the rotation of the transfer-unit-gap-forming-member supporting members 11.

The registration unit 113 is constituted the same as the transfer unit 112.

Figure 14:
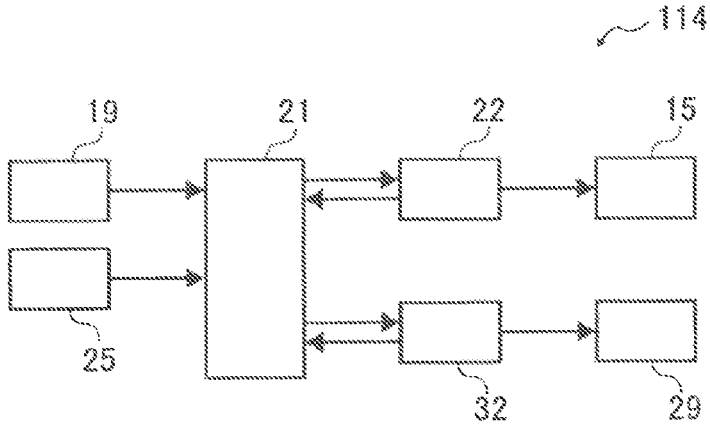
FIG. 14 is a block diagram of a control unit shown in FIG. 12.

FIG. 14 is a diagram of a control unit 114 that controls the transfer unit 112 and the registration unit 113. The control unit 114 includes the transfer-unit-sheet-passage sensor 19, the registration-unit-sheet-passage sensor 25, the microprocessor 21, a transfer-unit-solenoid driving circuit 22, the transfer-unit solenoid 15, a registration-unit-solenoid driving circuit 32, and a registration unit solenoid 29. The microprocessor 21 causes the transfer-unit-solenoid driving circuit 22 to drive the transfer unit solenoid 15 when the entrance of the sheet 8 into the transfer unit 112 is detected by the transfer-unit-sheet-passage sensor 19 and when the exit of the trailing end of the sheet 8 from the transfer unit 112 is detected by the transfer-unit-sheet-passage sensor 19. The microprocessor 21 causes the registration-unit-solenoid driving circuit 32 to drive the registration unit solenoid 29 when the exit of the trailing end of the sheet 8 from the registration unit 113 is detected by the registration-unit-sheet-passage sensor 25. In other words, a gap is formed in the transfer unit 112 or the registration unit 113 to control fluctuation in speed of the intermediate transfer belt 2 when the leading end of the sheet 8 enters the transfer unit 112, when the trailing end of the sheet 8 exits the transfer unit 112, and when the trailing end of the sheet 8 exits the registration unit 113.

FIGS. 15 to 19 are diagrams of control states of a rotational motion of the transfer-unit-gap-forming-member supporting members 11. In FIGS. 15 to 19, side views of the transfer unit 112 and the registration unit 113 are shown. FIG. 20 is a flowchart for explaining operations of the control unit 114 shown in FIG. 14.

During print standby, as shown in FIG. 15, the transfer-unit-solenoid driving circuit 22 and the registration-unit-solenoid driving circuit 32 are off and the transfer unit ratchet 14 and a registration unit ratchet 28 are pushed up by the transfer-unit compression spring 16 and a registration-unit compression spring 30. Thus, the rotation of the transfer-unit-gap-forming-member supporting members 11 and the registration-unit-gap-forming-member supporting members 26 is regulated. During print start, the intermediate transfer belt 2 is driven and the transfer roller shaft 10 rotates according to the driving of the intermediate transfer belt 2. However, since the transfer unit ratchet 14 is pushed up by the transfer-unit compression spring 16, the rotation of the transfer-unit-gap-forming-member supporting members 11 is regulated. Even if the registration roller 23 is driven and the conveyance of the sheet 8 is started, since the registration unit ratchet 28 is pushed up by the registration-unit compression spring 30, the rotation of the registration-unit-gap-forming-member supporting members 26 is regulated.

During print standby, the control unit 114 judges whether a set mode is a thick paper mode (step S1). When the set mode is the thick paper mode, the control unit 114 judges whether a print request is made (step S2). When a print request is made, the control unit 114 starts driving of the intermediate transfer belt 2 (step S3).

During the entrance of a sheet into the transfer press-contact portion, as shown in FIG. 6, while a user selects the thick paper mode, when passage of the leading end of the sheet 8 is detected by the transfer-unit-sheet-passage sensor 19, the transfer unit solenoid 15 is driven by the transfer-unit-solenoid driving circuit 22 and the transfer unit ratchet 14 is pulled to move downward. Consequently, the rotational motion of the transfer-unit-gap-forming-member supporting members 11 is allowed, the driving force of the transfer roller shaft 10 is transmitted to the transfer-unit-gap-forming-member supporting members 11 via the transfer-unit torque limiters 13, and the transfer-unit-gap-forming-member supporting members 11 rotate around the transfer roller shaft 10. Thereafter, before the sheet 8 enters the press-contact portion of the transfer unit 112 according to the rotation of the transfer-unit-gap-forming-member supporting members 11, a gap is formed in the press-contact portion of the transfer unit 112 by the transfer-unit-gap forming members 12 and fluctuation in speed of the intermediate transfer belt is controlled. When the transfer-unit-solenoid driving circuit 22 is turned off, the transfer unit ratchet 14 is pushed up by the urging force of the transfer-unit compression spring 16 again. When the transfer-unit-gap-forming-member supporting members 11 make one full rotation and return to their original positions, the transfer-unit ratchet 14 controls the motion of the transfer-unit-gap-forming-member supporting members 11. When the thick paper mode is not selected, the transfer-unit-solenoid driving circuit 22 stands by in the off state. Printing is performed in an image forming cycle for plain paper, i.e., a mode for the sheet 8 having normal thickness smaller than thick paper. The transfer-unit-gap forming members 12 are not inserted into the press-contact portion.

During the entrance of a sheet into the transfer press-contact portion, the control unit 114 judges whether it is detected that the leading end of the sheet 8 has entered the transfer unit 112 (step S4). When the entrance of the sheet 8 is detected, the control unit 114 turns on the transfer unit solenoid 15 (step S5). When the transfer unit solenoid 15 is turned on, the transfer unit ratchet 14 is pulled down and the transfer-unit-gap-forming-member supporting members 11 make one full rotation. The control unit 114 turns off the transfer unit solenoid 15 (step S6). When the transfer unit solenoid 15 is turned off, the transfer unit ratchet 14 is pushed up. When the transfer-unit-gap-forming-member supporting members 11, which have finished the one full rotation, return to their original positions, the transfer unit ratchet 14 regulates the transfer-unit-gap-forming-member supporting members 11.

Figure 17:
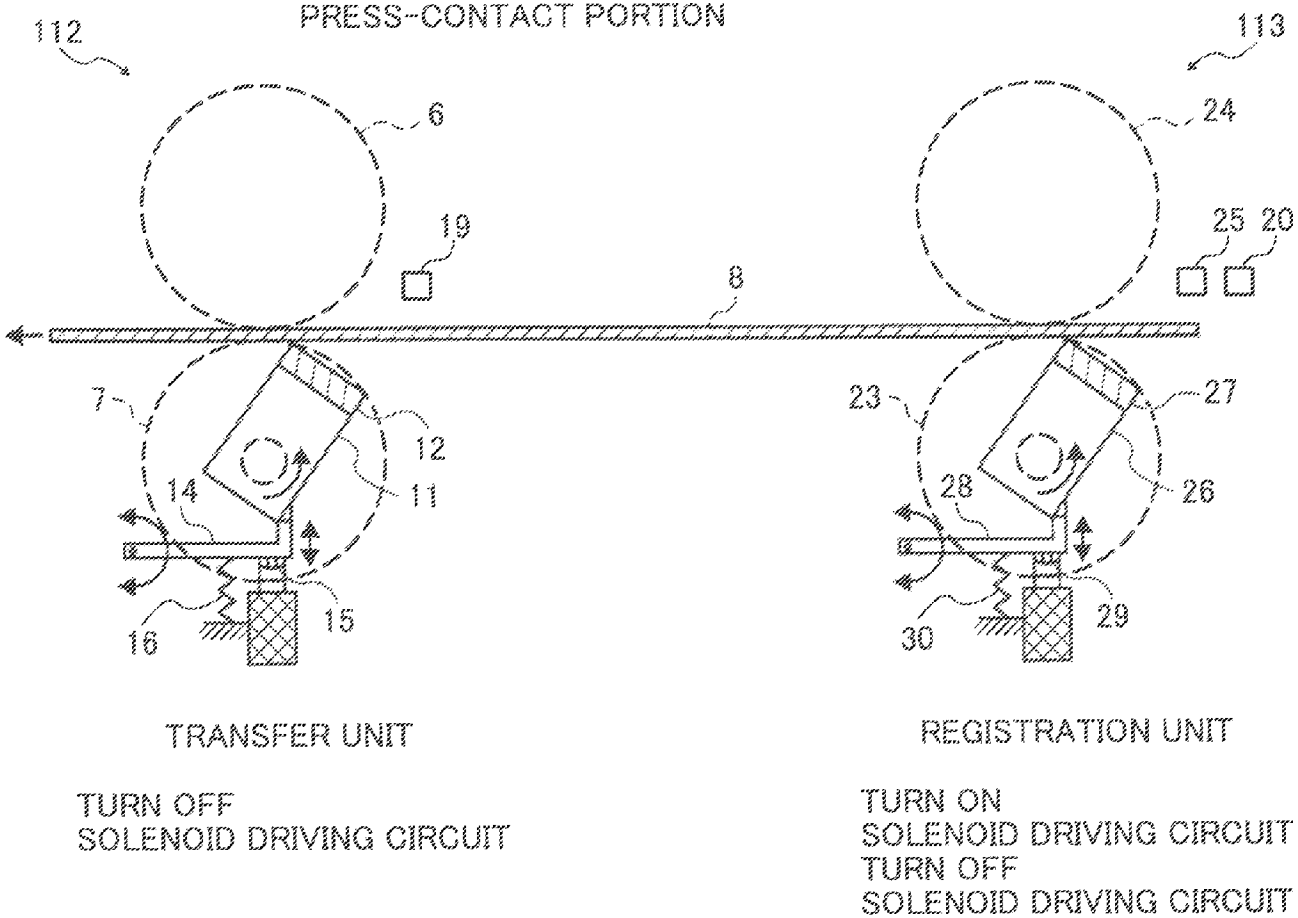

During the exit of a sheet from the registration-roller press-contact portion, as shown in FIG. 17, when passage of the trailing end of the sheet 8 is detected by the registration-unit-sheet-passage sensor 25, the registration unit solenoid 29 is driven by the registration-unit-solenoid driving circuit 32 and the registration-unit ratchet 28 is pulled and moves downward. Consequently, the same operations as above are performed in the registration unit. The registration-unit-gap forming members 27 are inserted into the registration unit 113 before the trailing end of the sheet 8 completely exits the registration unit 113. Acceleration of the registration roller 23, the registration pressure roller 24, and the trailing end of the sheet 8 is relaxed. When the registration-unit-solenoid driving circuit 32 is turned off, the same operations as above are performed. When the registration-unit-gap-forming-member supporting members 26 make one full rotation and return to their original positions, the motion of the registration-unit-gap-forming-member supporting members 26 is regulated.

During the exit of a sheet from the registration-roller press-contact portion, the control unit 114 judges whether it is detected that the trailing end of the sheet 8 has exited the registration unit 113 (step S7). When the exit of the trailing end of the sheet 8 is detected, the control unit 114 turns on the registration unit solenoid 29 (step S8). When the registration unit solenoid 29 is turned on, the registration unit ratchet 28 is pulled down and the registration-unit-gap-forming-member supporting members 26 make one full rotation. The control unit 114 turns off the registration unit solenoid 29 (step S9). When the registration unit solenoid 29 is turned off, the registration unit ratchet 28 is pushed up. When the registration-unit-gap-forming-member supporting members 26, which have finished the one full rotation, return to their original positions, the registration unit ratchet 28 regulates the rotation of the registration-unit-gap-forming-member supporting members 26.

Figure 18:
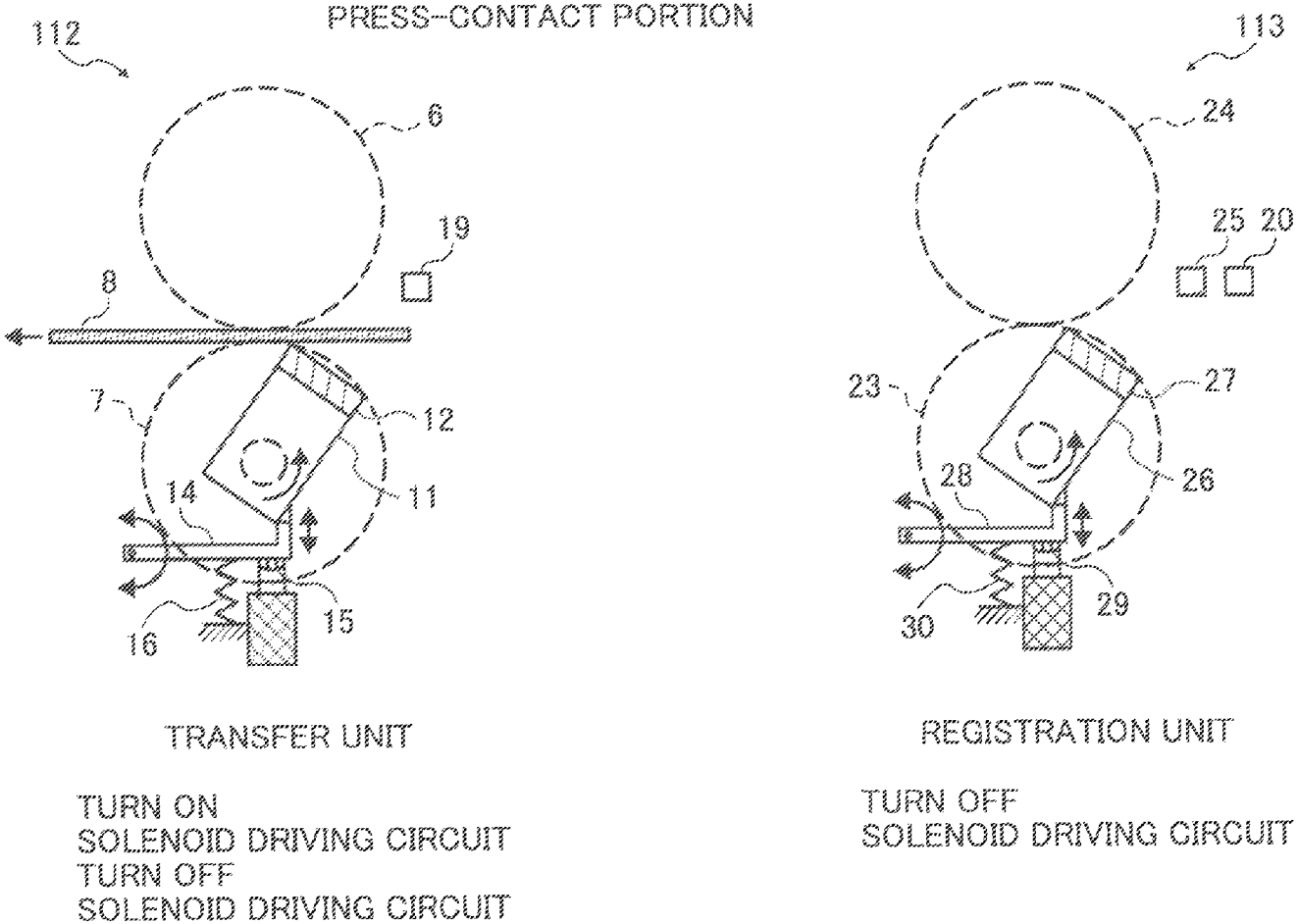

During the exit of a sheet from the transfer press-contact portion, as shown in FIG. 18, when passage of the trailing end of the sheet 8 is detected by the transfer-unit-sheet-passage sensor 19, the same operations as above are performed in the transfer unit 112. The transfer-unit-gap-forming members 12 are inserted into the transfer unit 112 before the trailing end of the sheet 8 completely exits the transfer unit 112. Acceleration of the intermediate transfer belt 2 is relaxed. When the transfer-unit-solenoid driving circuit 22 is turned off, the same operations as above are performed. When the transfer-unit-gap-forming-member supporting members 11 make one full rotation and return to their original positions, the motion of the transfer-unit-gap-forming-member supporting members 11 is regulated.

During the exit of a sheet from the transfer press-contact portion, the control unit 114 judges whether it is detected that the trailing end of the sheet 8 has exited the transfer unit 112 (step S10). When the exit of the trailing end of the sheet 8 is detected, the control unit 114 turns on the transfer unit solenoid 15 (step S11). When the transfer unit solenoid 15 is turned on, the transfer unit ratchet 14 is pulled down and the transfer-unit-gap-forming-member supporting members 11 make one full rotation. The control unit 114 turns off the transfer unit solenoid 15 (step S12). When the transfer unit solenoid 15 is turned off, the transfer unit ratchet 14 is pushed up. When the transfer-unit-gap-forming-member supporting members 11, which have finished the one full rotation, return to their original positions, the transfer unit ratchet 14 regulates the rotation of the transfer-unit-gap-forming-member supporting members 11.

Figure 19:
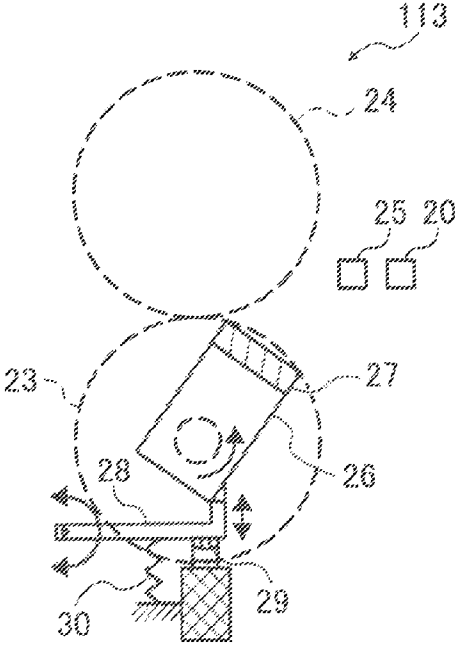
Figure 19:
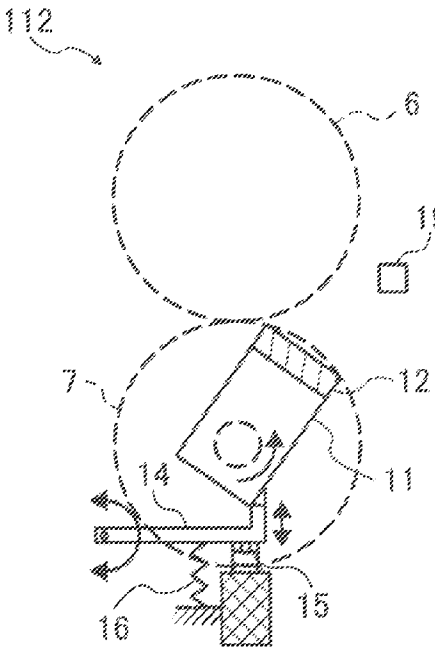
Figure 20A:
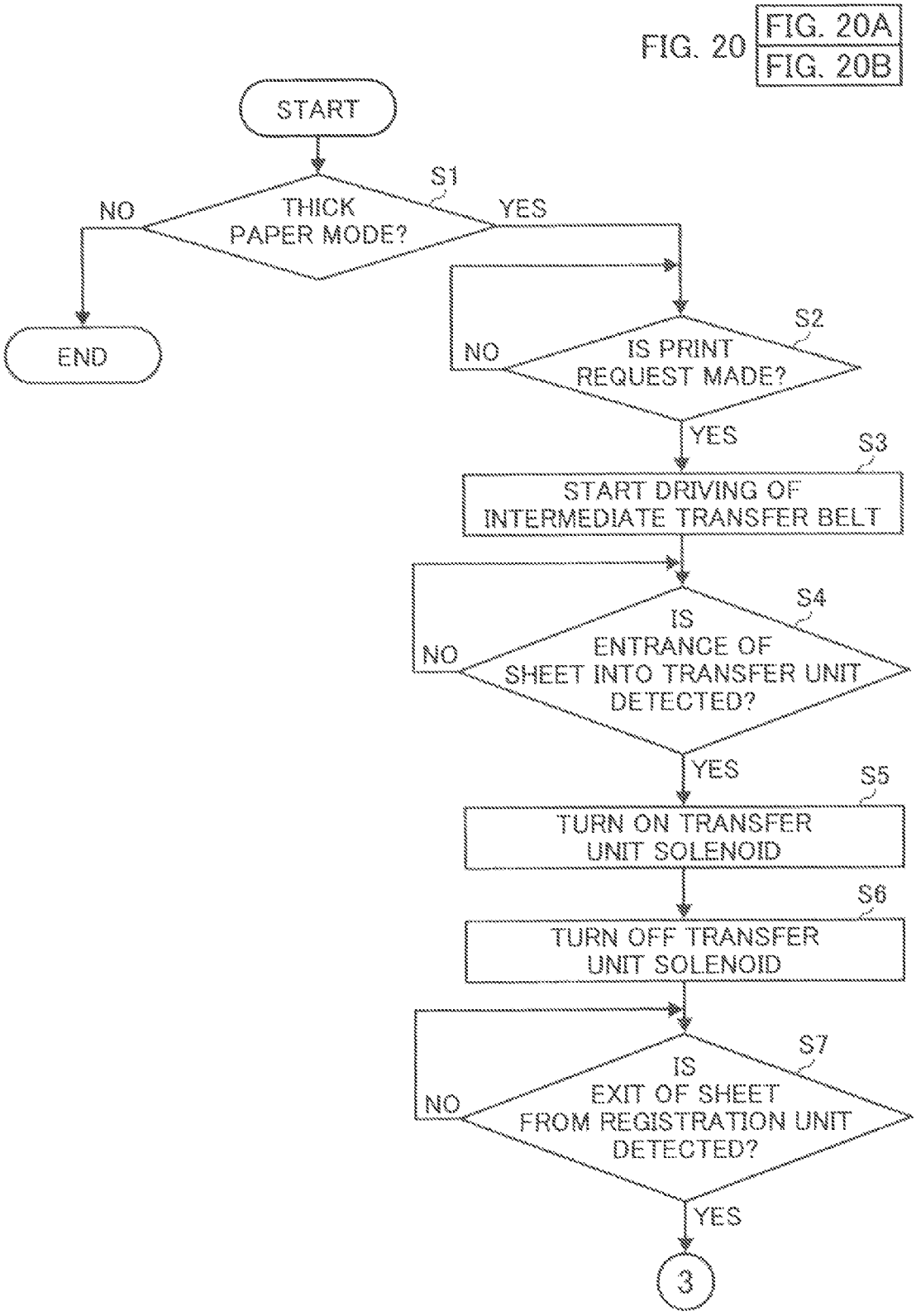
FIG. 20 is a flowchart of the operation of the control unit shown in FIG. 14.
Figure 20B:
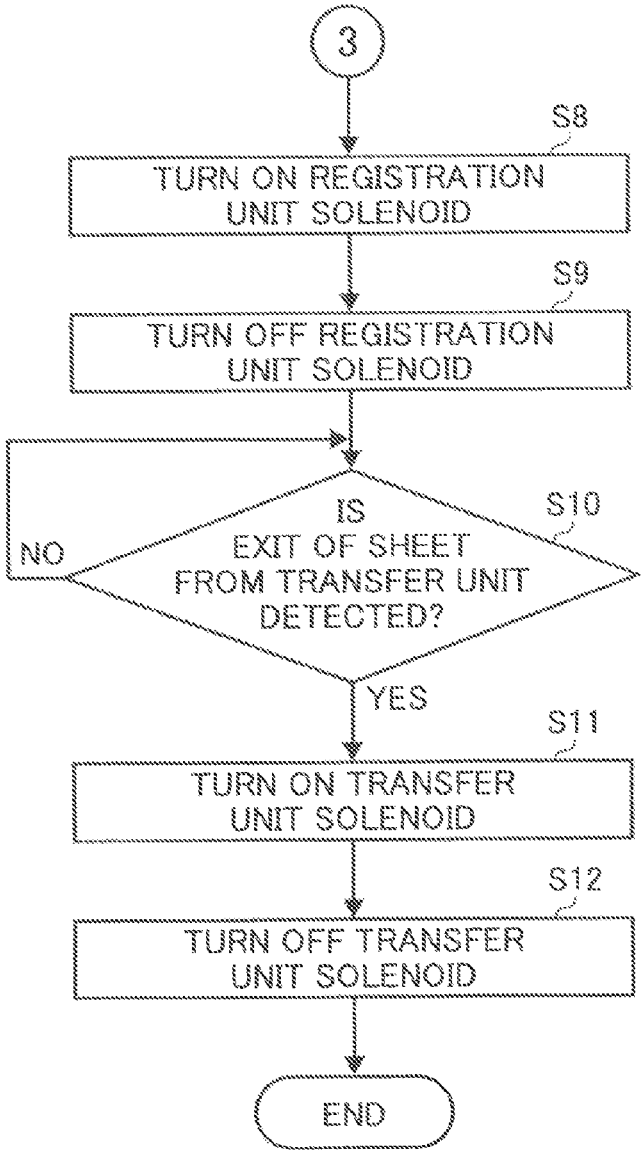

During the next print standby, as shown in FIG. 19, the transfer-unit-solenoid driving circuit 22 and the registration-unit-solenoid driving circuit 32 are put on standby in the off state in preparation for the next print.

As described above, in this embodiment, the transfer-unit-gap forming members 12 are rotated by a driving source identical with that for the intermediate transfer belt 2, the counter roller 6, and the transfer roller 7 or the registration roller 23 and the registration pressure roller 24 via the transfer-unit torque limiters 13. Thus, it is unnecessary to separately provide a driving source for forming a gap and it is possible reduce manufacturing cost. The driving source for the transfer-unit-gap forming members 12 can always stably rotate the transfer-unit-gap forming members 12.

In this embodiment, a driving force is transmitted from the transfer roller shaft 10 to the transfer-unit-gap-forming-member supporting members 11 via the transfer-unit torque limiters 13. Thus, when the motion of the transfer-unit-gap-forming-member supporting members 11 is regulated, the transfer roller shaft 10 can stably rotate without being affected by the motion.

In this embodiment, only when the transfer-unit-sheet-passage sensor 19 detects the passage of the sheet 8, the control unit 114 allows the rotational motion of the transfer-unit-gap-forming-member supporting members 11. Thus, only when the sheet 8 enters the press-contact portion of a transfer unit 122, the transfer-unit-gap-forming-member supporting members 11 are driven and a gap is formed by the transfer-unit-gap forming members 12. It is possible to prevent the intermediate transfer belt 2, the counter roller 6, and the transfer roller 7 from being deformed.

The image forming apparatus 50 according to a third embodiment of the present invention includes two gap forming members having different thicknesses and adjusts a size of a gap to be formed. In the following explanation of the image forming apparatus 50 according to the third embodiment, components similar to those in the embodiments described above are denoted by the identical reference numerals and signs and explanations thereof are omitted.

Figure 21:
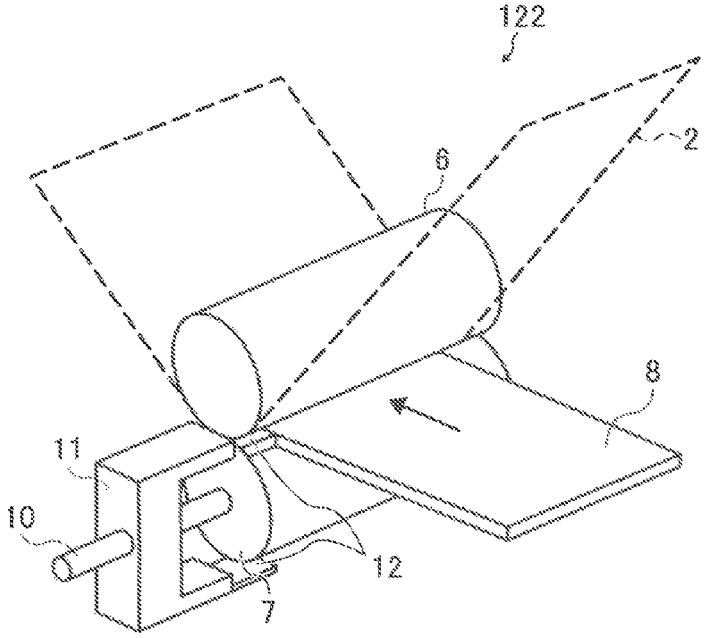
FIG. 21 is a perspective view of a transfer unit of an image forming apparatus according to a third embodiment of the present invention.
Figure 22:
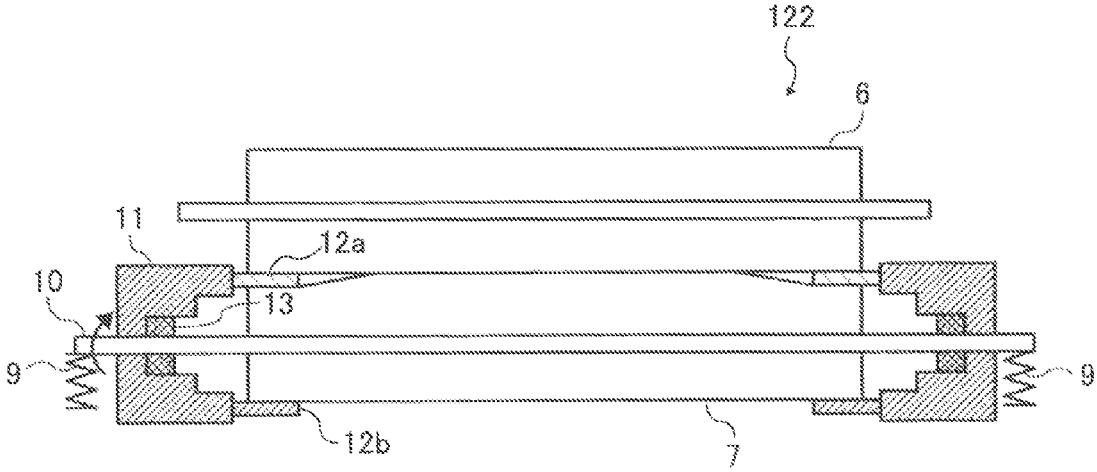
FIG. 22 is a sectional view of the transfer unit shown in FIG. 21.

FIGS. 21 and 22 are a perspective view and a sectional view in the width direction of the sheet 8 of the transfer unit 122, respectively. In this embodiment, two kinds of transfer-unit-gap forming members 12*a* and 12*b* having different thicknesses are provided in the transfer-unit-gap-forming-member supporting members 11 at an interval of 180° around the transfer roller shaft 10. Two kinds of registration-unit-gap forming members 27*a* and 27*b* having different thicknesses are provided in the registration-unit-gap-forming-member supporting members 26 in the same manner. In this embodiment, the thickness of the transfer-unit-gap forming member 12*a* is set smaller than the thickness of the transfer-unit-gap forming member 12*b*. The thickness of the registration-unit-gap forming member 27*a* is set smaller than the thickness of the registration-unit-gap forming member 27*b*.

Figure 23:
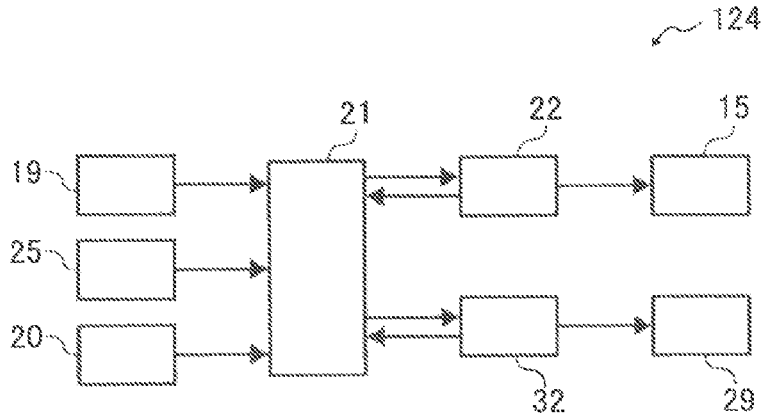
FIG. 23 is a block diagram of a control unit of the transfer unit shown in FIG. 21.

FIG. 23 is a diagram of a control unit 124 that controls the transfer unit 122 and a registration unit 123. The control unit 124 includes the transfer-unit-sheet-passage sensor 19, the registration-unit-sheet-passage sensor 25, the sheet thickness sensor 20, the microprocessor 21, the transfer-unit-solenoid driving circuit 22, the transfer unit solenoid 15, the registration-unit-solenoid driving circuit 32, and the registration unit solenoid 29. The microprocessor 21 causes the transfer-unit-solenoid driving circuit 22 to drive the transfer unit solenoid 15 when the entrance of the sheet 8 into the transfer unit 122 is detected by the transfer-unit-sheet-passage sensor 19 and when the exit of the trailing end of the sheet 8 from the transfer unit 122 is detected by the transfer-unit-sheet-passage sensor 19. The microprocessor 21 causes the registration-unit-solenoid driving circuit 32 to drive the registration unit solenoid 29 when the exit of the trailing end of the sheet 8 from the registration unit 123 is detected by the registration-unit-sheet-passage sensor 25. In other words, a gap corresponding to the thickness of the sheet 8 is formed in the transfer unit 122 or the registration unit 123 to control fluctuation in speed of the intermediate transfer belt 2 when the leading end of the sheet 8 enters the transfer unit 122, when the trailing end of the sheet 8 exits the transfer unit 122, and when the trailing end of the sheet 8 exits the registration unit 123.

In this embodiment, when the transfer-unit-gap forming member 12*a* is near a press-contact portion of the transfer unit 122, the rotational motion of the transfer-unit-gap-forming-member supporting members 11 is regulated by the transfer unit ratchet 14. In other words, during print standby, the transfer-unit-gap forming member 12*a* is located near the press-contact portion of the transfer unit 122 and the registration-unit-gap forming member 27*a* is located near a press-contact portion of the registration unit 123.

In this embodiment, when the thick paper mode is selected and the sheet 8 is conveyed by the registration roller 23 and the registration pressure roller 24 according to a print request, the thickness of the sheet 8 is detected by the sheet thickness sensor 20 (see FIG. 24) arranged upstream in the conveying direction of the sheet 8. When a relation of $d \geqq d1$ is satisfied, where d is the thickness of the sheet 8 and d1 is a threshold for judging whether the sheet 8 is thick or thin, it is judged that the sheet 8 is a thicker sheet among thick papers and a thickest paper mode described later is executed. When d and d1 are not in the relation of $d \geqq d1$, it is judged that the sheet 8 is a thinner sheet among thick papers and a medium thick paper mode is executed. In the following explanation, the thinner sheet 8 and the thicker sheet 8 are distinguished as a sheet 8*a* and a sheet 8*b*, respectively. Specifically, when d1 is set to 200 micrometers as shown in FIG. 39, the sheet thickness sensor 20 judges that 158 kg art paper having the thickness of about 160 micrometers is the thinner sheet 8*a* and judges that 220 kg art paper having the thickness of about 250 micrometers is the thicker sheet 8*b*. In this embodiment, the thickness of the transfer-unit-gap forming member 12*a* and the registration-unit-gap forming member 27*a* corresponding to the thicker sheet 8*a* is set to about 100 micrometers and the thickness of the transfer-unit-gap forming member 12*b* and the registration-unit-gap forming member 27*b* corresponding to the thicker sheet 8*b* is set to about 170 micrometers. As in the first embodiment, when the thick paper mode is not selected, the transfer-unit-solenoid driving circuit 22 and the registration-unit-solenoid driving circuit 32 are put on standby in the off state. Printing is performed in an image forming cycle of a plain paper mode for not inserting the transfer-unit-gap forming members 12*a* and 12*b* or the registration-unit-gap forming members 27*a* and 27*b* into the press-contact portion. In this embodiment, the two modes, i.e., the thick paper mode and the plain paper mode, are provided for selection by a user. The thick paper mode is classified into the medium thick paper mode and the thickest paper mode discriminated by a sheet thickness sensor (see FIG. 24) described later.

Figure 36:
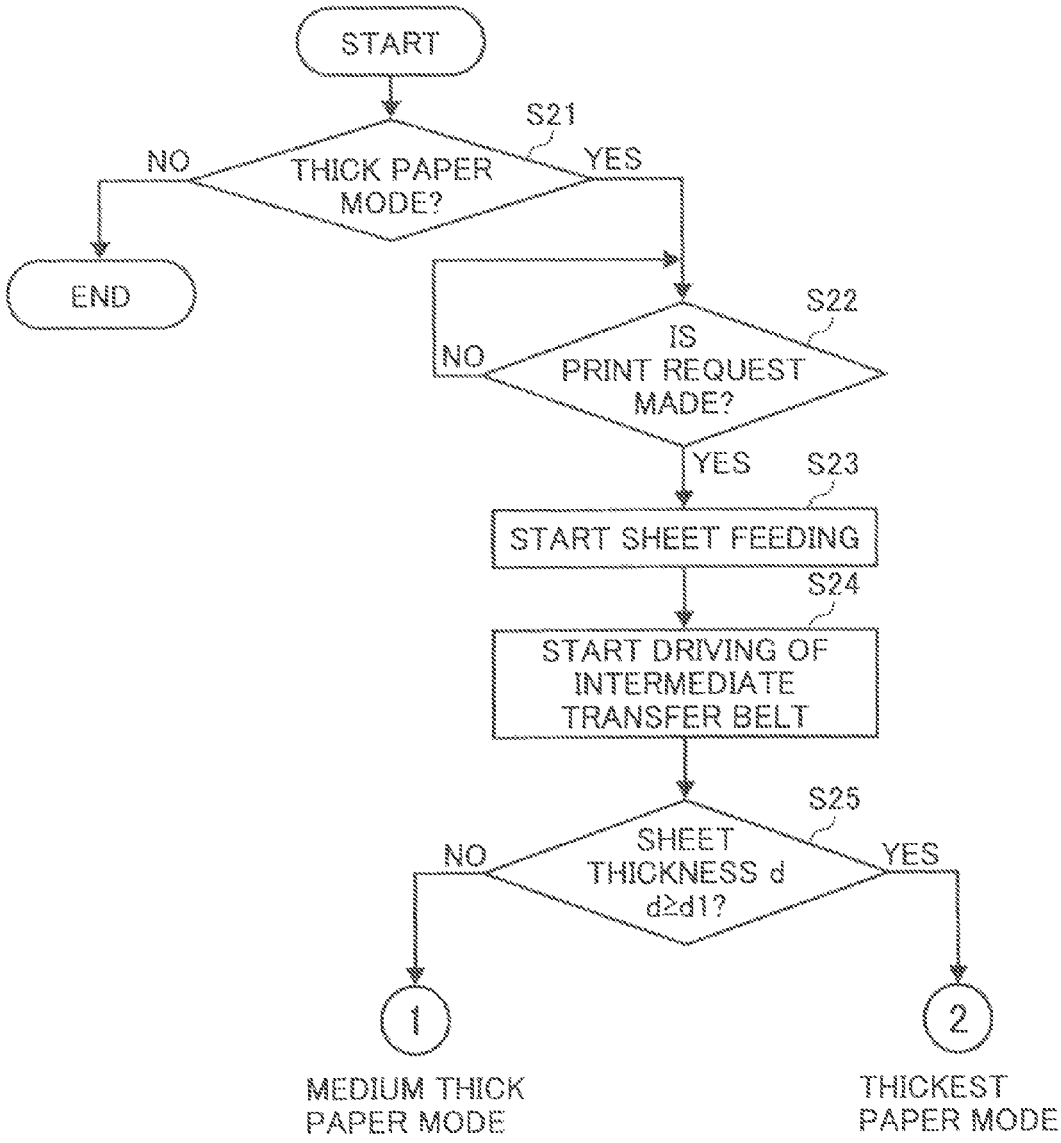
FIGS. 36 to 38 are flowcharts of the operation of the control unit shown in FIG. 23.
Figure 37:
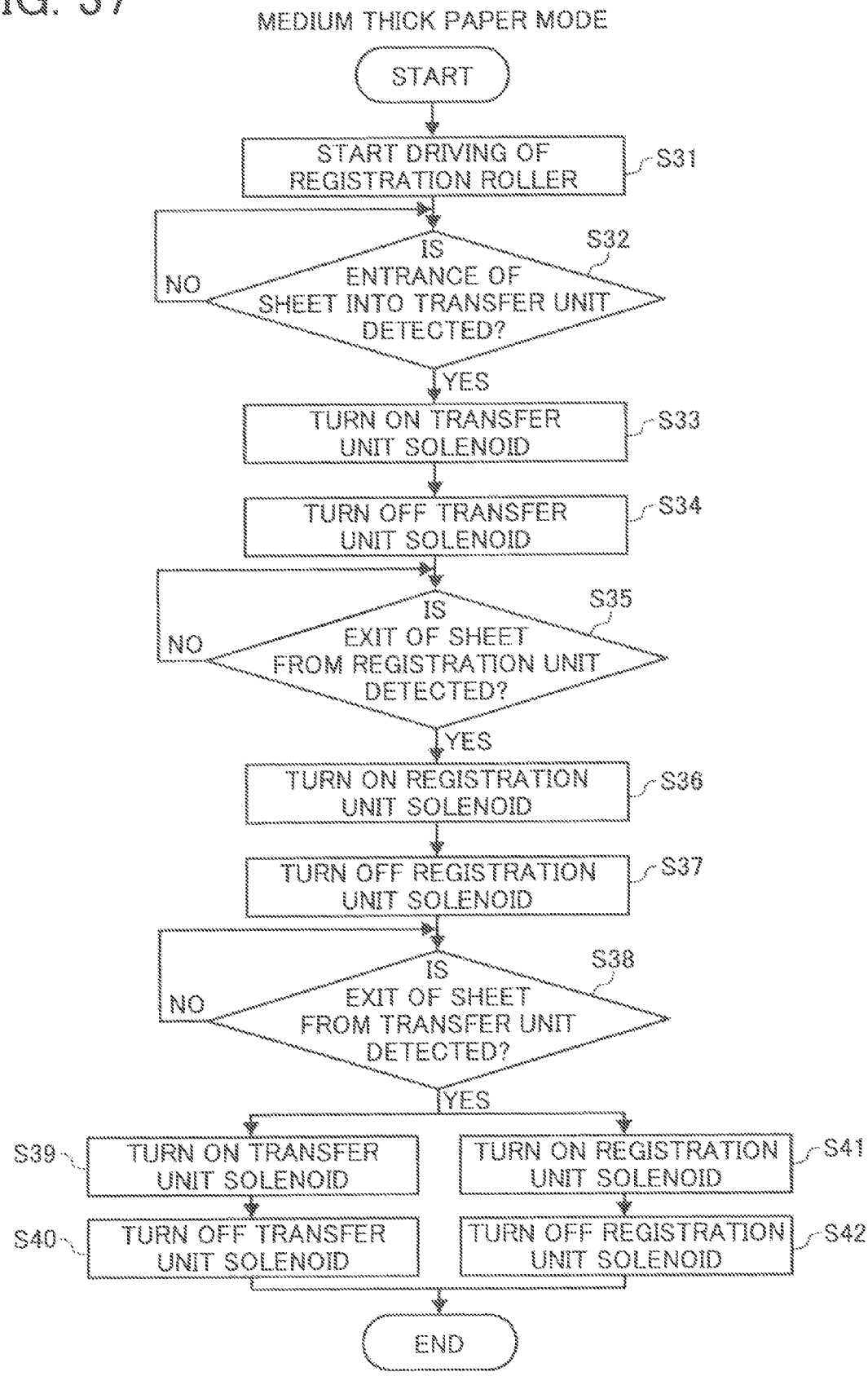
Figure 38A:
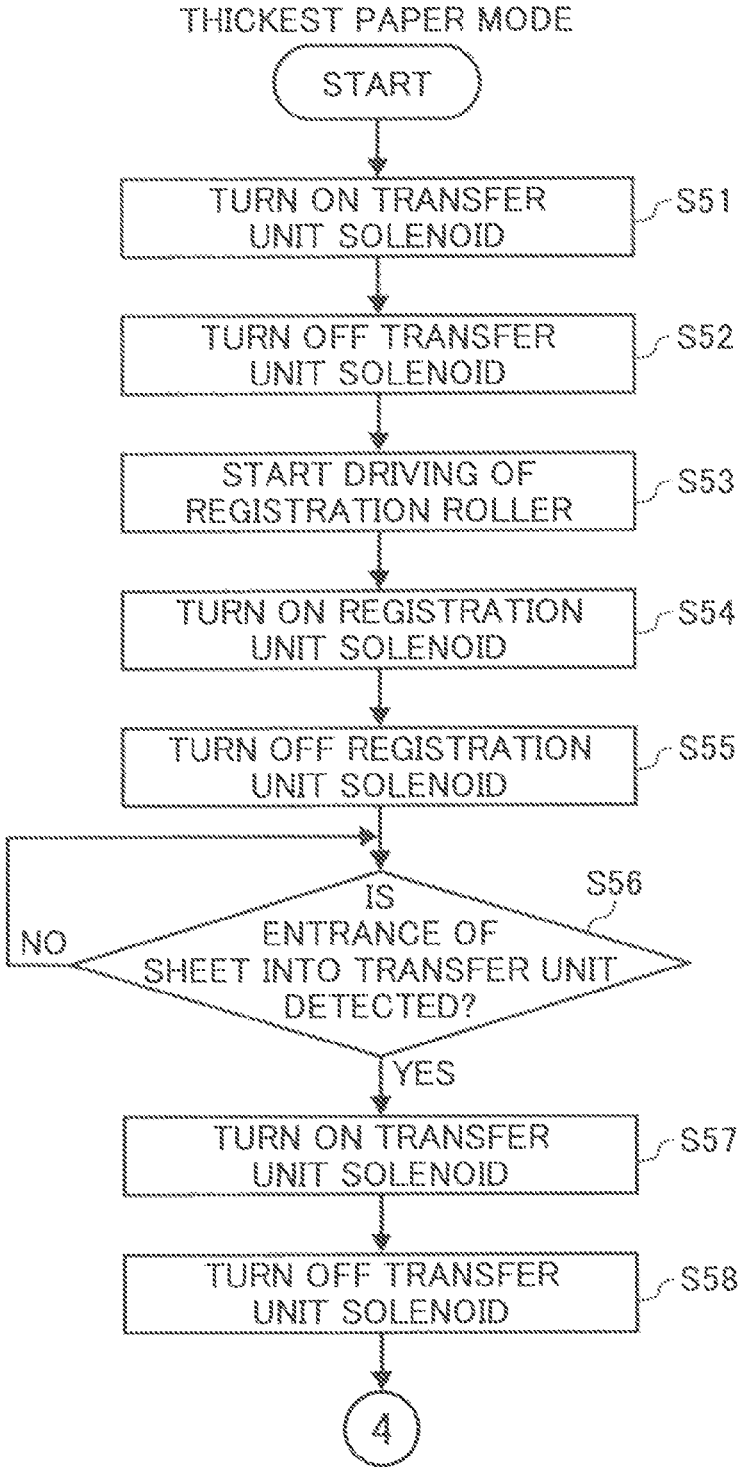
Figure 38B:
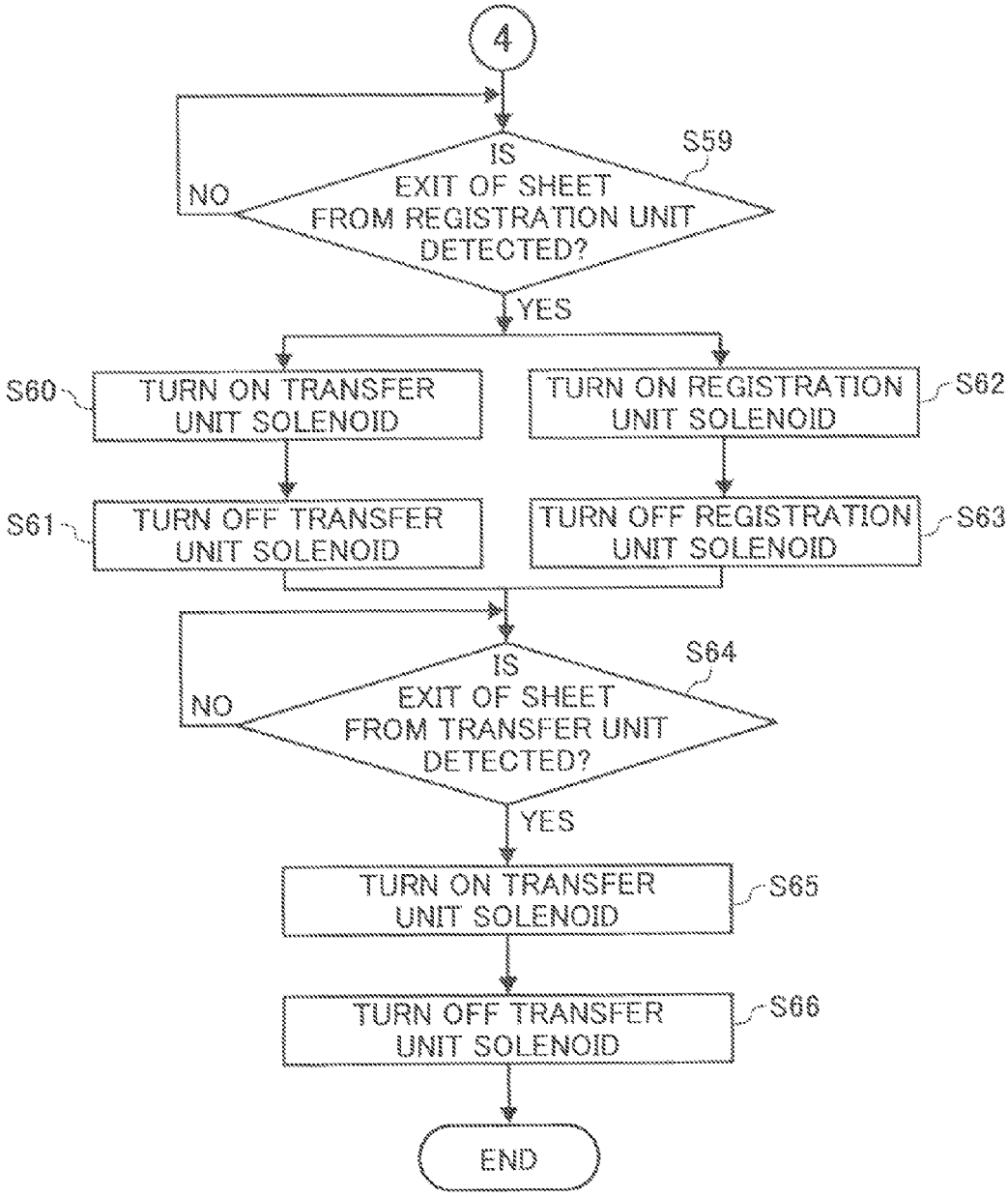

FIGS. 24 to 35 are diagrams of control states of the rotational motion of the transfer-unit-gap-forming-member supporting members 11. FIGS. 36 to 38 are flowcharts of operations of the control unit 124.

The control unit 124 judges whether a set mode is the thick paper mode (step S21). When the set mode is the thick paper mode, the control unit 124 judges whether a print request is made (step S22). When a print request is made, the control unit 124 starts conveyance of the sheet 8 (step S23) and starts driving of the intermediate transfer belt 2 (step S24). The control unit 124 judges whether the thickness of the sheet 8 is equal to or larger than the threshold d1 based on a detection result of the sheet thickness sensor 20 (step S25). When the thickness of the sheet 8 is equal to or larger than the threshold d1, the control unit 124 executes the thickest paper mode. When the thickness of the sheet 8 is not equal to or larger than the threshold d1, the control unit 124 executes the medium thick paper mode.

Figure 24:
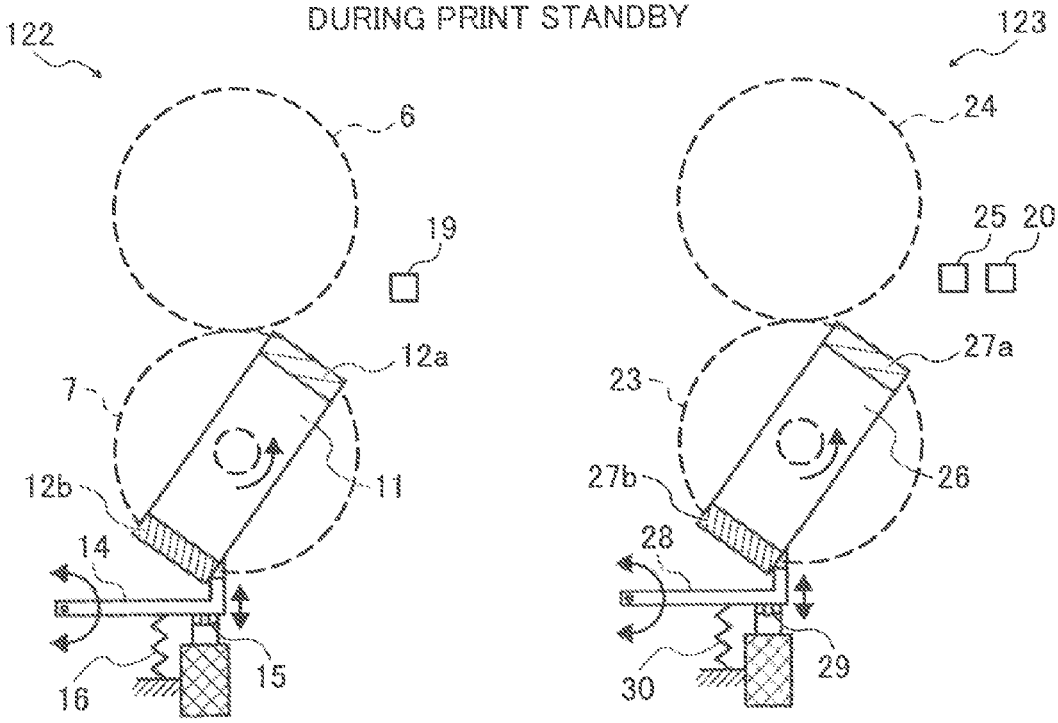
FIGS. 24 to 35 are side views of the transfer unit and a registration unit of the image forming apparatus according to the third embodiment.

During print standby, as shown in FIG. 24, the transfer-unit-solenoid driving circuit 22 and the registration-unit-solenoid driving circuit 32 are off. As in the first embodiment, the rotation of the transfer-unit-gap-forming-member supporting members 11 and the registration-unit-gap-forming-member supporting members 26 is regulated.

Figure 25:
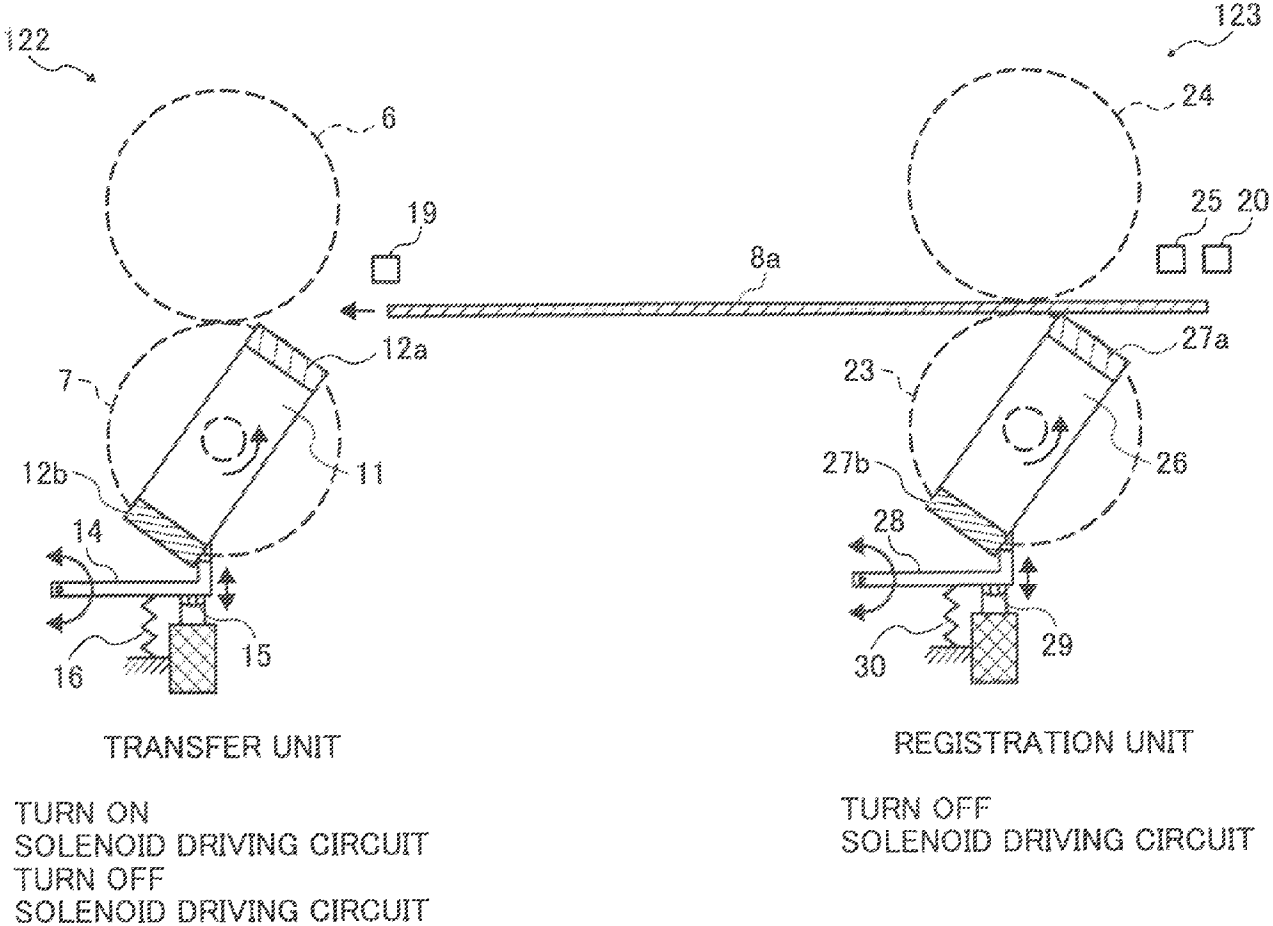

During the entrance of a sheet into the transfer press-contact portion, as shown in FIG. 25, when the entrance of the thinner sheet 8*a* is detected by the transfer-unit-sheet-passage sensor 19, the transfer unit solenoid 15 is turned on to pull down the transfer unit ratchet 14 and allow the rotational motion of the transfer-unit-gap-forming-member supporting members 11. When the sheet 8*a* enters the transfer unit 122, a gap is formed by the thinner transfer-unit-gap forming member 12*a* and fluctuation in speed of the intermediate transfer belt 2 is controlled. When the transfer unit solenoid 15 is turned off to return the transfer unit ratchet 14 to its original position, the rotational motion of the transfer-unit-gap-forming-member supporting members 11 is regulated when the transfer-unit-gap-forming-member supporting members 11 make a half rotation, i.e., rotates 180°. In this case, the thicker transfer-unit-gap forming member 12*b* is located near the press-contact portion of the transfer unit 122.

The control unit 124 starts driving of the registration roller 23 and the registration pressure roller 24 (step S31). The control unit 124 judges whether it is detected that the leading end of the sheet 8*a* has entered the transfer unit 112 (step S32). When the entrance of the sheet 8*a* is detected, the control unit 124 turns on the transfer-unit solenoid 15 (step S33). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S34). When the transfer unit solenoid 15 is turned off, the transfer unit ratchet 14 is pushed up to regulate the rotation of the transfer-unit-gap-forming-member supporting members 11, which have finished the half rotation.

Figure 26:
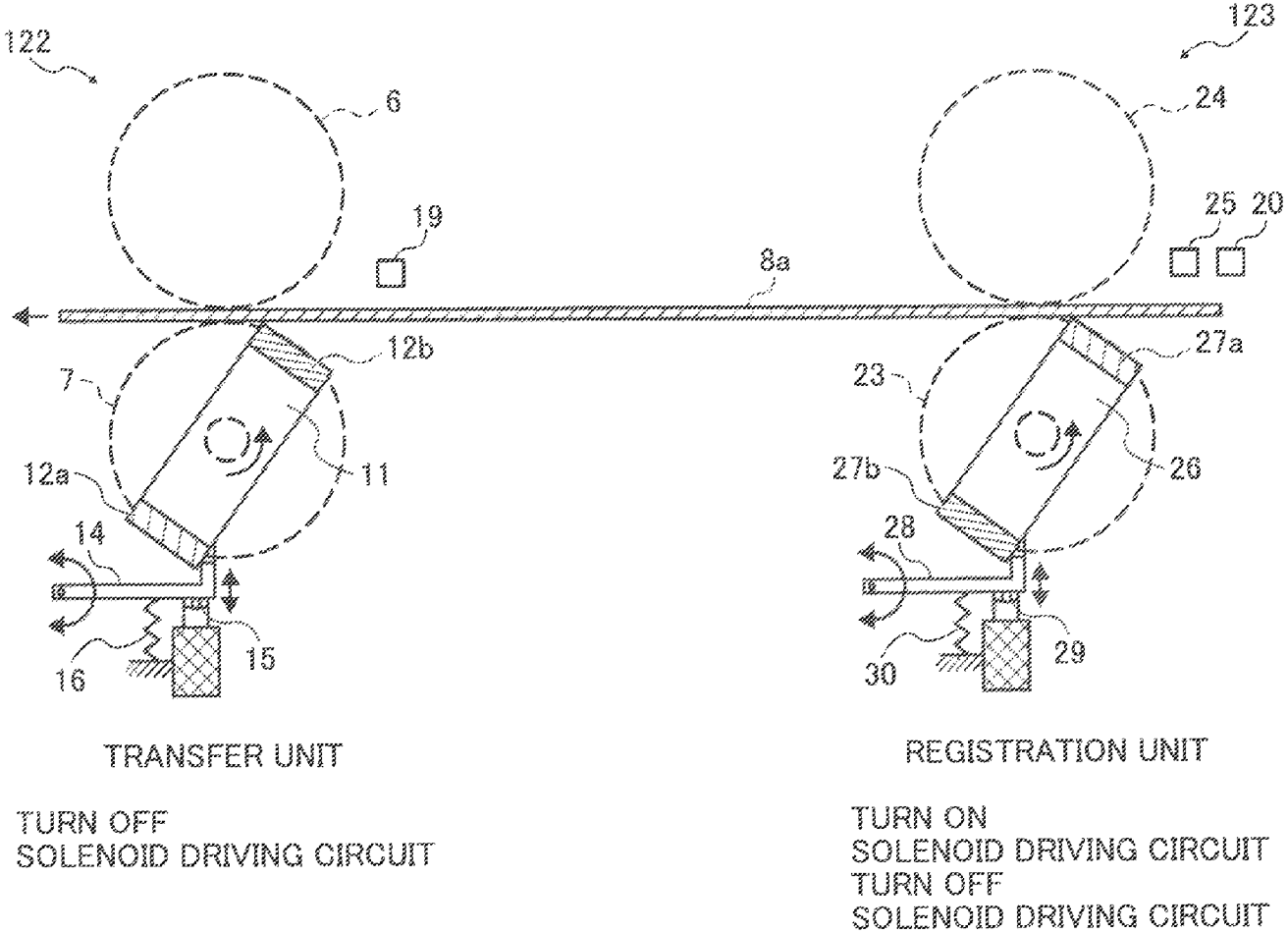

During the exit of a sheet from the registration-roller press-contact portion, as shown in FIG. 26, when passage of the trailing end of the sheet 8*a* is detected by the registration-unit-sheet-passage sensor 25, the registration unit solenoid 29 is turned on to pull down the registration unit ratchet 28 to allow the rotational motion of the registration-unit-gap-forming-member supporting members 26. When the sheet 8*a* exits the press-contact portion of the registration unit 123, sudden exit of the sheet 8*a* is relaxed by an amount of the thickness thereof by the thinner registration-unit-gap forming member 27*a*. Fluctuation in speed of the registration roller 23, the registration pressure roller 24, and the trailing end of the sheet 8*a* is controlled. The registration unit solenoid 29 is turned off to return the registration unit ratchet 28 to its original position. Consequently, the rotational motion of the registration-unit-gap-forming-member supporting members 26 is regulated when the registration-unit-gap-forming-member supporting members 26 make a half rotation. In this case, the thicker registration-unit-gap forming member 27*b* is located near the press-contact portion of the registration unit 123.

During the exit of a sheet from the registration-roller press-contact portion, the control unit 124 judges whether it is detected that the trailing end of the sheet 8*a* has exited the registration unit 123 (step S35). When the exit of the trailing end of the sheet 8*a* is detected, a control unit 124*a* turns on the registration unit solenoid 29 (step S36). When the registration unit solenoid 29 is turned on, the registration unit ratchet 28 is pulled down and the registration-unit-gap-forming-member supporting members 26 make a half rotation. The control unit 124 turns off the registration unit solenoid 29 (step S37). When the registration unit solenoid 29 is turned off, the registration unit ratchet 28 is pushed up to regulate the rotation of the registration-unit-gap-forming-member supporting members 26, which have finished the half rotation.

Figure 27:
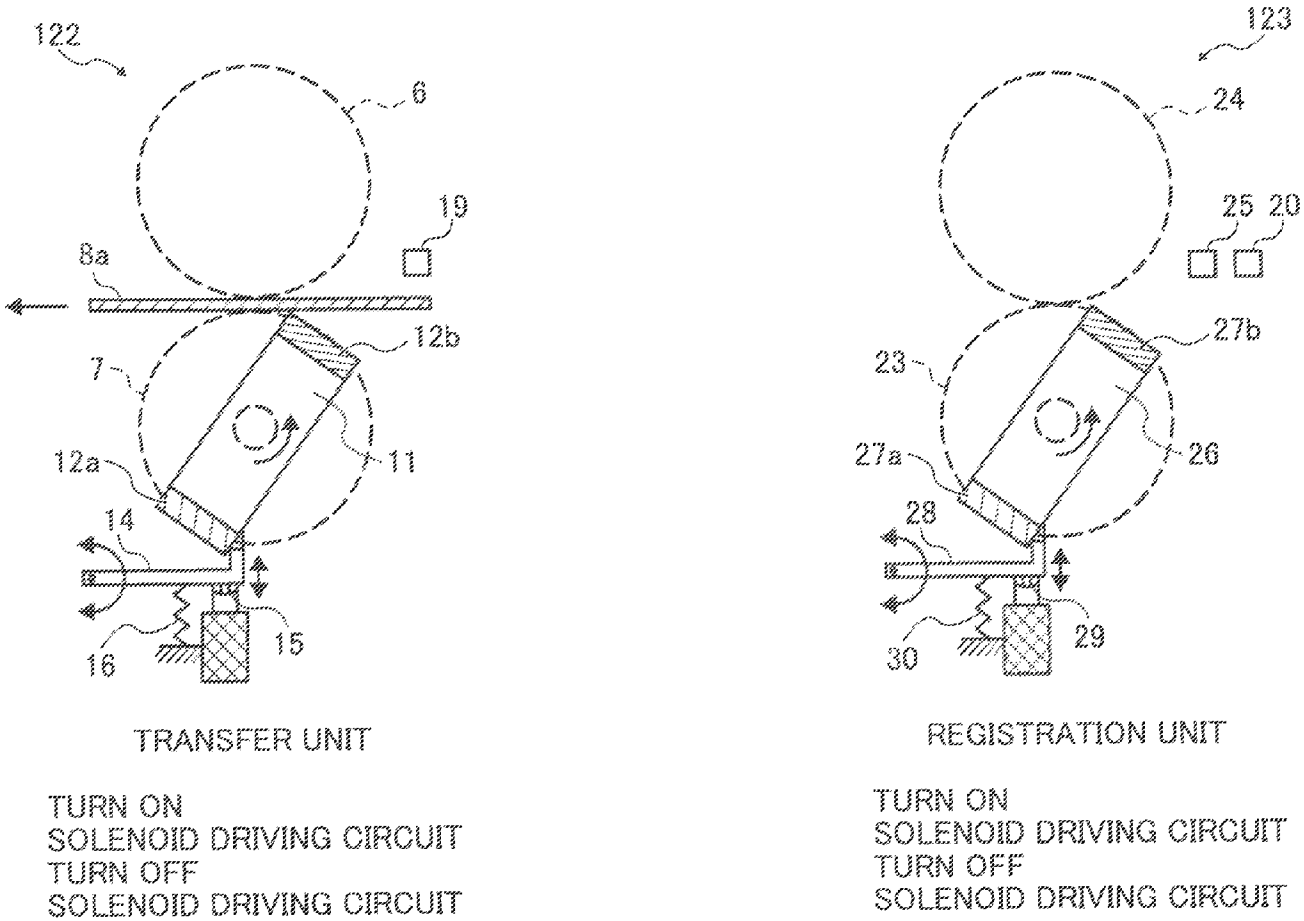

During the exit of a sheet from the transfer press-contact portion, as shown in FIG. 27, when passage of the trailing end of the sheet 8*a* is detected by the transfer-unit-sheet-passage sensor 19, the transfer unit solenoid 15 and the registration unit solenoid 29 are turned on to pull down the transfer unit ratchet 14 and the registration unit ratchet 28 and allow the rotational motion of the transfer-unit-gap-forming-member supporting members 11 and the registration-unit-gap-forming-member supporting members 26. When the sheet 8*a* exits the press-contact portion of the transfer unit 122, sudden exit of the sheet 8*a* is relaxed by an amount of the thickness thereof by the thicker transfer-unit-gap forming member 12*b*. Fluctuation in speed of the intermediate transfer belt 2 is controlled. The transfer unit solenoid 15 and the registration unit solenoid 29 are turned off to return the transfer unit ratchet 14 and the registration unit ratchet 28 to their original positions. Then, the rotational motion of the transfer-unit-gap-forming-member supporting members 11 and the registration-unit-gap-forming-member supporting members 26 is regulated when the transfer-unit-gap-forming-member supporting members 11 and the registration-unit-gap-forming-member supporting members 26 make a half rotation. In this case, the thinner transfer-unit-gap forming member 12*a* is located near the press-contact portion of the transfer unit 122 and the thinner registration-unit-gap forming member 27*a* is located near the press-contact portion of the registration unit 123.

During the exit of a sheet from the transfer press-contact portion, the control unit 124 judges whether it is detected that the trailing end of the sheet 8*a* has exited the transfer unit 122 (step S38). When the exit of the trailing end of the sheet 8*a* is detected, the control unit 124 turns on the transfer unit solenoid 15 (step S39). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S40). When the transfer unit solenoid 15 is turned off, the transfer unit ratchet 14 is pushed up to regulate the rotation of the transfer-unit-gap-forming-member supporting members 11, which have finished the half rotation. When the exit of the trailing end of the sheet 8*a* is detected in step S38, the control unit 124 turns on the registration unit solenoid 29 (step S41). When the registration unit solenoid 29 is turned on, the registration unit ratchet 28 is pulled down and the registration-unit-gap-forming-member supporting members 26 make a half rotation. The control unit 124 turns off the registration unit solenoid 29 (step S42). When the registration unit solenoid 29 is turned off, the registration unit ratchet 28 is pushed up to regulate the rotation of the registration-unit-gap-forming-member supporting members 26, which have finished the half rotation.

Figure 28:
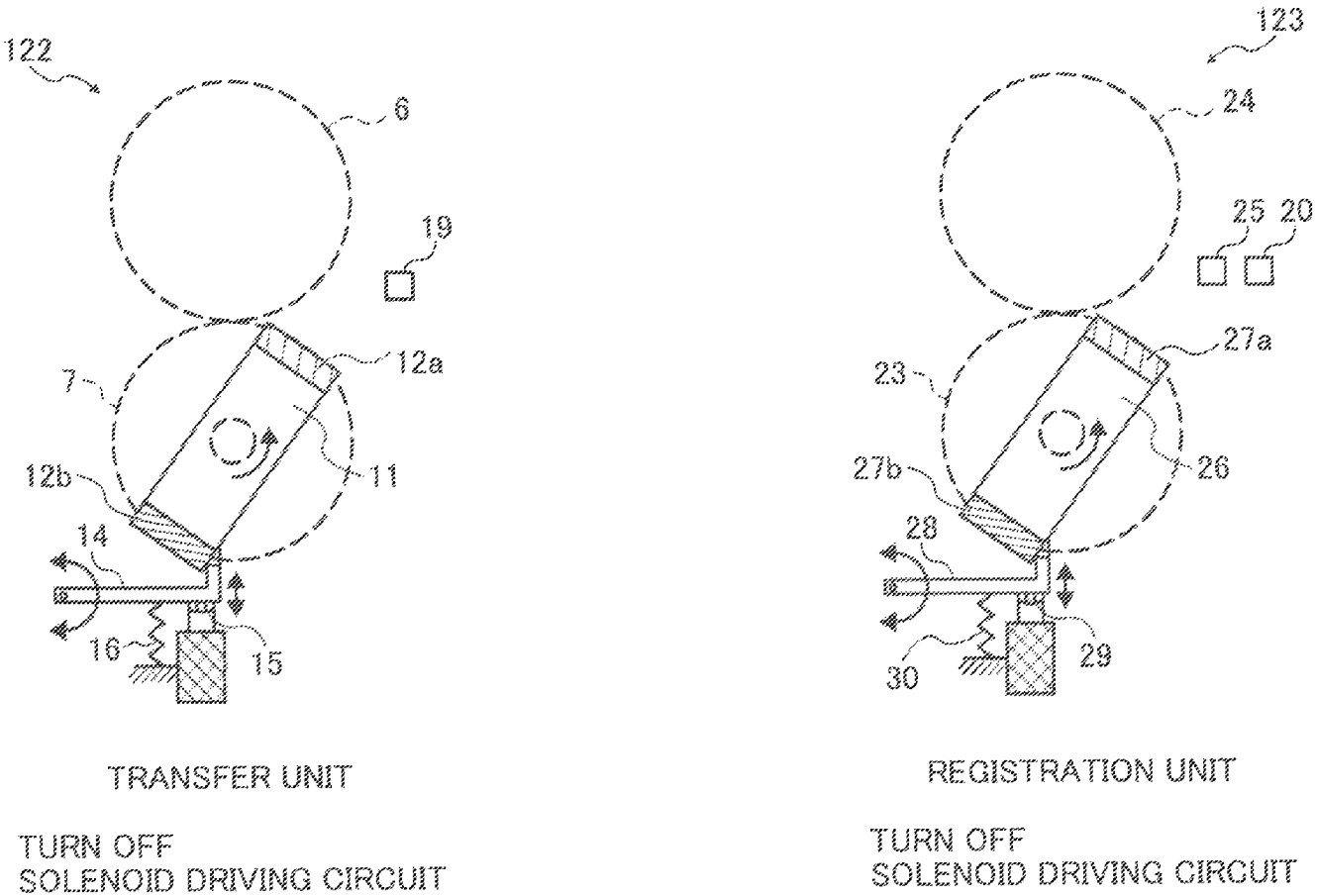

During the next sheet print standby, as shown in FIG. 28, the thinner transfer-unit-gap forming member 12*a* is located near the press-contact portion of the transfer unit 122 and the thinner registration-unit-gap forming member 27*a* is located near the press-contact portion of the registration unit 123 to stand by for the next print.

Figure 29:
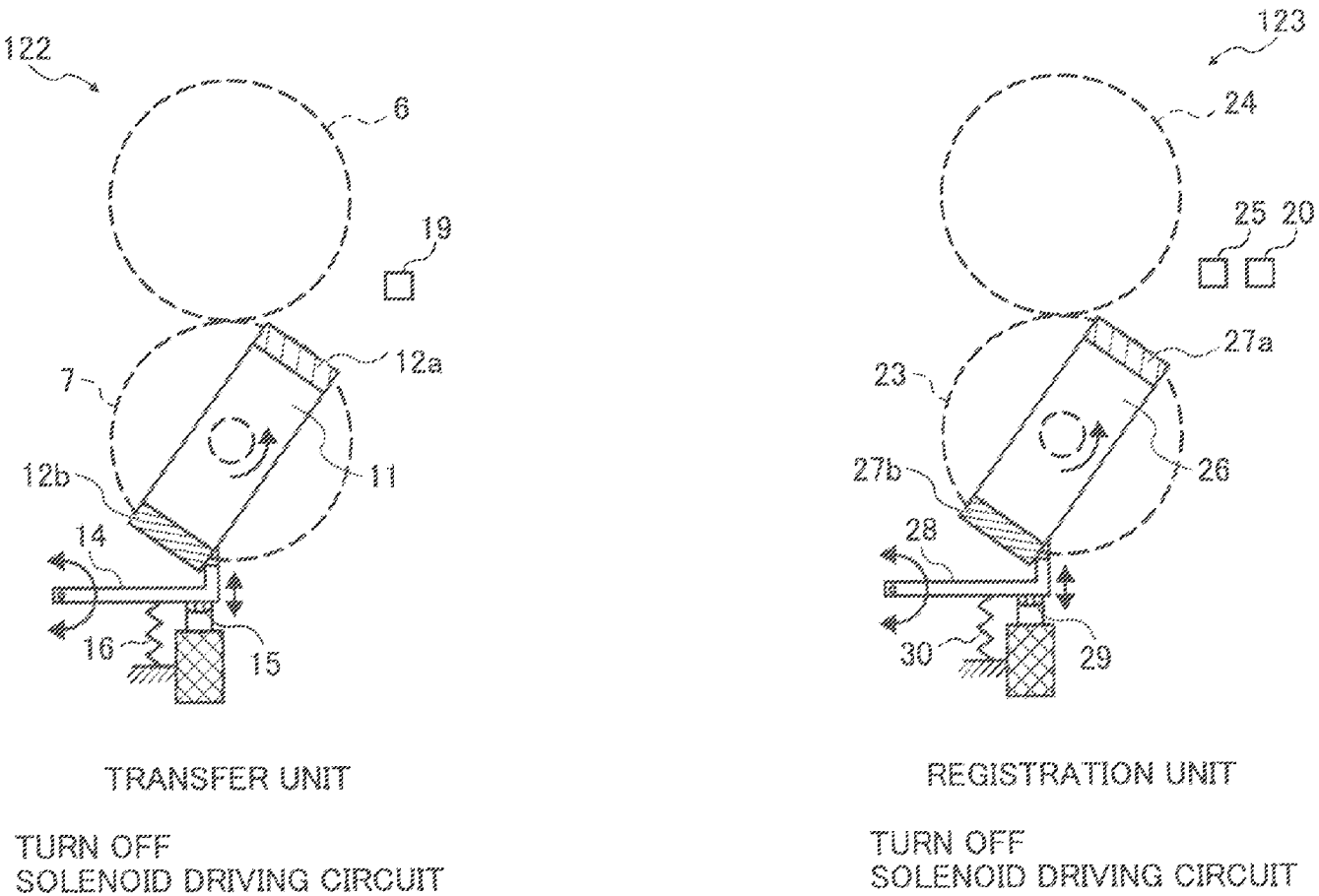

During print standby, as shown in FIG. 29, the transfer-unit-solenoid driving circuit 22 and the registration-unit-solenoid driving circuit 32 are off. As in the first embodiment, the rotation of the transfer-unit-gap-forming-member supporting members 11 and the registration-unit-gap-forming-member supporting members 26 is regulated.

Figure 30:
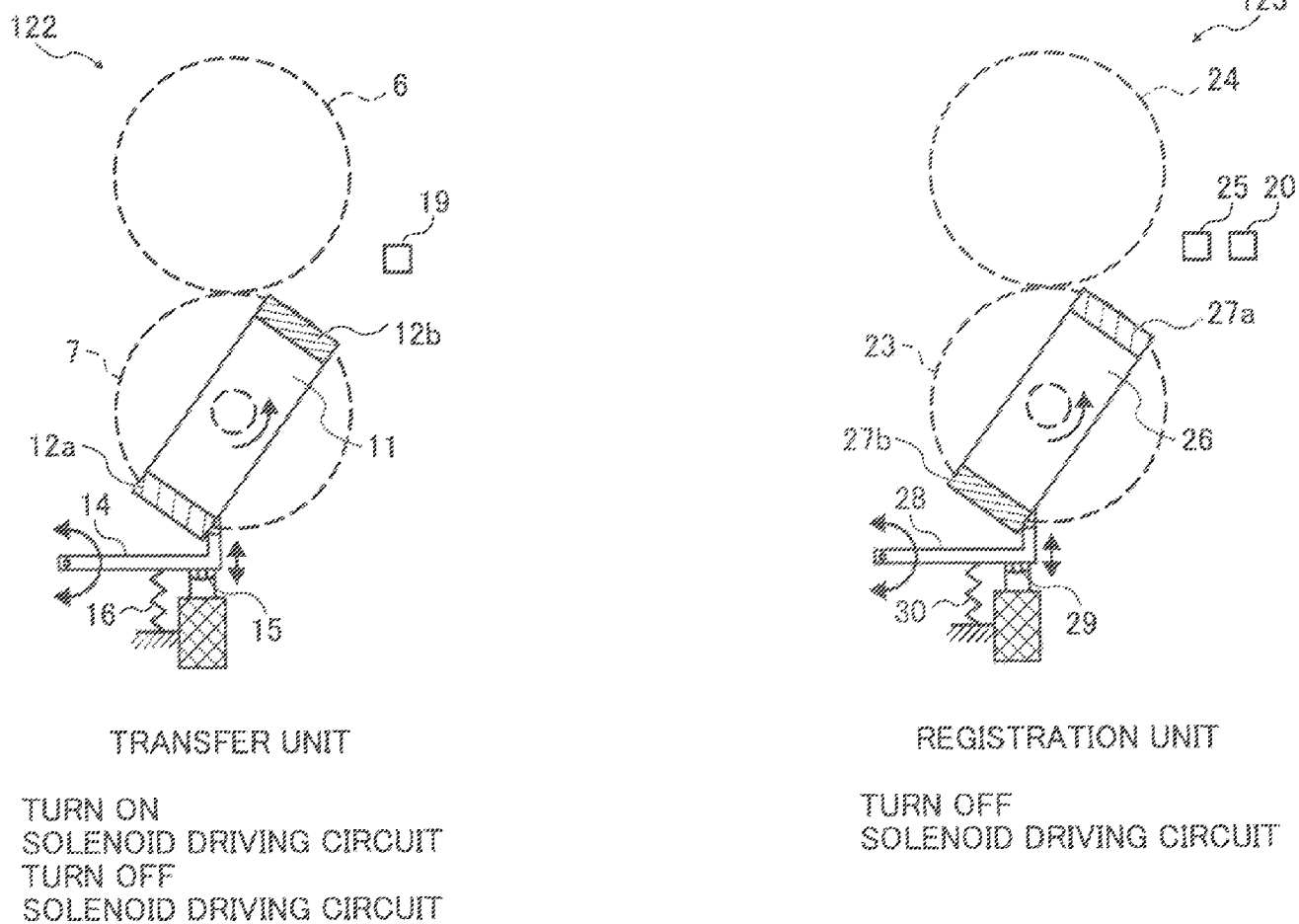

During sheet thickness detection after the intermediate transfer belt 2 starts driving, as shown in FIG. 30, the transfer unit solenoid 15 is turned on to pull down the transfer unit ratchet 14 and allow the rotational motion of the transfer-unit-gap-forming-member supporting members 11. When the transfer unit solenoid 15 is turned off to return the transfer unit ratchet 14 to its original position, the rotational motion of the transfer-unit-gap-forming-member supporting members 11 is regulated when the transfer-unit-gap-forming-member supporting members 11 make a half rotation. In this case, the thicker transfer-unit-gap forming member 12*b* is located near the press-contact portion of the transfer unit 122.

When the thickest paper mode is executed as a result of the judgment of $d \geqq d1$ in step S25, the control unit 124 turns on the transfer unit solenoid 15 (step S51). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S52). When the transfer unit solenoid 15 is turned off, the transfer unit ratchet 14 is pushed up to regulate the rotation of the transfer-unit-gap-forming-member supporting members 11, which have finished the half rotation. Consequently, the thicker transfer-unit-gap forming member 12*b* is put on standby near the press-contact portion of the transfer unit 122.

Figure 31:
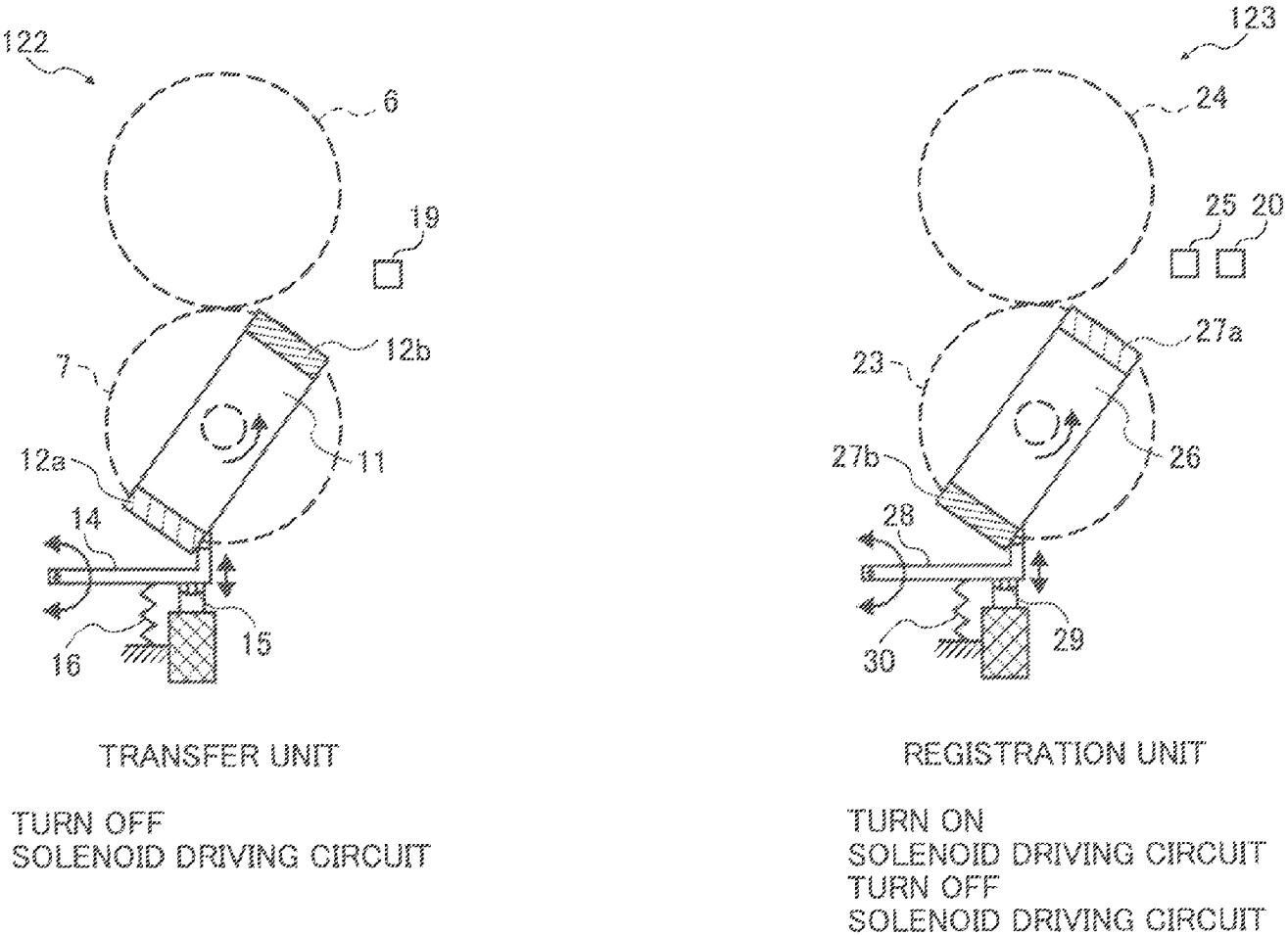

During start of registration roller driving, as shown in FIG. 31, the registration unit solenoid 29 is turned on to pull down the registration unit ratchet 28 to allow the rotational motion of the registration-unit-gap-forming-member supporting members 26. The registration unit solenoid 29 is turned off to return the registration unit ratchet 28 to its original position.

Consequently, the rotational motion of the registration-unit-gap-forming-member supporting members 26 is regulated when the registration-unit-gap-forming-member supporting members 26 make a half rotation. In this case, the thicker registration-unit-gap forming member 27*b* is located near the press-contact portion of the registration unit 123.

The control unit 124 starts driving of the registration roller 23 and the registration pressure roller 24 (step S53). Then, the control unit 124 turns on the registration unit solenoid 29 (step S54). When the registration unit solenoid 29 is turned on, the registration unit ratchet 28 is pulled down and the registration-unit-gap-forming-member supporting members 26 make a half rotation. The control unit 124 turns off the registration unit solenoid 29 (step S55). When the registration unit solenoid 29 is turned off, the registration unit ratchet 28 is pushed up to regulate the rotation of the registration-unit-gap-forming-member supporting members 26, which have finished the half rotation. In this case, the thicker registration-unit-gap forming member 27*b* is located near the press-contact portion of the registration unit 123.

Figure 32:
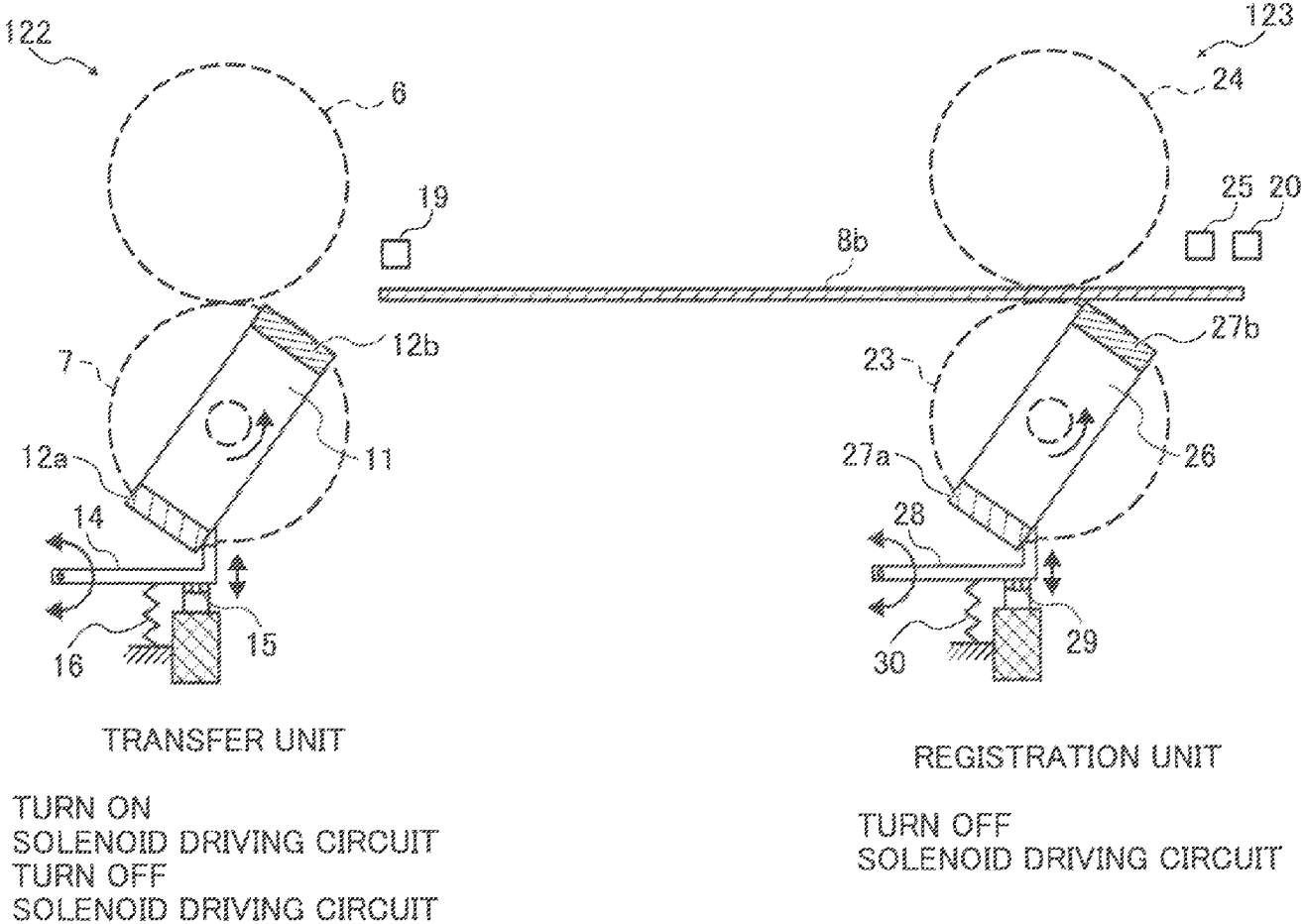

During the exit of a sheet from the transfer press-contact portion, as shown in FIG. 32, when the entrance of the thicker sheet 8*b* is detected by the transfer-unit-sheet-passage sensor 19, the transfer unit solenoid 15 is turned on to pull down the transfer unit ratchet 14 and allow the rotational motion of the transfer-unit-gap-forming-member supporting members 11. When the sheet 8*b* enters the press-contact portion of the transfer unit 122, a gap is formed by the thicker transfer-unit-gap forming member 12*b* and fluctuation in speed of the intermediate transfer belt 2 is controlled. When the transfer unit solenoid 15 is turned off to return the transfer unit ratchet 14 to its original position, the rotational motion of the transfer-unit-gap-forming-member supporting members 11 is regulated when the transfer-unit-gap-forming-member supporting members 11 make a half rotation. In this case, the thinner transfer-unit-gap forming member 12*a* is located near the press-contact portion of the transfer unit 122.

The control unit 124 judges whether it is detected that the leading end of the sheet 8*b* has entered the transfer unit 112 (step S56). When the entrance of the sheet 8*b* is detected, the control unit 124 turns on the transfer unit solenoid 15 (step S57). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S58). When the transfer unit solenoid 15 is turned off, the transfer unit ratchet 14 is pushed up to regulate the rotation of the transfer-unit-gap-forming-member supporting members 11, which have finished the half rotation.

Figure 33:
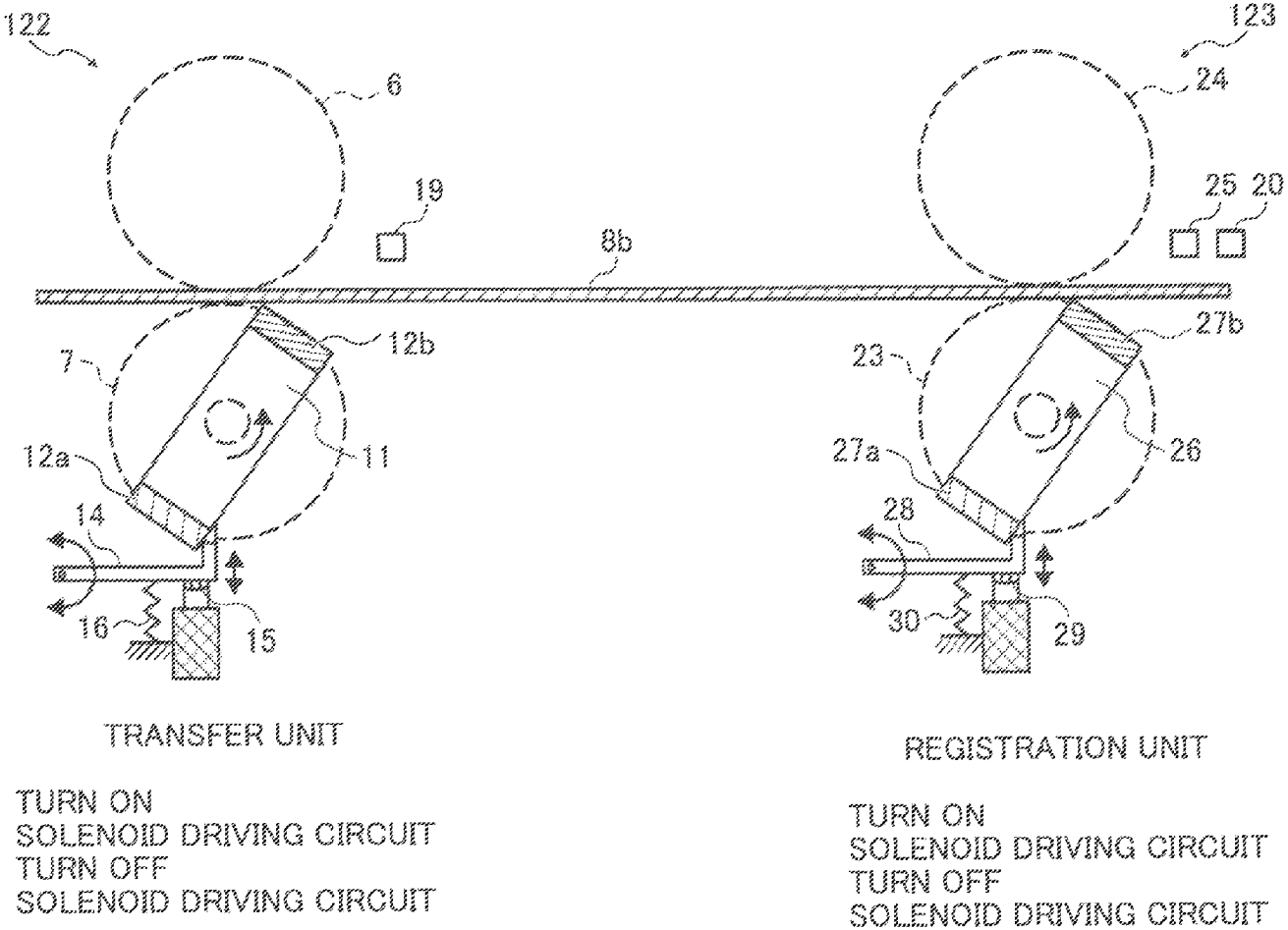

During the exit of a sheet from the registration-roller press-contact portion, as shown in FIG. 33, when passage of the trailing end of the thicker sheet 8*b* is detected by the registration-unit-sheet-passage sensor 25, the transfer unit solenoid 15 and the registration unit solenoid 29 are turned on to pull down the transfer unit ratchet 14 and the registration unit ratchet 28 and allow the rotational motion of the transfer-unit-gap-forming-member supporting members 11 and the registration-unit-gap-forming-member supporting members 26. Therefore, when the sheet 8*b* exits the press-contact portion of the registration unit, sudden exit of the sheet 8*b* is relaxed by an amount of the thickness thereof by the thicker registration-unit-gap forming member 27*b* and fluctuation in speed of the intermediate transfer belt 2 is controlled. The transfer unit solenoid 15 and the registration unit solenoid 29 are turned off to return the transfer unit ratchet 14 and the registration unit ratchet 28 to their original positions. Then, the rotational motion of the transfer-unit-gap-forming member supporting members 11 and the registration-unit-gap-forming-member supporting members 26 is regulated when the transfer-unit-gap-forming member supporting members 11 and the registration-unit-gap-forming-member supporting members 26 make a half rotation.

In this case, the thicker transfer-unit-gap forming member 12*b* is located near the press-contact portion of the transfer unit 122 and the thinner registration-unit-gap forming member 27*a* is located near the press-contact portion of the registration unit 123.

During the exit of a sheet from the registration-roller press-contact portion, the control unit 124 judges whether it is detected that the trailing end of the sheet 8*b* has exited the transfer unit 122 (step S59). When the exit of the trailing end of the sheet 8*b* is detected, the control unit 124 turns on the transfer unit solenoid 15 (step S60). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S61). When the transfer unit solenoid 15 is turned off, the transfer unit ratchet 14 is pushed up to regulate the rotation of the transfer-unit-gap-forming-member supporting members 11, which have finished the half rotation. When the exit of the trailing end of the sheet 8*b* is detected in step S69, the control unit 124 turns on the registration unit solenoid 29 (step S62). When the registration unit solenoid 29 is turned on, the registration unit ratchet 28 is pulled down and the registration-unit-gap-forming-member supporting members 26 make a half rotation. The control unit 124 turns off the registration unit solenoid 29 (step S63). When the registration unit solenoid 29 is turned off, the registration unit ratchet 28 is pushed up to regulate the rotation of the registration-unit-gap-forming-member supporting members 26, which have finished the half rotation.

Figure 34:
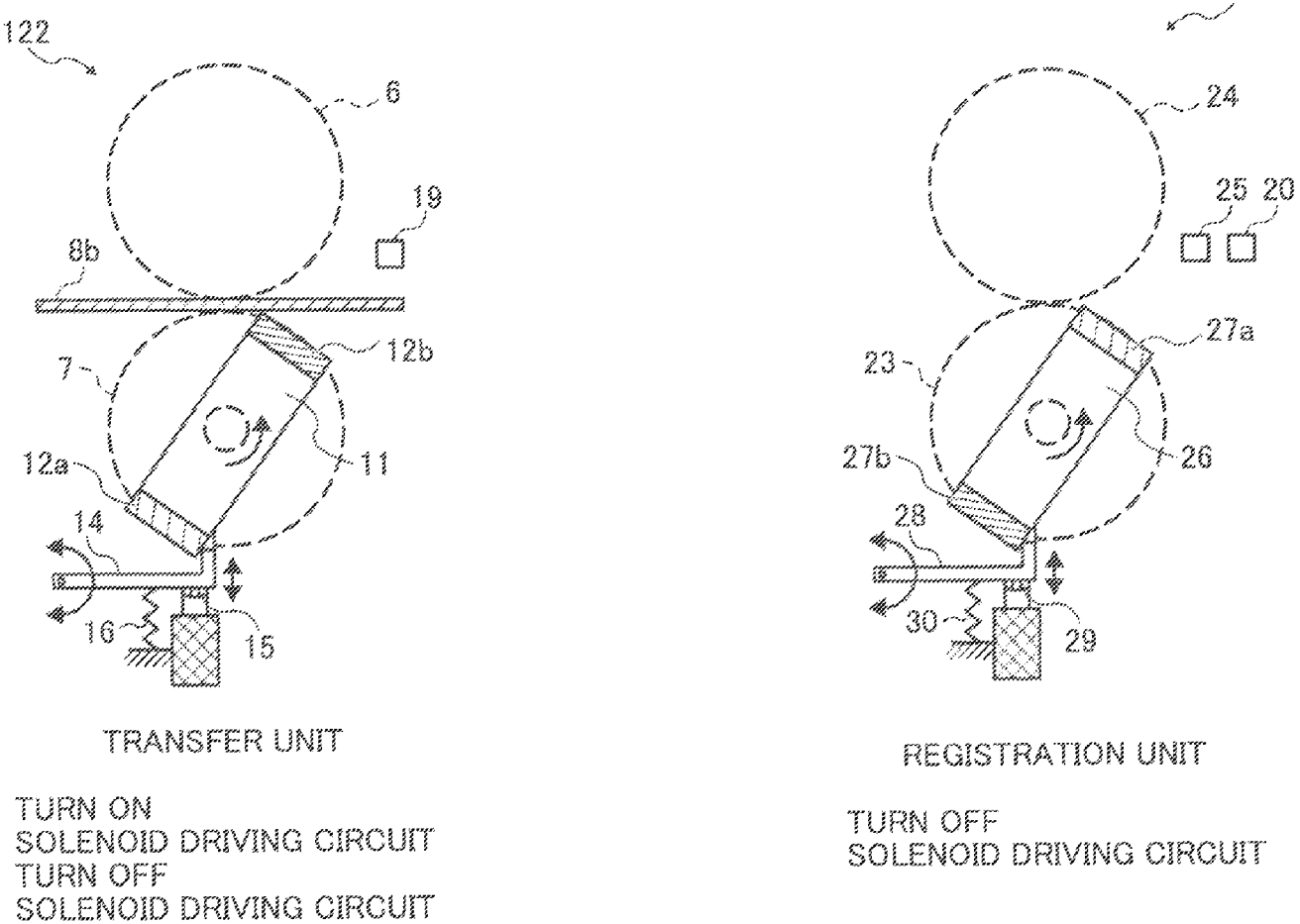

During the exit of a sheet from the transfer press-contact portion, as shown in FIG. 34, when passage of the trailing end of the sheet 8*b* is detected by the transfer-unit-sheet-passage sensor 19, the transfer unit solenoid 15 is turned on to pull down the transfer unit ratchet 14 and allow the rotational motion of the transfer-unit-gap-forming-member supporting members 11. When the sheet 8*b* exits the press-contact portion of the transfer unit 122, sudden exit of the sheet 8*b* is relaxed by an amount of the thickness thereof by the thicker transfer-unit-gap forming member 12*b* and fluctuation in speed of the intermediate transfer belt 2 is controlled. When the transfer unit solenoid 15 is turned off to return the transfer unit ratchet 14 to its original position, the rotational motion of the transfer-unit-gap-forming-member supporting members 11 is regulated when the transfer-unit-gap-forming-member supporting members 11 make a half rotation. In this case, the thinner transfer-unit-gap forming member 12*a* is located near the press-contact portion of the transfer unit 122.

The control unit 124 judges whether it is detected that the trailing end of the sheet 8*b* has exited the press-contact portion of the transfer unit 112 (step S64). When the exit of the sheet 8*b* is detected, the control unit 124 turns on the transfer unit solenoid 15 (step S65). When the transfer unit solenoid 15 is turned on, the transfer unit ratchet 14 is pulled down and the transfer-unit-gap-forming-member supporting members 11 make a half rotation. The control unit 124 turns off the transfer unit solenoid 15 (step S66). When the transfer unit solenoid 15 is turned off, the transfer unit ratchet 14 is pushed up to regulate the rotation of the transfer-unit-gap-forming-member supporting members 11, which have finished the half rotation.

Figure 35:
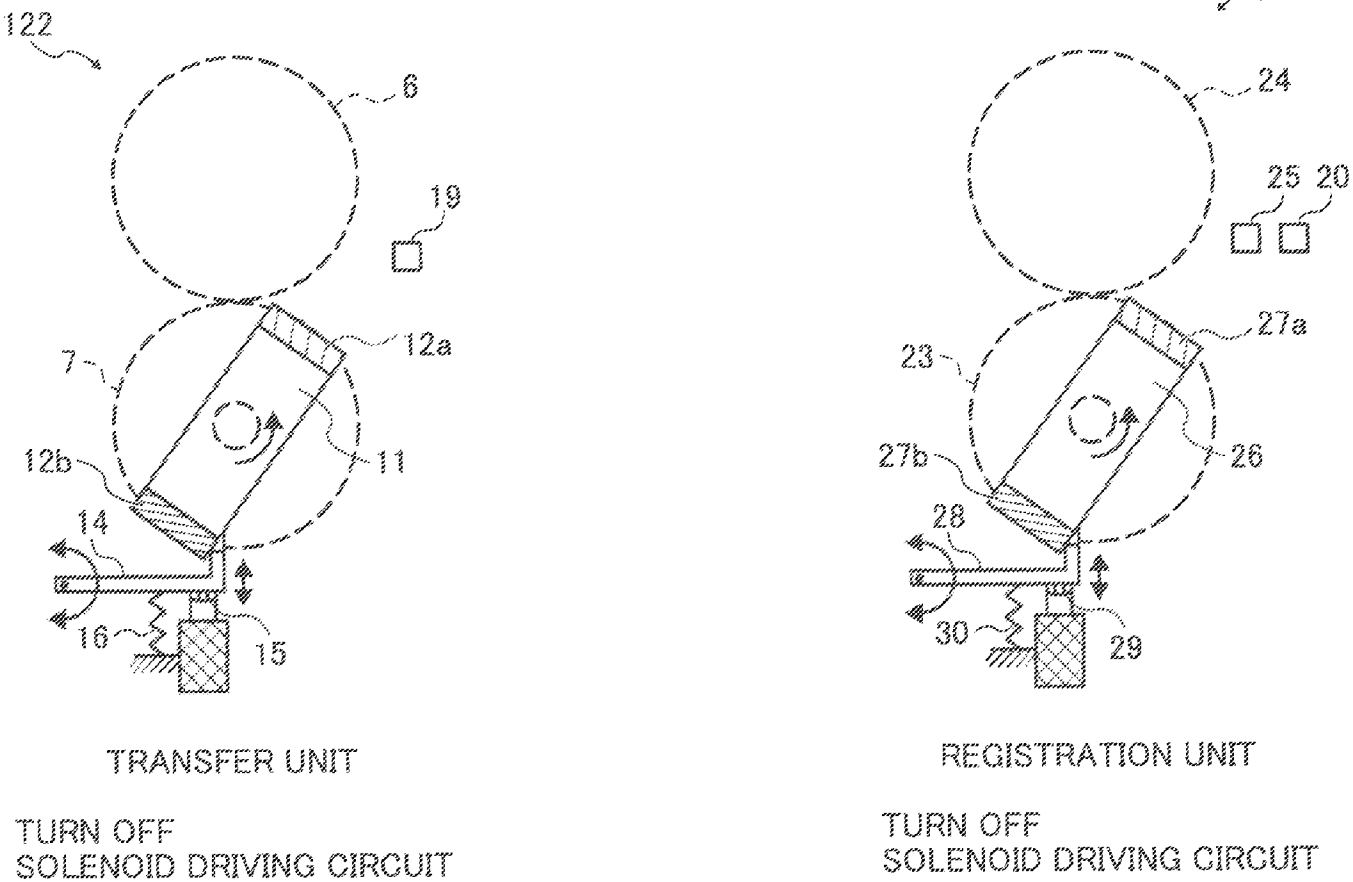

During the next sheet print standby, as shown in FIG. 35, the thinner transfer-unit-gap forming member 12*a* is located near the press-contact portion of the transfer unit 122 and the thinner registration-unit-gap forming member 27*a* is located near the press-contact portion of the registration unit 123 to stand by for the next printing.

By repeating the operations described above, during print start, the thinner transfer-unit-gap forming member 12*a* and the registration-unit-gap forming member 27*a* are always located near the press-contact portion of the transfer unit 122 and the press-contact portion of the registration unit 123, respectively. Therefore, in this embodiment, it is unnecessary to judge, using, for example, a home position sensor or a counter, whether the transfer-unit-gap forming members 12 and the registration-unit-gap forming members 27 on standby near the press-contact portions of the transfer unit 122 and the registration unit 123 are thin or thick. During passage of the thinner sheet 8*a*, the thinner transfer-unit-gap forming member 12*a* and the registration-unit-gap forming member 27*a* form a gap. During passage of the thicker sheet 8*b*, the thicker transfer-unit-gap forming member 12*b* and the registration-unit-gap forming member 27*b* form a gap. Thus, during the entrance of a sheet into the transfer press-contact portion, it is possible to appropriately relax fluctuation in speed of the intermediate transfer belt 2 due to steps of sheets, which occurs during the exit of a sheet from the registration-roller press-contact portion and during the exit of a sheet from the transfer press-contact portion.

As described above, in this embodiment, it is judged whether the sheet 8 is the thinner sheet 8*a* or the thicker sheet 8*b* to adjust a size of a gap according to the thickness of the sheet 8. Thus, it is possible to more appropriately reduce a rotation load generated in the image carrier.

In this embodiment, it is possible to select the thinner transfer-unit-gap forming member 12*a* or the thicker transfer-unit-gap forming member 12*b* to form a gap of an appropriate size according to the thickness of the sheet 8. Thus, it is possible to effectively reduce a rotation load.

Moreover, in this embodiment, a widest gap formed by the transfer-unit-gap forming members 12 is smaller than the thickness of the sheet 8 that enters the press-contact portion of the transfer unit 122. Thus, even if the transfer-unit-gap forming members 12 are in the press-contact portion while the sheet 8 is passing the press-contact portion of the transfer unit 122, this does not affect a transfer process.

The image forming apparatus 50 according to a fourth embodiment of the present invention is configured to determine, according to the thickness of the sheet 8, whether a gap should be formed in a transfer unit 132. In the following explanation of the image forming apparatus 50 according to the fourth embodiment, components similar to those in the embodiments described above are denoted by the identical reference numerals and signs and explanations thereof are omitted.

Figure 40:
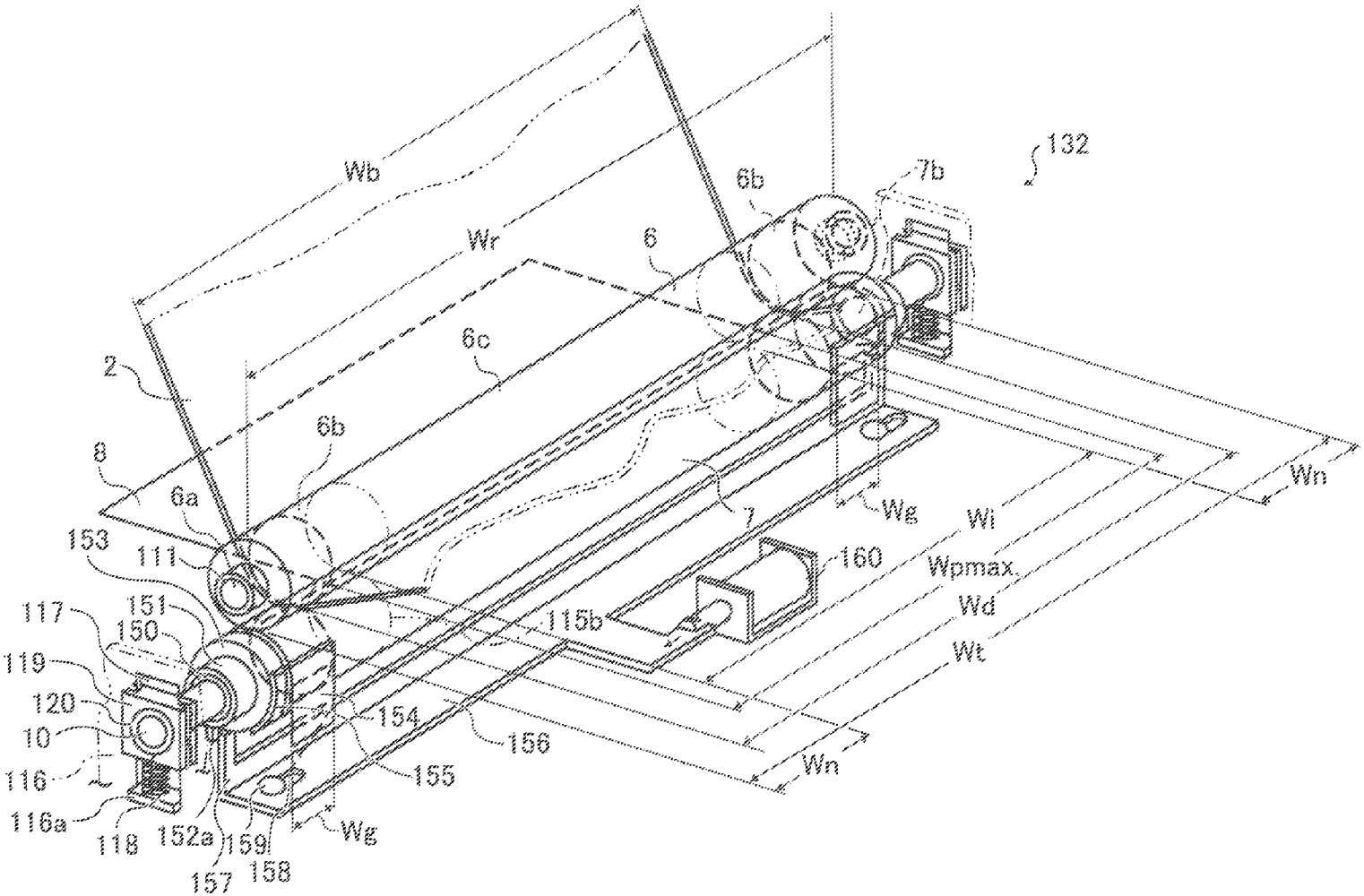
FIGS. 40 to 42 are perspective views of a transfer unit of an image forming apparatus according to a fourth embodiment of the present invention.
Figure 41:
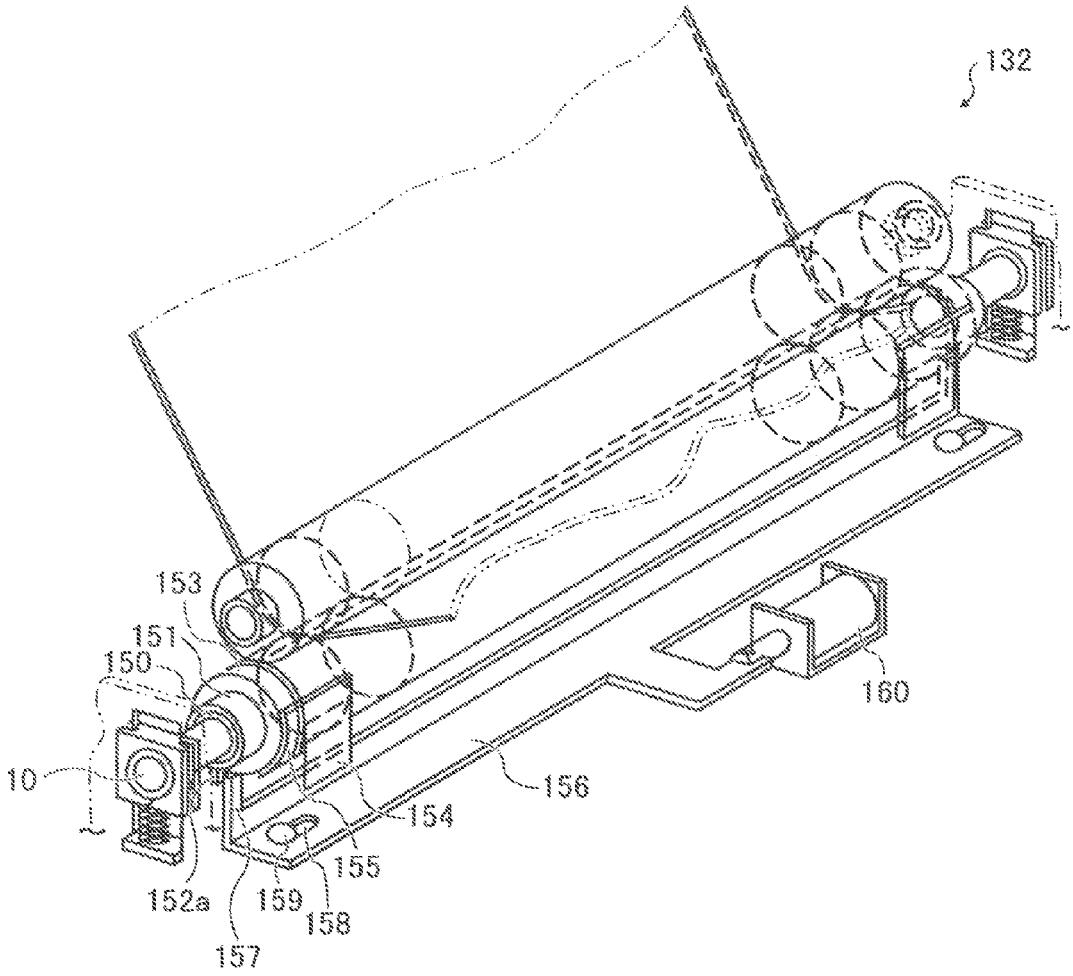
Figure 42:
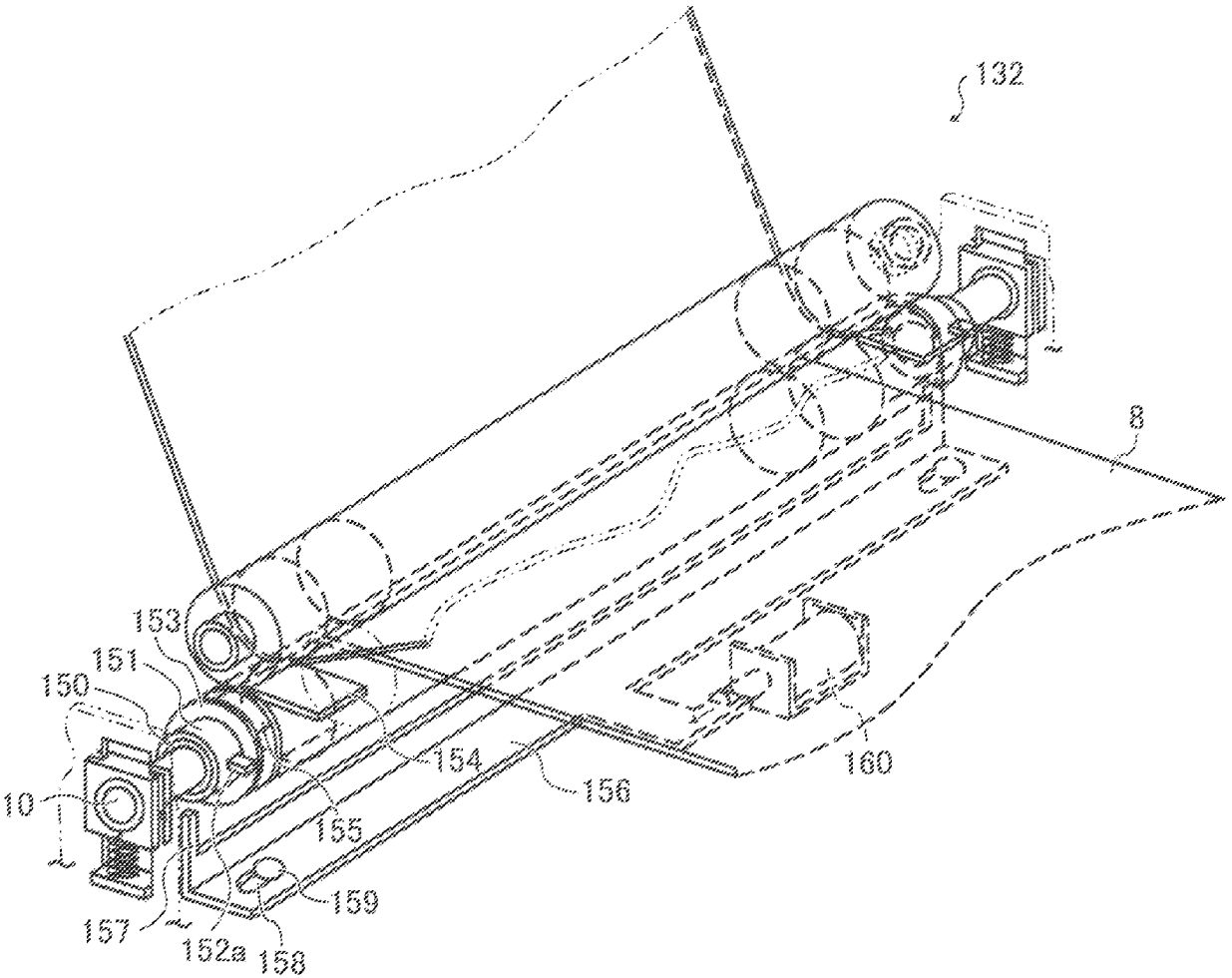

FIGS. 40 to 42 are perspective views of the transfer unit 132. FIG. 41 is a diagram of states before and after a gap is formed in the transfer unit 132. FIG. 42 is a diagram of a state in which the gap is formed in the transfer unit 132.

As shown in FIG. 40, the transfer unit 132 stretches and suspend and rotates accompanying the intermediate transfer belt 2 having a width of a belt width Wb in the main scanning direction and includes the counter roller 6 having a width of a counter roller width Wr in the main scanning direction. Counter roller shafts 6*a* provided at both ends of the counter roller 6 are supported by bearings 111 provided in a belt unit frame (not shown). When a width of an image forming area 6*c* that is an area on which a toner image of the counter roller 6 passes (an image forming area width) is Wi, a width of non-image forming areas 6*b* that are areas on which the toner image does not pass at both ends outside the image forming area (a non-image forming area width) is Wn, and a width of the counter roller 6 (a counter roller width) is Wr, a relational expression Wr (the counter roller width)=2×Wn (the non-image forming area width)+Wi (the image forming area width) holds.

Below the counter roller 6, the transfer roller 7 having a width in the main scanning direction (a transfer width) Wt is provided. On both sides of the transfer roller 7, slide holes 117 of a square hole shape opened in a main body side plate 116 and slide bearing holders 119 that slide on edges of the slide holes 117 are arranged. Bearings 120 that support the transfer roller shaft 10 are attached to the slide bearing holders 119.

Pressing springs 118 similar to the compression springs 9 and the transfer-unit compression spring 16 are provided between bottom surfaces of the slide bearing holders 119 and spring receiving units 116*a*. The pressing springs 118 presses the transfer roller 7 to the side of the counter roller 6.

As shown in FIG. 41, torque limiters 150 similar to the transfer-unit torque limiters 13 are slidably provided at both the ends of the transfer roller shaft 10. Torque limiter holders 151 are pressed into outer peripheries of the torque limiters 150. Gap forming and holding rings 153 are integrally provided in the torque limiter holders 151. Gap-forming-member attaching sections 155 as margins for joining sheet-like gap forming members 154 are provided on outer peripheries of the gap forming and holding rings 153. The gap forming members 154 are constituted the same as the transfer-unit-gap forming members 12 and joined to the gap-forming-member attaching sections 155 by a method such as adhesion, welding, or fusing. In areas of joining with the gap-forming-member attaching sections 155, a shape of the gap forming members 154 are an arc as with the shape of the outer peripheries of the inscribing gap-forming-member attaching sections 155. However, further on an upstream side in a rotating direction than the joining areas, since the gap forming members 154 are not subjected to an external force, the gap forming members 154 are formed flat by a restoring force thereof. The torque limiter holders 151 can rotate if a load torque applied to the torque limiters 150 by the rotation of the transfer roller shaft 10 is equal to or smaller than a set torque. The torque limiters 150 and the torque limiter holders 151 are prevented from moving in the main scanning direction on the transfer roller shaft 10.

Projected rotation stopping pawl sections 152*a* are provided on the outer peripheries of the torque limiter holders 151. A hooking plate 156 has long holes 158 extending in a width direction thereof, i.e., the main scanning direction. Movement of the hooking plate 156 in the conveying direction of the sheet 8, i.e., the sub-scanning direction is regulated by pins 159 fixed to the main body. The hooking plate 156 is movable in the main scanning direction at a predetermined stroke. The hooking plate 156 moves in the main scanning direction with a solenoid 160 as a power source. In a state shown in FIG. 41, the solenoid 160 is off, the hooking plate 156 is located on a right side in the figure, and hooking pawl sections 157 projected to both sides of the hooking plate 156 are in contact with the rotation stopping pawl sections 152*a*. Thus, the rotation of the torque limiter holder 151 is regulated.

In a state shown in FIG. 42, the solenoid 160 is turned on and the hooking plate 156 moves in a left direction in the figure. Thus, the hooking pawl sections 157 open the rotation stopping pawl sections 152*a*. The torque limiter holders 151 and the gap forming members 154 rotate at a torque equal to or smaller than the set torque of the torque limiter 150. In this embodiment, since the hooking pawl sections 157 move in the width direction of the transfer roller 7, it is possible to release the contact of the rotation stopping pawl sections 152*a* and the hooking pawl sections 157 simultaneously on the left and the right.

In this embodiment, based on thickness information of the sheet 8 detected by the sheet thickness sensor 20 or thickness information of the sheet 8 manually input and set by a user, only when the thickness of the sheet 8 exceeds a predetermined threshold, a gap is formed between the counter roller 6 and the transfer roller 7 according to judgment of the microprocessor 21.

Figure 43:
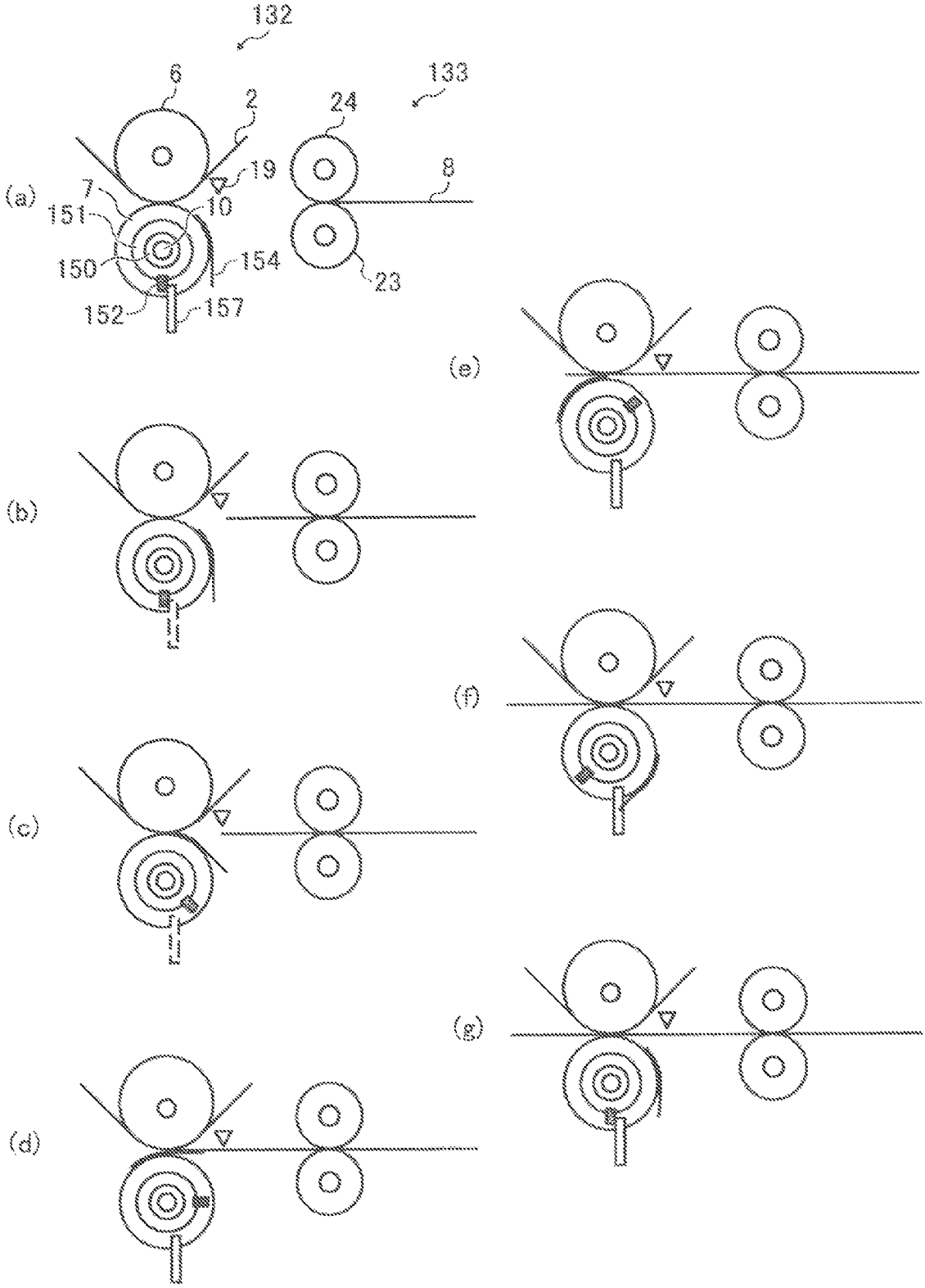
FIG. 43 is a sectional view the transfer unit shown in time series according to the fourth embodiment.

FIG. 43 depicts states of formation of a gap in the transfer unit 132 in time series.

In the state in FIG. 43 (*a*), the counter roller 6 and the transfer roller 7 constituting the transfer unit 132 start rotation. The counter roller 6 rotates according to conveyance by the intermediate transfer belt 2 and the transfer roller 7 rotates following the rotation of the counter roller 6. Since the hooking pawl sections 157 still hook the rotation stopping pawl sections 152*a*, the torque limiters 150 slip and the gap forming members 154 provided in the torque limiter holders 151 stay on standby while stopping in front of the press-contact portion. The sheet 8 is located in the press-contact portion of a registration unit 133 constituted by the registration roller 23 and the registration pressure roller 24.

In the state in FIG. 43 (*b*), the transfer-unit-sheet-passage sensor 19 detects that the leading end of the sheet 8 has arrived. The hooking pawl sections 157 opens the rotation stopping pawl sections 152*a* according to the operation of the solenoid 160. The torque limiter holders 151 and the gap forming members 154 start to rotate in the counterclockwise direction with a transmission torque of the torque limiters 150.

In the state in FIG. 43 (*c*), the leading end of the gap forming member 154 reaches the press-contact portion of the counter roller 6 and the transfer roller 7. Specifically, the leading end of the gap forming member 154 reaches the non-image forming areas 6*b* of the counter roller 6. In the state in FIG. 43 (*d*), the gap forming member 154 further rotates in the counterclockwise direction while being nipped by the press-contact portion. The leading end of the sheet 8 reaches the press-contact portion where the counter roller 6 and the transfer roller 7 come into press contact with the intermediate transfer belt 2.

In the state in FIG. 43 (*e*), the gap forming member 154 has exited the press-contact portion. In the state in FIG. 43 (*f*), the gap forming member 154 further rotates in the counterclockwise direction. The rotation stopping pawl sections 152*a* approach a position where the hooking pawl sections 157 are waiting in a hooked state. In the state in FIG. 43 (*g*), the hooking pawl sections 157 come into contact with the rotation stopping pawl sections 152*a*, hook the rotation stopping pawl sections 152*a*, and return to their original positions.

As described above, in this embodiment, based on thickness information of the sheet 8 detected by the sheet thickness sensor 20 and thickness information of the sheet 8 manually input and set by the user, only when the thickness of the sheet 8 exceeds the predetermined threshold, a gap is formed between the counter roller 6 and the transfer roller 7 according to judgment of the microprocessor 21. Thus, it is possible to prevent the intermediate transfer belt 2 and the transfer roller 7 from being deformed.

In the image forming apparatus 50 according to a fifth embodiment of the present invention, shapes and thicknesses of the transfer-unit-gap forming members 12 and the registration-unit-gap forming members 27 are different from those in the embodiments described above and vary in the image sub-scanning direction (the conveying direction of the sheet 8). In the following explanation of the image forming apparatus 50 according to the fifth embodiment, components similar to those in the embodiments described above are denoted by the identical reference numerals and signs and explanations thereof are omitted.

Figure 44:
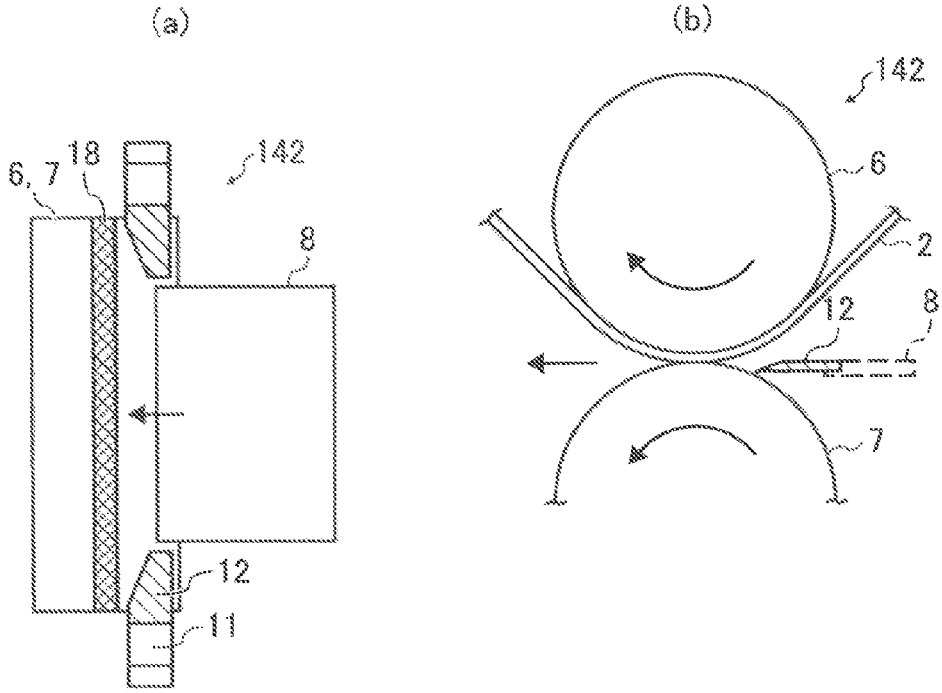
FIGS. 44 and 45 are sectional views of a press-contact portion of a transfer unit according to a fifth embodiment of the present invention.
Figure 45:
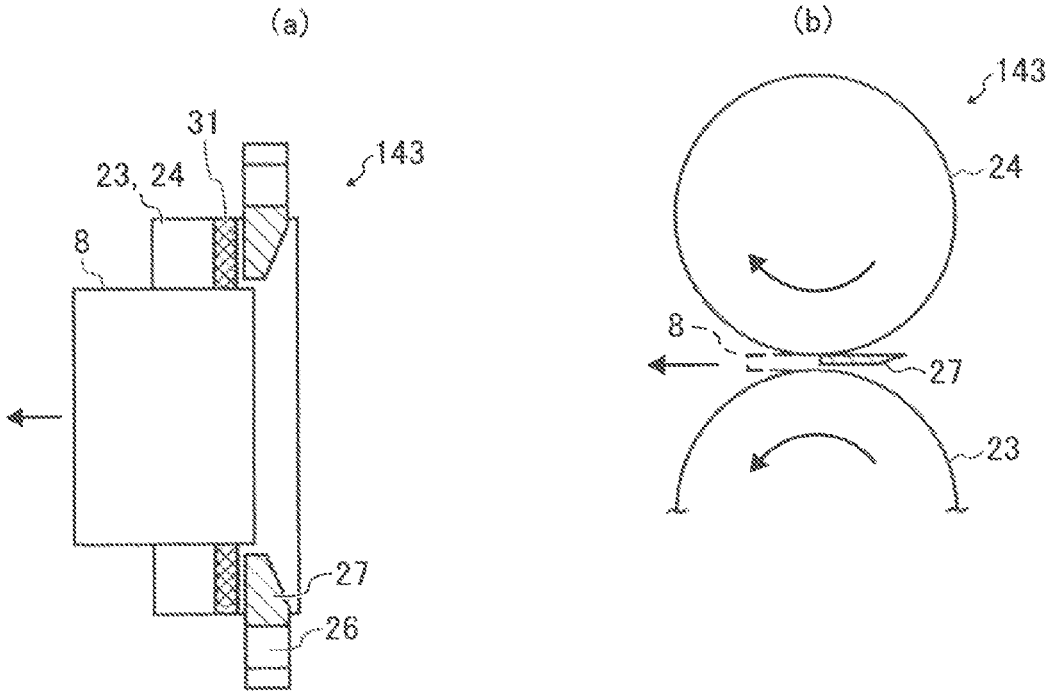

FIG. 44 is a sectional view of a transfer unit 142. FIG. 45 is a sectional view of a registration unit 143.

As shown in FIG. 44 (*a*), in this embodiment, leading end sides of the transfer-unit-gap forming members 12 are obliquely cut in the width direction toward the conveying direction of the sheet 8. As shown in FIG. 44 (*b*), the leading ends of the transfer-unit-gap forming members 12 are formed in a wedge shape inclined in the thickness direction. Therefore, fluctuation in speed of the intermediate transfer belt 2 that occurs when the leading ends of the transfer-unit-gap forming members 12 enter the press-contact portion is reduced. It is possible to obtain the same effect when the transfer-unit-gap forming members 12 are inclined in one of the width direction and the thickness direction.

As shown in FIG. 45 (*a*), trailing end sides of the registration-unit-gap forming members 27 are obliquely cut toward the conveying direction of the sheet 8. As shown in FIG. 45 (*b*), the trailing ends of the registration-unit-gap forming members 27 are formed in a wedge shape inclined in the thickness direction. Therefore, fluctuation in speed of the intermediate transfer belt 2 that occurs when the trailing ends of the registration-unit-gap forming members 27 exit the press-contact portion of the registration unit 143 is reduced. It is possible to obtain the same effect when the registration-unit-gap forming members 27 are inclined in one of the width direction and the thickness direction.

As described above, in this embodiment, the shapes of the transfer-unit-gap forming members 12 and the registration-unit-gap forming members 27 in the conveying direction of the sheet 8 have the distributions in the image sub-scanning direction. The leading end sides of the transfer-unit-gap forming members 12 are obliquely cut in the width direction toward the conveying direction of the sheet 8.

In this embodiment, the thicknesses of the transfer-unit-gap forming members 12 and the registration-unit-gap forming members 27 in the conveying direction of the sheet 8 have the distributions in the image sub-scanning direction. The thickness of the transfer-unit-gap forming members 12 decreases to the leading ends thereof.

In this embodiment, the thickness of the transfer-unit-gap forming members 12 in the conveying direction of the sheet 8 has the distribution and the shape of the transfer-unit-gap forming members 12 in the conveying direction of the sheet 8 has the distribution with respect to the image sub-scanning direction. The leading ends of the transfer-unit-gap forming members 12 are obliquely cut in the width direction toward the conveying direction and the thickness of the transfer-unit-gap forming members 12 decreases to the leading ends. Like the transfer-unit-gap forming members 12, the leading ends of the registration-unit-gap forming members 27 are obliquely cut in the width direction toward the conveying direction and the thickness of the registration-unit-gap forming members 27 decreases to the leading ends. Consequently, it is possible to control fluctuation in speed of the intermediate transfer belt 2 that occurs when the transfer-unit-gap forming members 12 exit the press-contact portion of the transfer unit 142 and when the registration-unit-gap forming member 27 exit from the press-contact portion of the registration unit 143.

In the image forming apparatus 50 according to a sixth embodiment of the present invention, the gap forming members 154 move in the main scanning direction. In the following explanation of the image forming apparatus 50 according to the sixth embodiment, components are the same as those in the embodiments described above are denoted by the identical reference numerals and signs and explanations thereof are omitted.

Figure 46:
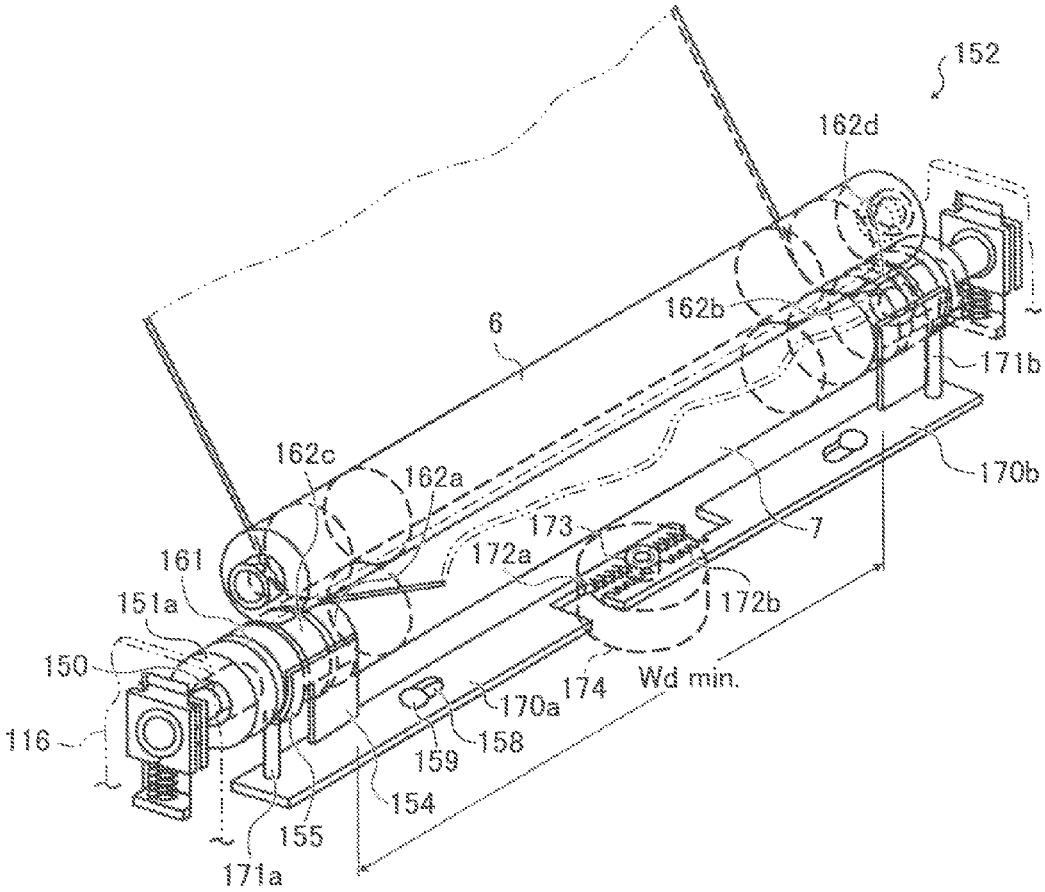
FIGS. 46 and 47 are perspective views of a transfer unit of an image forming apparatus according to a sixth embodiment of the present invention.
Figure 47:
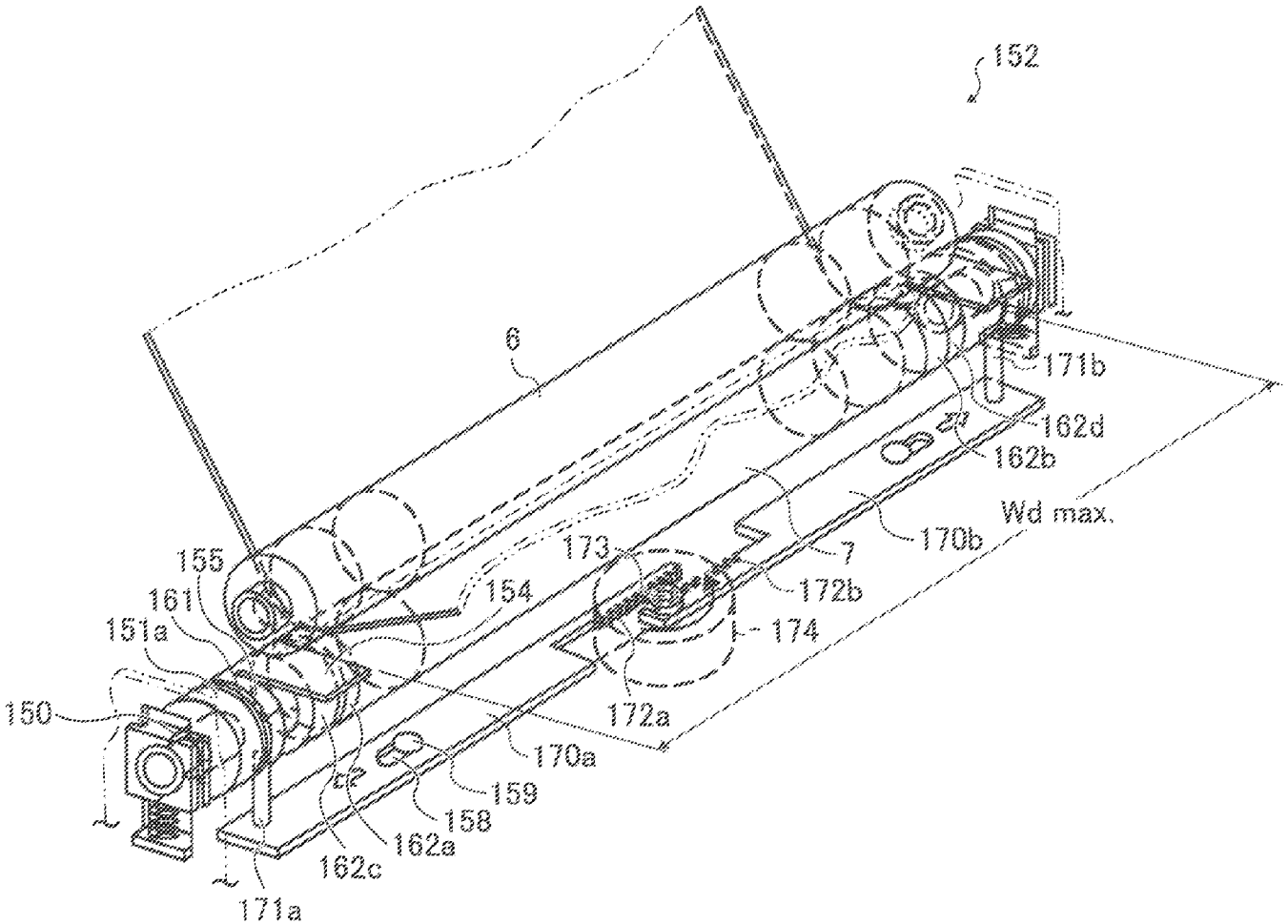

FIGS. 46 and 47 are perspective views of a transfer unit 152. The transfer unit 152 includes a stepping motor 174 and rack plates 170*a* and 170*b* that are moved in the main scanning direction reversely to each other according to rotation of the stepping motor 174 via a rack mechanism. Rack units 172*a* and 172*b* that mesh with a pinion gear 173 attached to the stepping motor 174 are formed in the rack plates 170*a* and 170*b*, respectively. The rack plates 170*a* and 170*b* have the long holes 158 extending in a width direction thereof, i.e., the main scanning direction, respectively. Movement of the rack plates 170*a* and 170*b* in the conveying direction of the sheet 8, i.e., the sub-scanning direction is regulated by the pins 159 fixed to the main body. The rack plates 170*a* and 170*b* are movable in the main scanning direction at a predetermined stroke. At ends of the rack plates 170*a* and 170*b*, groove-cam actuating pins 171*a* and 171*b* are vertically provided, respectively, such that ends thereof are inserted into groove cam units 161 described later.

At both the ends of the transfer roller 7, large diameter rings 162*a* and 162*b* adjacent to the ends of the transfer roller 7 and having a diameter equal to that of the transfer roller 7 and small diameter rings 162*c* and 162*d* adjacent to the large diameter rings 162*a* and 162*b* and having a diameter smaller than the large diameter rings 162*a* and 162*b* are provided integrally with or separately from the transfer roller 7. The large diameter ring 162*a* and the small diameter ring 162*c* are provided in a pair at one end of the transfer roller 7. The large diameter ring 162*b* and the small diameter ring 162*d* are provided in a pair at the other end of the transfer roller 7. At both the ends of the transfer roller shaft 10, torque limiter holders 151*a* are provided via the torque limiters 150. The torque limiter holders 151 can rotate with a driving force of the transfer roller shaft 10 if a load torque applied to the torque limiters 150 is equal to or smaller than a set torque. The torque limiters 150 and the torque limiter holders 151 are provided in the transfer roller shaft 10 to be movable in the main scanning direction.

Figure 48:
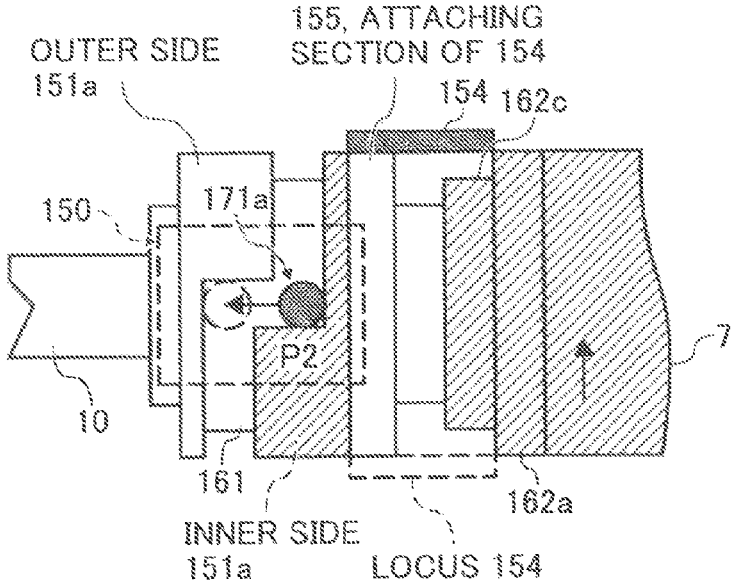
FIG. 48 is a bottom view of a torque limiter holder of the image forming apparatus according to the sixth embodiment.

FIG. 48 is a bottom view of the torque limiter holder 151*a*. The gap-forming-member attaching section 155 is provided on an inner side in an axial direction of the torque limiter holder 151*a*. The gap forming member 154 is provided in the gap-forming-member attaching section 155. The gap forming member 154 is joined to the gap-forming-member attaching section 155 by a method such as adhesion, welding, or fusing. The groove cam unit 161 is formed in the torque limiter holder 151*a*. The groove-cam actuating pins 171*a* and 171*b* are inserted into the groove cam unit 161. Therefore, while the gap forming member 154 is in a standby position (see FIG. 48), when an interval between the groove-cam actuating pin 171*a* and the groove-cam actuating pin 171*b* changes according to the rotation of the stepping motor 174, the groove-cam actuating pins 171*a* and 171*b* move the torque limiter holder 151*a* in the axial direction. An inter-gap-forming-members internal dimension width Wd, which is an interval between the two gap forming members 154, changes between Wdmin shown in FIG. 46 and Wdmax shown in FIG. 47. In this embodiment, the stepping motor 174 as a driving source for performing a rotational motion is used to move the gap forming member 154 in the main scanning direction. Thus, it is possible to accurately and quickly perform switching of presence or absence of a gap forming operation and an amount of gap formation. However, as in the fourth embodiment, the gap forming members 154 may be moved in the main scanning direction using the solenoid 160 that is a driving source for performing a linear motion. In that case, it is possible to drive the gap forming members 154 without changing a direction of the linear motion of the solenoid 160.

In this embodiment, the interval in the main scanning direction of the gap forming members 154 (the inter-gap-forming-members internal dimension width Wd) is adjusted between Wdmin and Wdmax according to the thickness of the sheet 8 to switch the gap forming members 154 to be nipped by the large diameter rings 162*a* and 162*b* or the small diameter rings 162*c* and 162*d* and change a gap size. When the stepping motor 174 moves both the gap forming members 154 in the main scanning direction and the inter-gap-forming-members internal dimension width (Wd) reaches Wdmin, during gap formation, the gap forming members 154 are nipped between the large diameter ring 162*a* and the counter roller 6 and between the large diameter ring 162*b* and the counter roller 6. When the stepping motor 174 moves both the gap forming members 154 in the main scanning direction and the inter-gap-forming-member internal dimensional width (Wd) reaches Wdmax, during gap formation, the gap forming member 154 is nipped between the small diameter ring 162*c* and the counter roller 6 and between the small diameter ring 162*d* and the counter roller 6.

Figure 49:
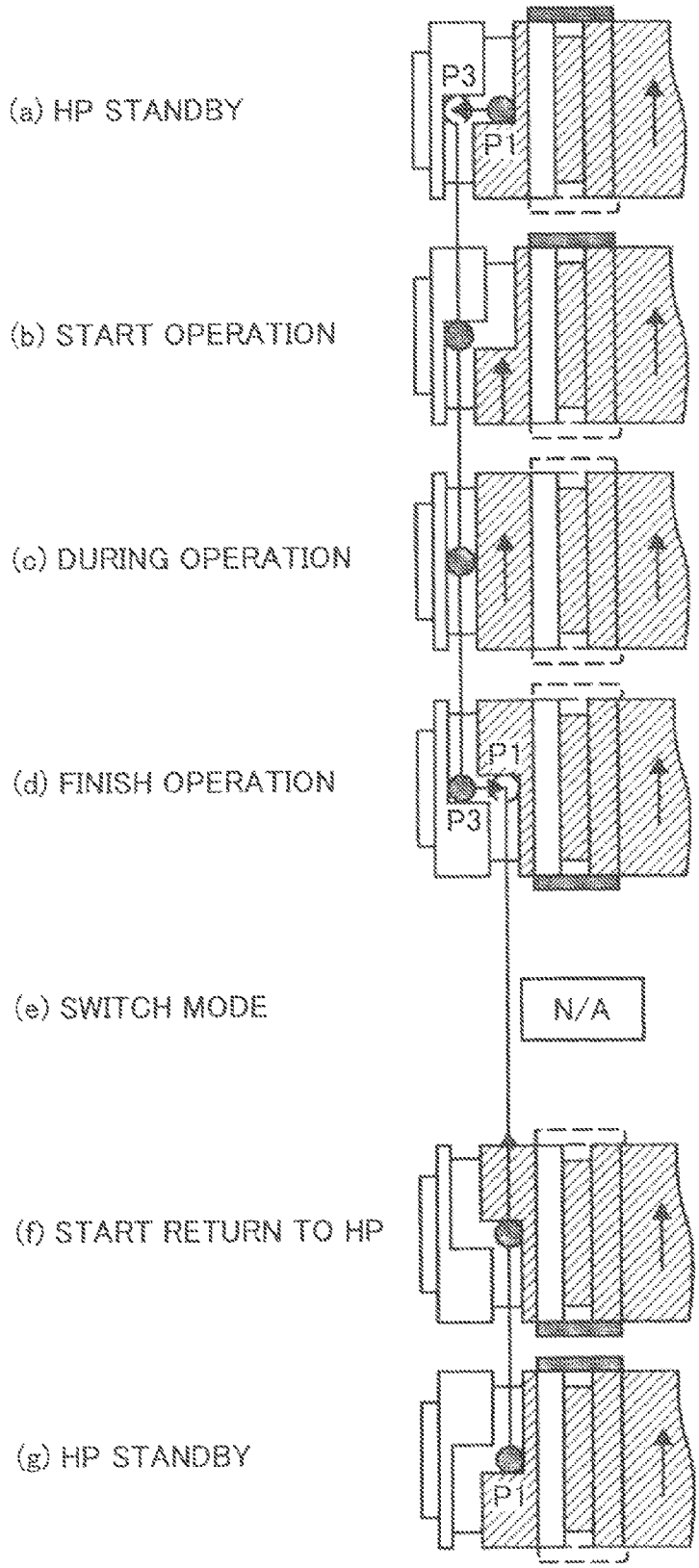
FIGS. 49 to 52 are schematic diagrams for explaining operations of the image forming apparatus according to the sixth embodiment.

When the groove-cam actuating pins 171*a* and 171*b* are in a position P1 (see FIG. 49 (*a*)), since the gap forming members 154 are in a standby state and do not rotate, the gap forming members 154 are not nipped by a press-contact portion of the transfer unit 152. Therefore, by selecting positions of the groove-cam actuating pins 171*a* and 171*b*, it is possible to select whether the gap forming member 154 is nipped by the press-contact portion of the transfer unit 152.

The groove-cam actuating pin 171*a* is moved to any one of a position P1, a position P2, a position P3, and a position P4 according to a rotation angle of the stepping motor 174. A position in the main scanning direction of the groove-cam actuating pin 171*a* is closer to the center in the width direction of the transfer roller 7 in an order of the position P1, the position P2, the position P3, and the position P4.

As shown in FIG. 48, when the transfer roller 7 and the transfer roller shaft 10 rotate in a direction indicated by an arrow and the torque limiter 150 transmits the rotation of the transfer roller 7 to the torque limiter holder 151*a*, the groove-cam actuating pin 171*a* collides with a wall in the main scanning direction (the horizontal direction) of a groove cam section 161. In this case, until the groove-cam actuating pin 171*a* moves to the left side in the main scanning direction, the torque limiter holder 151*a* and the gap forming member 154 are in a stopped state. As shown in FIG. 49 (*b*), when the groove cam unit 161 is in a lower part (further on an upstream side) than the groove-cam actuating pin 171*a*, the torque limiter holder 151*a* rotates following the transfer roller 7. In this embodiment, the registration unit 103 same as that in the first embodiment is provided. The registration unit 103 may be constituted in the same manner as the transfer unit 152. A gap is formed only at timing immediately before the sheet 8 enters the press-contact portion of the transfer unit 152, immediately before the sheet 8 exits the press-contact portion of the transfer unit 152, and immediately before the sheet 8 exits the press-contact portion of the registration unit 103.

Figure 50:
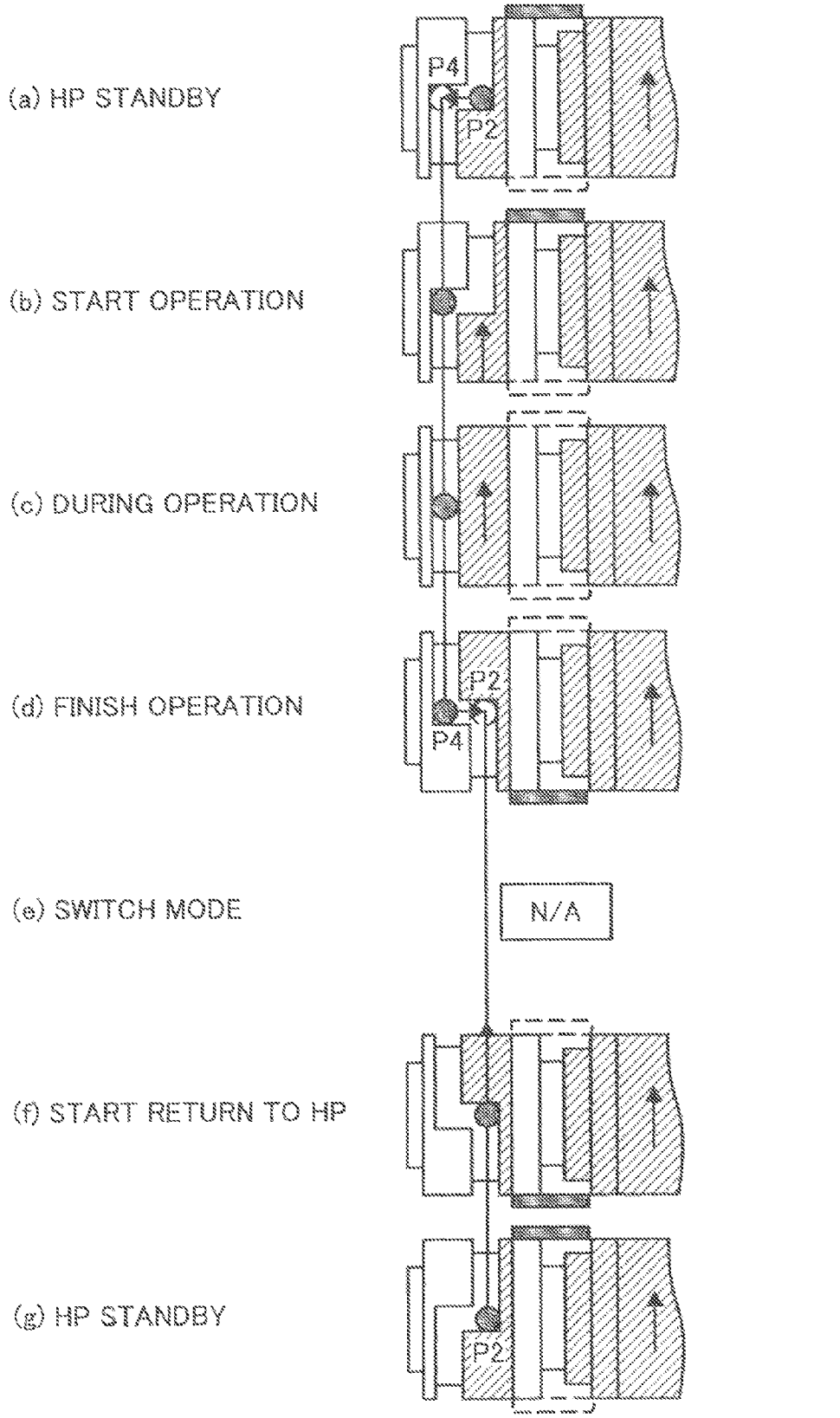
Figure 51:
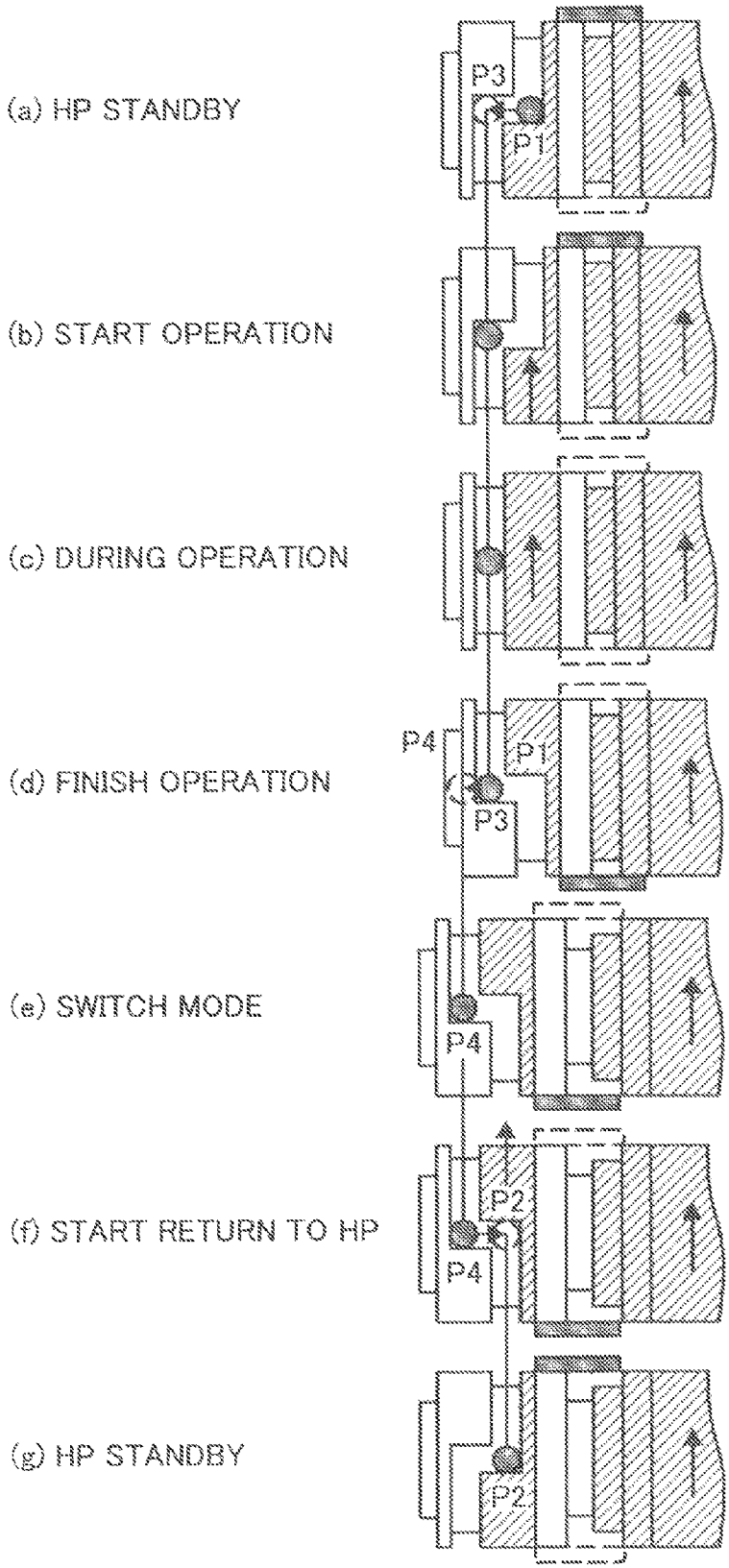
Figure 52:
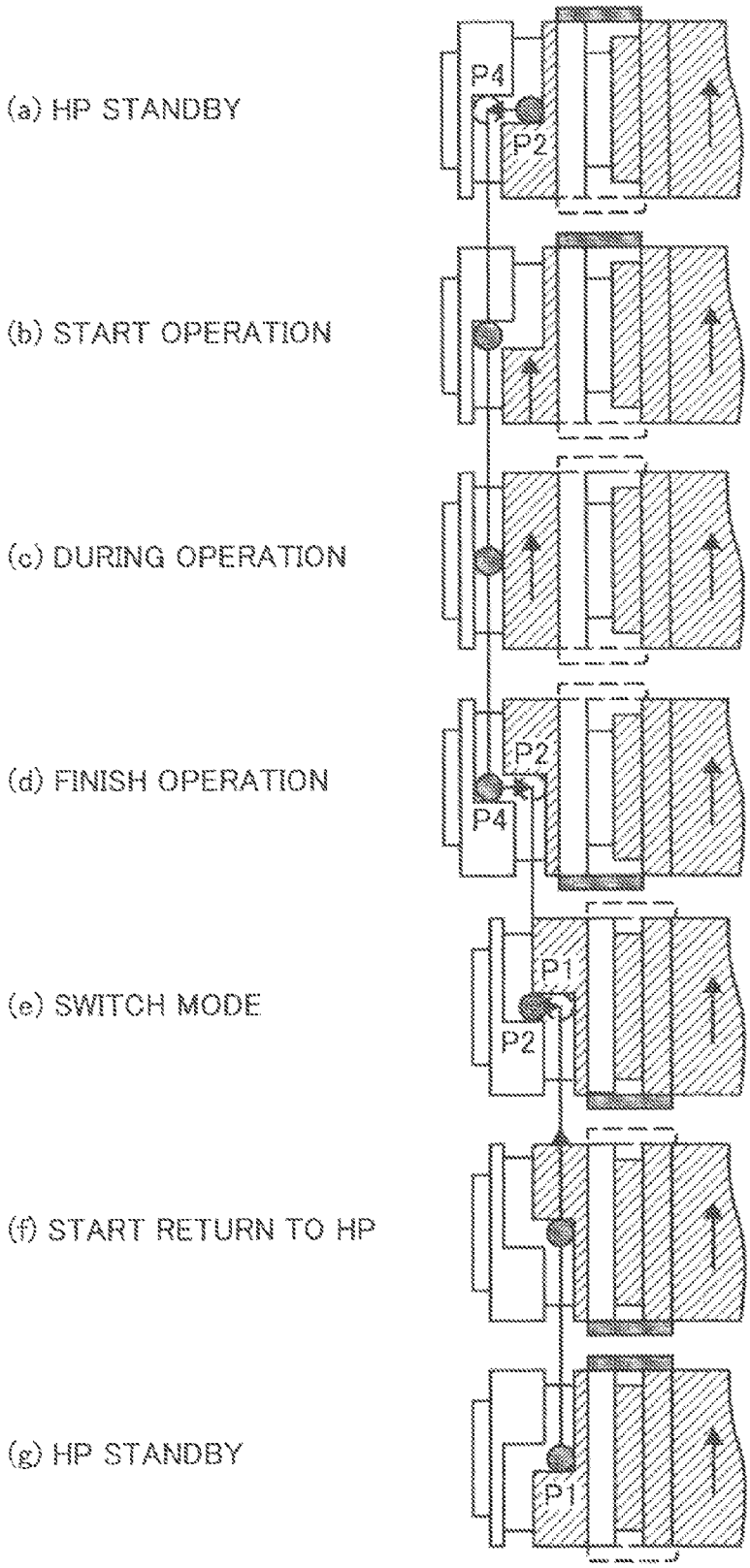

FIGS. 49 and 50 are schematic diagrams of operation states of the gap forming member 154 in a thick paper continuous mode and a medium thick paper continuous mode. FIGS. 51 and 52 are schematic diagrams of operation states of the gap forming member 154 at the time when a mode switches from the thick paper mode to the medium thick paper mode and at the time when a mode switches from the medium thick paper mode to the thick paper mode.

In this embodiment, it is possible to switch the image forming apparatus 50 to the two modes, i.e., the thick paper mode and the medium thick mode according to the thickness of the sheet 8. The thick paper mode is a mode corresponding to the relatively thick sheet 8 and the medium thick paper mode is a mode corresponding to the relatively thin sheet 8.

As shown in FIG. 49 (*a*), when the groove-cam actuating pin 171*a* is in the position P1, the groove-cam actuating pin 171*a* comes into contact with an inner wall on the inner side of the groove cam unit 161 of the torque limiter holder 151*a* (the center side in the width direction of the transfer roller 7). Thus, the torque limiter holder 151*a* does not rotate and stays on standby in a home position (HP in the figure). As shown in FIG. 49 (*b*), when the groove-cam actuating pin 171*a* moves to the position P3, the torque limiter holder 151*a* starts rotation and continues to rotate to a state shown in FIG. 49 (*c*). In the state in FIG. 49 (*c*), the gap forming member 154 reaches a press-contact position on the back of the figure and a gap is formed between the counter roller 6 and the transfer roller 7. In a state shown in FIG. 49 (*d*), the gap forming member 154 completely exits the press-contact portion and this gap forming operation is completed. In a state in which the groove-cam actuating pin 171*a* is in the position P3, the rotation of the torque limiter holder 151*a* stops. However, as shown in FIG. 49 (*f*), when the groove-cam actuating pin 171*a* moves to the position P1, the torque limiter holder 151*a* rotates again. As shown in FIG. 49 (*g*), the gap forming member 154 returns to the same home position as in FIG. 49 (*a*).

Therefore, in the thick paper continuous mode, when a gap is formed in the intermediate transfer belt 2 and the transfer roller 7 in the press-contact portion where the counter roller 6 and the transfer roller 7 come into press contact with the intermediate transfer belt 2, since the leading end of the gap forming member 154 is in contact with the large diameter ring 162*a*, the gap formed is relatively large.

As shown in FIG. 50 (*a*), when the groove-cam actuating pin 171*a* is in the position P2, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in a home position. As shown in FIG. 50 (*b*), when the groove-cam actuating pin 171*a* moves to the position P4, the torque limiter holder 151*a* starts rotation and continues to rotate to a state shown in FIG. 50 (*c*). In the state in FIG. 50 (*c*), the gap forming member 154 reaches a press-contact position on the back of the figure and a gap is formed between the counter roller 6 and the transfer roller 7. In a state shown in FIG. 50 (*d*), the gap forming member 154 completely exits the press-contact portion and this gap forming operation is completed. In a state in which the groove-cam actuating pin 171*a* is in the position P4, the rotation of the torque limiter holder 151*a* stops. However, as shown in FIG. 50 (*f*), when the groove-cam actuating pin 171*a* moves to the position P2, the torque limiter holder 151*a* rotates again. As shown in FIG. 50 (*g*), the gap forming member 154 returns to the same home position as in FIG. 50 (*a*).

Therefore, in the medium thick paper continuous mode, when a gap is formed between the intermediate transfer belt 2 and the transfer roller 7 in the press-contact portion where the counter roller 6 and the transfer roller 7 come into contact with the intermediate transfer belt 2, since the leading end of the gap forming member 154 is in contact with the small diameter ring 162*c*, the gap formed is relatively small.

As shown in FIG. 51 (*a*), when the groove-cam actuating pin 171*a* is in the position P1, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in a home position. As shown in FIG. 51 (*b*), when the groove-cam actuating pin 171*a* moves to the position P3, the torque limiter holder 151*a* starts rotation and continues to rotate to a state shown in FIG. 51 (*c*). In the state in FIG. 51 (*c*), the gap forming member 154 reaches a press-contact position on the back of the figure and a gap is formed between the counter roller 6 and the transfer roller 7. In a state shown in FIG. 51 (*d*), the gap forming member 154 completely exits the press-contact portion and this gap forming operation is completed. In a state in which the groove-cam actuating pin 171*a* is in the position P3, the rotation of the torque limiter holder 151*a* stops. However, as shown in FIG. 51 (*e*), when the groove-cam actuating pin 171*a* moves to the position P4, the torque limiter holder 151*a* moves to the left side in the figure and a position of the leading end of the gap forming member 154 moves from the large diameter ring 162*a* to the small diameter ring 162*c*. In other words, a mode switches from the thick paper mode to the medium thick paper mode. Moreover, as shown in FIG. 51 (*f*), when the groove-cam actuating pin 171*a* moves to the position P2, the torque limiter holder 151*a* starts rotation again. As shown in FIG. 51 (*g*), the gap forming member 154 moves to the home position of the medium thick paper mode.

As shown in FIG. 52 (*a*), when the groove-cam actuating pin 171*a* is in the position P2, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in the home position of the medium thick paper mode. As shown in FIG. 52 (*b*), when the groove-cam actuating pin 171*a* moves to the position P4, the torque limiter holder 151*a* starts rotation and continues to rotate to a state shown in FIG. 52 (*c*). In the state in FIG. 52 (*c*), the gap forming member 154 reaches a press-contact position on the back of the figure and a gap is formed between the counter roller 6 and the transfer roller 7. In a state shown in FIG. 52 (*d*), the gap forming member 154 completely exits the press-contact portion and this gap forming operation is completed. In a state in which the groove-cam actuating pin 171*a* is in the position P4, the rotation of the torque limiter holder 151*a* stops. However, as shown in FIG. 52 (*e*), when the groove-cam actuating pin 171*a* moves to the position P1, the torque limiter holder 151*a* moves to the right side in the figure and a position of the leading end of the gap forming member 154 moves from the small diameter ring 162*c* to the large diameter ring 162*a*. In other words, a mode switches from the medium thick paper mode to the thick paper mode. Moreover, as shown in FIG. 52 (*f*), when the groove-cam actuating pin 171*a* moves to the position P1, the torque limiter holder 151*a* starts rotation again. As shown in FIG. 52 (*g*), the gap forming member 154 moves to the home position of the thick paper mode.

In the image forming apparatus 50 according to a seventh embodiment of the present invention, the gap forming member 154 moves in the main scanning direction and a size of a gap formed is changed steplessly. In the following explanation of the image forming apparatus 50 according to the seventh embodiment, components similar to those in the embodiments described above are denoted by the identical reference numerals and signs and explanations thereof are omitted.

Figure 53:
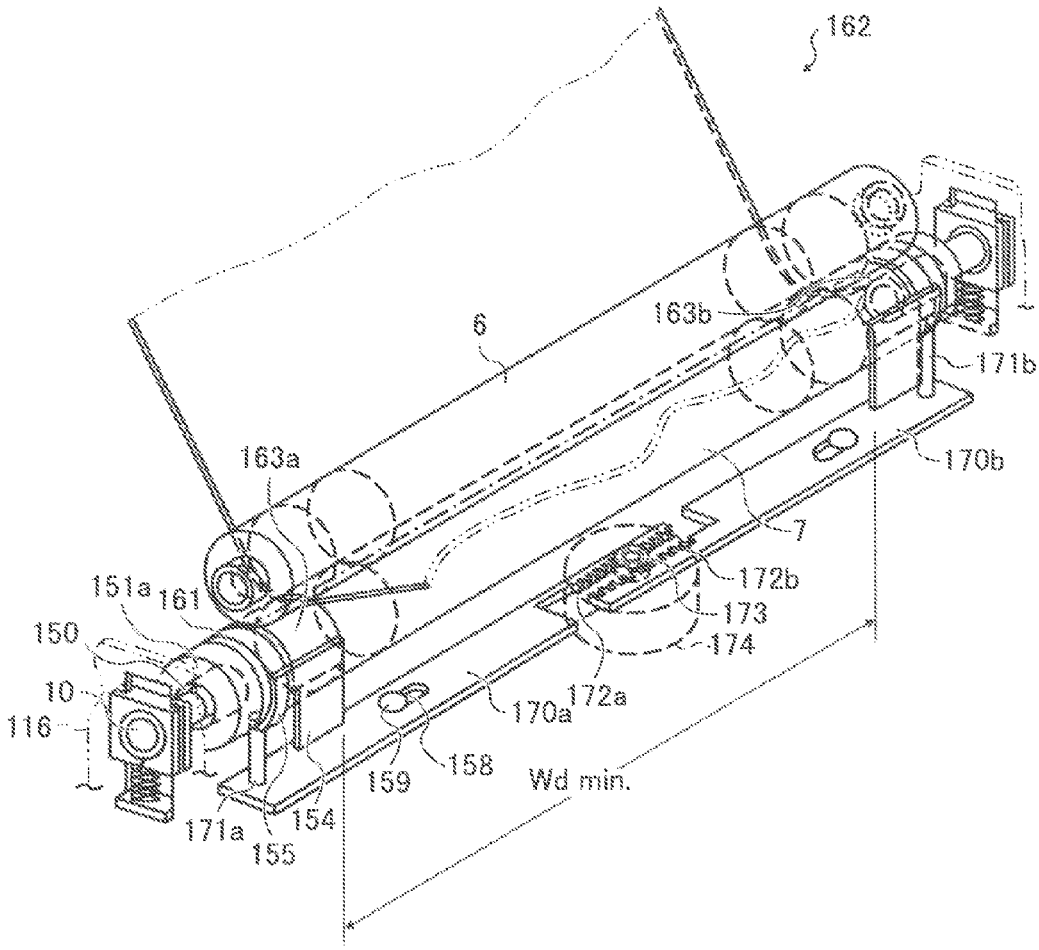
FIGS. 53 and 54 are perspective views of a transfer unit of an image forming apparatus according to a seventh embodiment of the present invention.
Figure 54:
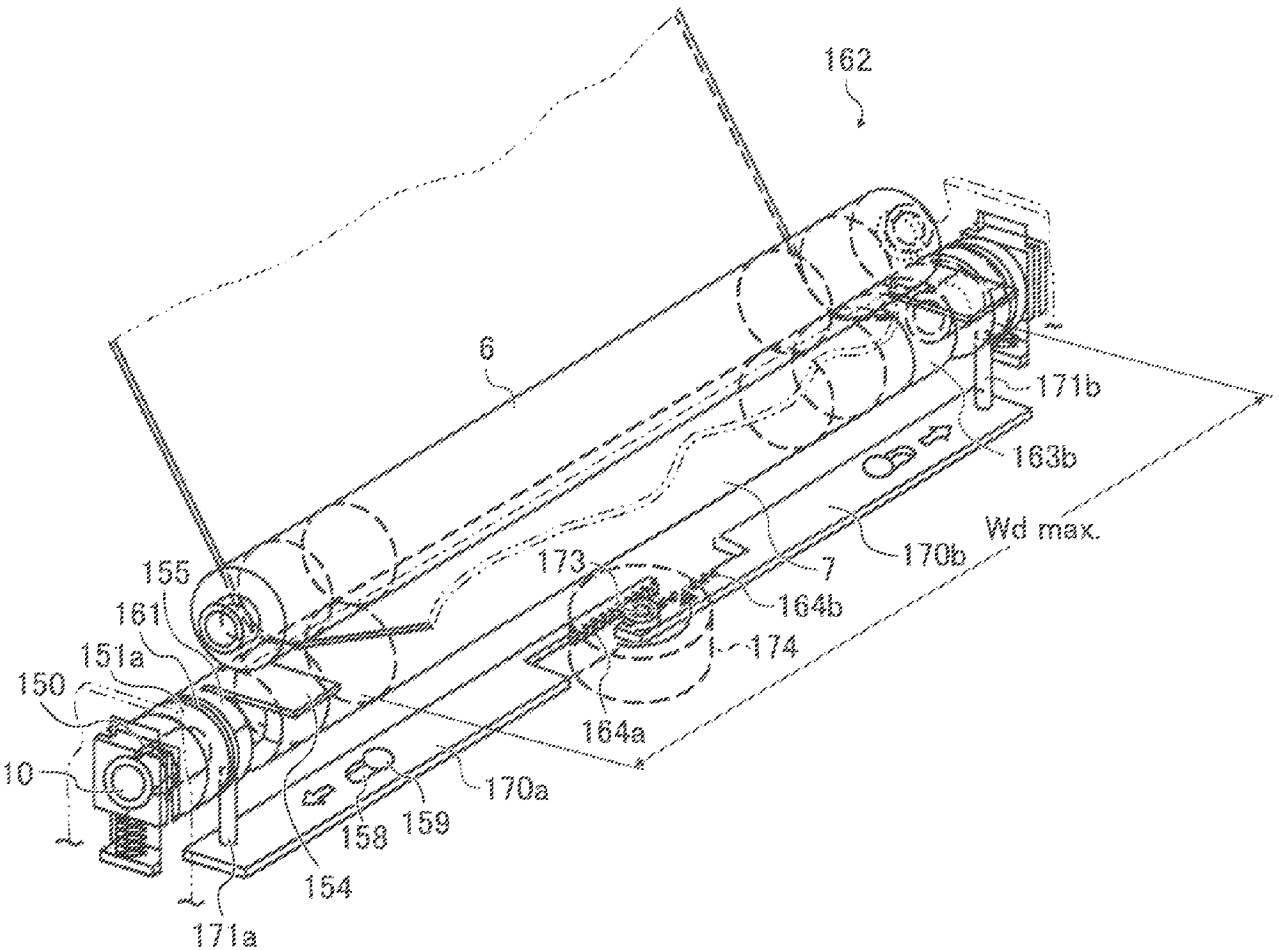
Figure 55:
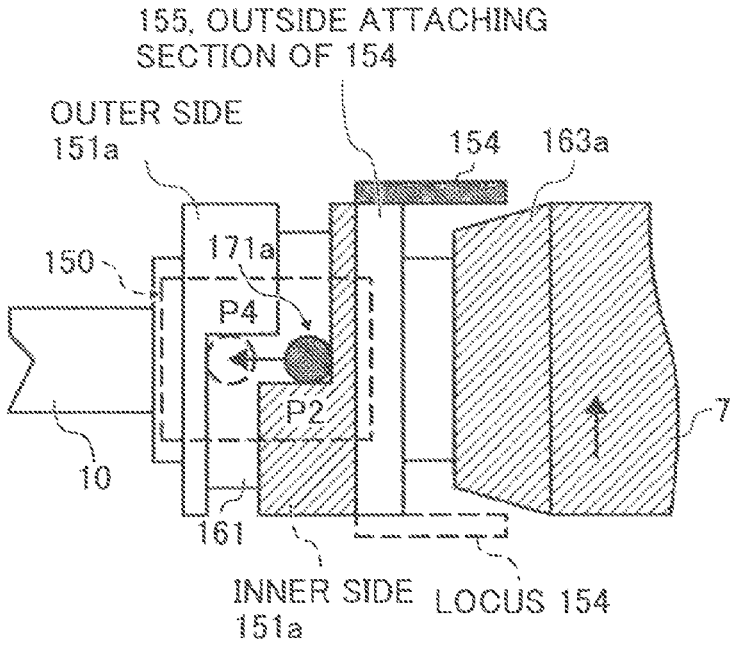
FIG. 55 is a bottom view of a torque limiter holder of the image forming apparatus according to the seventh embodiment.

FIGS. 53 and 54 are perspective views of a transfer unit 162. In this embodiment, taper rings 163*a* and 163*b* are provided integrally with or separately from the transfer roller 7 at both the ends of the transfer roller 7. As shown in detail in FIG. 55, the taper rings 163*a* and 163*b* are formed to be reduced in diameter toward an outer side in the main scanning direction of the transfer roller 7. A diameter in an inner side direction of the taper rings 163*a* and 163*b* is equal to the diameter of the transfer roller 7. A diameter in an outer side direction of the taper rings 163*a* and 163*b* is smaller than the diameter of the transfer roller 7.

While the gap forming members 154 are in a standby position (see FIG. 55), when an interval between the groove-cam actuating pin 171*a* and the groove-cam actuating pin 171*b* changes according to the rotation of the stepping motor 174, the groove-cam actuating pins 171*a* and 171*b* move the torque limiter holder 151*a* in the axial direction. The inter-gap-forming-members internal dimension width Wd, which is an interval between the two gap forming members 154, changes between Wdmin shown in FIG. 53 and Wdmax shown in FIG. 54.

In this embodiment, the interval in the main scanning direction of the gap forming members 154 (the inter-gap-forming-members internal dimension width Wd) is adjusted between Wdmin and Wdmax according to the thickness of the sheet 8 to switch portions of the taper rings 163*a* are 163*b* that nip the gap forming members 154 and change a gap size. When the stepping motor 174 moves both the gap forming members 154 in the main scanning direction and the inter-gap-forming-members internal dimension width (Wd) reaches Wdmin, during gap formation, the gap forming members 154 are nipped between the large diameter ring 162*a* and the counter roller 6 and between the large diameter ring 162*b* and the counter roller 6. When the stepping motor 174 moves both the gap forming members 154 in the main scanning direction and the inter-gap-forming-members internal dimensional width (Wd) reaches Wdmax, during gap formation, the gap forming members 154 are nipped between large diameter portions on the inner side in the main scanning direction of the taper rings 163*a* and 163*b* and the counter roller 6. When the stepping motor 174 moves both the gap forming members 154 in the main scanning direction and the inter-gap-forming-members internal dimensional width (Wd) reaches Wdmax, during gap formation, the gap forming members 154 are nipped between a small diameter portion on the outer side in the main scanning direction of the taper rings 163*a* and 163*b* and the counter roller 6. In this embodiment, the registration unit 103 same as that in the first embodiment is provided. The registration unit 103 may be constituted in the same manner as the transfer unit 162. A gap is formed only at timing immediately before the sheet 8 enters a press-contact portion of the transfer unit 162, immediately before the sheet 8 exits the press-contact portion of the transfer unit 162, and immediately before the sheet 8 exits the press-contact portion of the registration unit 103.

Figure 56:
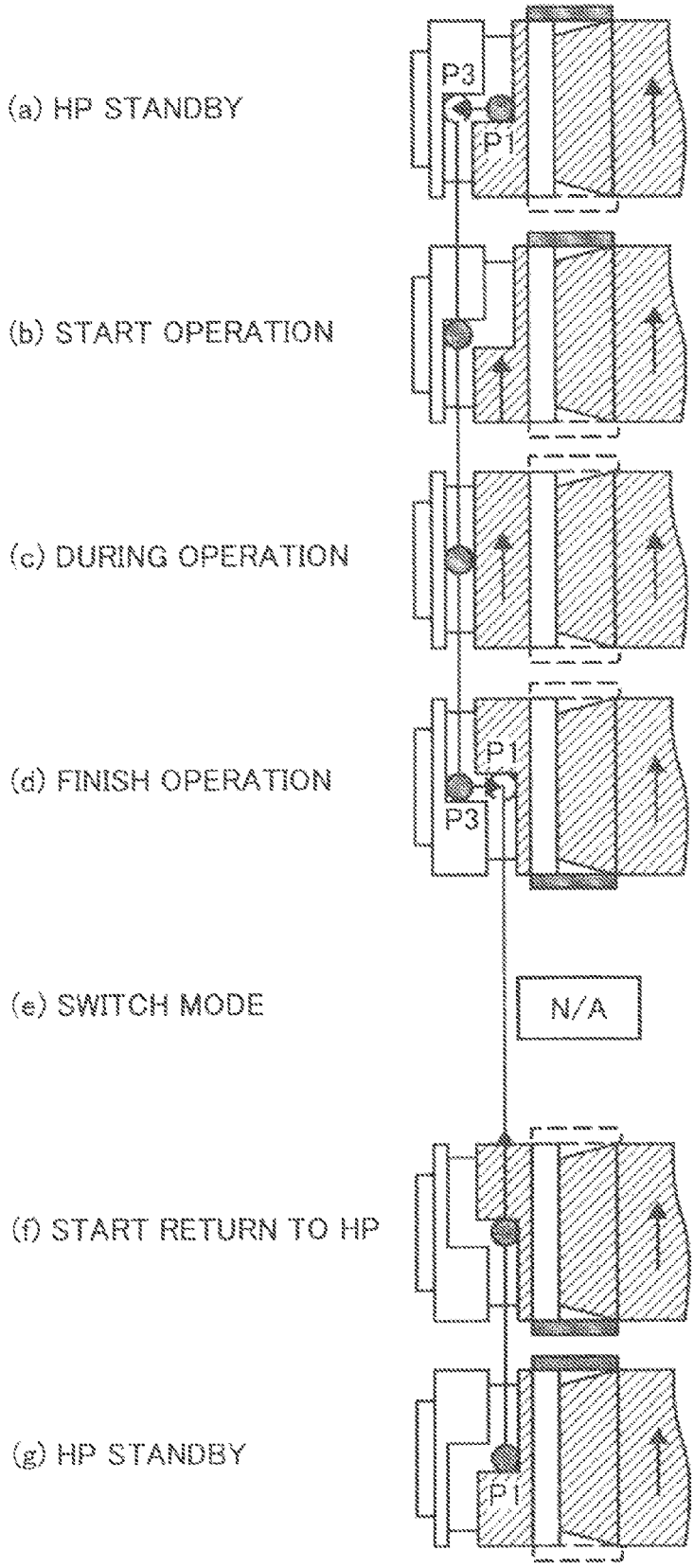
FIGS. 56 to 59 are schematic diagrams for explaining operations of the image forming apparatus according to the seventh embodiment.
Figure 57:
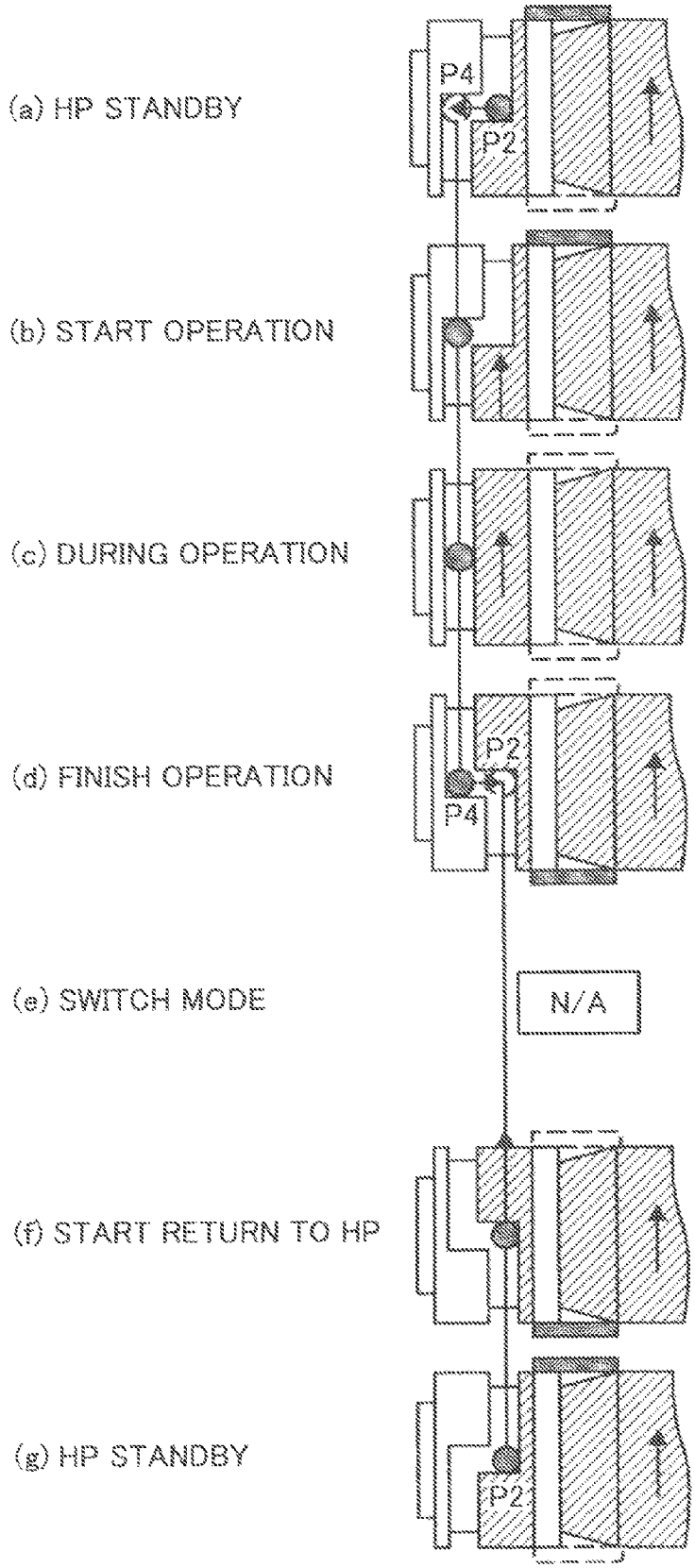
Figure 58:
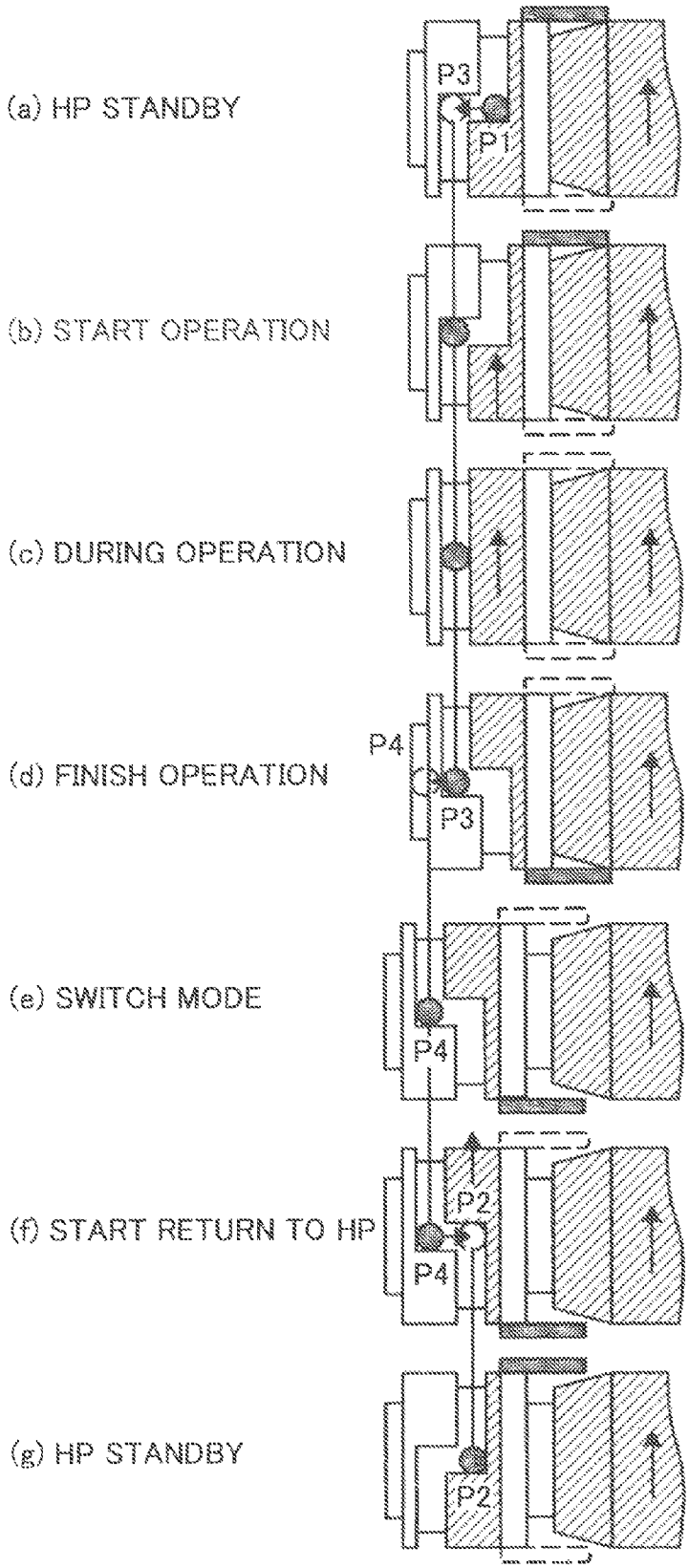
Figure 59:
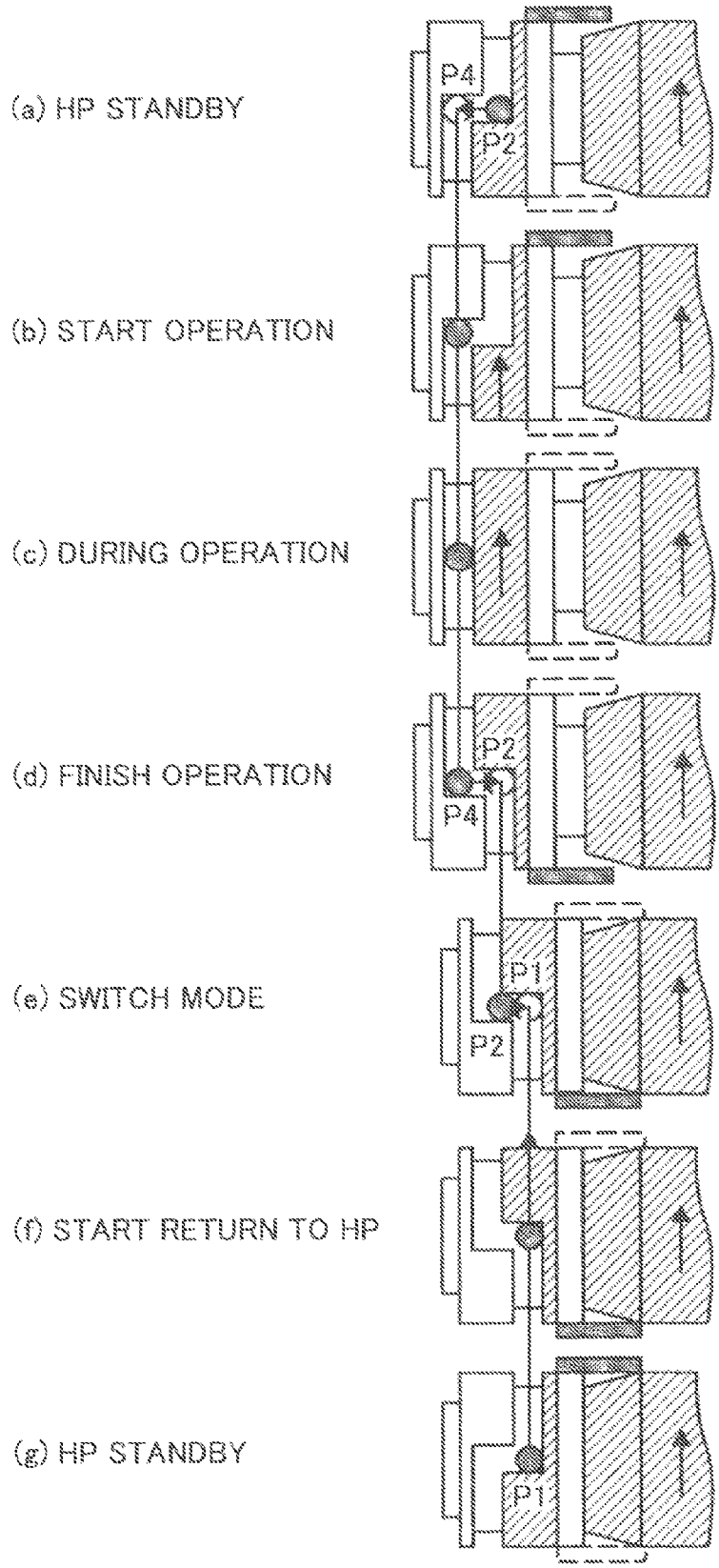

FIGS. 56 and 57 are schematic diagrams of operation states of the gap forming member 154 in the thick paper continuous mode and the medium thick paper continuous mode. FIGS. 58 and 59 are schematic diagrams of operation states of the gap forming member 154 at the time when a mode switches from the thick paper mode to the medium thick paper mode and at the time when a mode switches from the medium thick paper mode to the thick paper mode.

As shown in FIG. 56 (*a*), when the groove-cam actuating pin 171*a* is in the position P1, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in a home position. As shown in FIG. 56 (*b*), when the groove-cam actuating pin 171*a* moves to the position P3, the torque limiter holder 151*a* starts rotation and continues to rotate to a state shown in FIG. 56 (*c*). In the state in FIG. 56 (*c*), the gap forming member 154 reaches a press-contact position on the back of the figure and a gap is formed between the counter roller 6 and the transfer roller 7. In a state shown in FIG. 56 (*d*), the gap forming member 154 completely exits the press-contact portion and this gap forming operation is completed. In a state in which the groove-cam actuating pin 171*a* is in the position P3, the rotation of the torque limiter holder 151*a* stops. However, as shown in FIG. 56 (*f*), when the groove-cam actuating pin 171*a* moves to the position P1, the torque limiter holder 151*a* rotates again. As shown in FIG. 56 (*g*), the gap forming member 154 returns to the same home position as in FIG. 56 (*a*).

Therefore, in the thick paper continuous mode, since the leading end of the gap forming member 154 is in contact with the large diameter portion of the taper ring 163*a* or 163*b*, the gap formed is relatively large.

As shown in FIG. 57 (*a*), when the groove-cam actuating pin 171*a* is in the position P2, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in a home position. As shown in FIG. 57 (*b*), when the groove-cam actuating pin 171*a* moves to the position P4, the torque limiter holder 151*a* starts rotation and continues to rotate to a state shown in FIG. 57 (*c*). In the state in FIG. 57 (*c*), the gap forming member 154 reaches a press-contact position on the back of the figure and a gap is formed between the counter roller 6 and the transfer roller 7. In a state shown in FIG. 57 (*d*), the gap forming member 154 completely exits the press-contact portion and this gap forming operation is completed. In a state in which the groove-cam actuating pin 171*a* is in the position P4, the rotation of the torque limiter holder 151*a* stops. However, as shown in FIG. 57 (*f*), when the groove-cam actuating pin 171*a* moves to the position P2, the torque limiter holder 151*a* rotates again. As shown in FIG. 57 (*g*), the gap forming member 154 returns to the same home position as in FIG. 57 (*a*).

Therefore, in the medium thick paper continuous mode, since the leading end of the gap forming member 154 is in contact with the small diameter portion of the taper ring 163*a* or 163*b*, the gap formed is relatively small.

As shown in FIG. 58 (*a*), when the groove-cam actuating pin 171*a* is in the position P1, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in a home position. As shown in FIG. 58 (*b*), when the groove-cam actuating pin 171*a* moves to the position P3, the torque limiter holder 151*a* starts rotation and continues to rotate to a state shown in FIG. 58 (*c*). In the state in FIG. 58 (*c*), the gap forming member 154 reaches a press-contact position on the back of the figure and a gap is formed between the counter roller 6 and the transfer roller 7. In a state shown in FIG. 58 (*d*), the gap forming member 154 completely exits the press-contact portion and this gap forming operation is completed. In a state in which the groove-cam actuating pin 171*a* is in the position P3, the rotation of the torque limiter holder 151*a* stops. However, as shown in FIG. 58 (*e*), when the groove-cam actuating pin 171*a* moves to the position P4, the torque limiter holder 151*a* moves to the left side in the figure and a position of the leading end of the gap forming member 154 moves from the large diameter portion to the small diameter portion of the taper ring 163*a* or 163*b*. In other words, a mode switches from the thick paper mode to the medium thick paper mode. Moreover, as shown in FIG. 58 (*f*), when the groove-cam actuating pin 171*a* moves to the position P2, the torque limiter holder 151*a* starts rotation again. As shown in FIG. 58 (*g*), the gap forming member 154 moves to the home position of the medium thick paper mode.

As shown in FIG. 59 (*a*), when the groove-cam actuating pin 171*a* is in the position P2, the groove-cam actuating pin 171*a* comes into contact with the inner wall on the inner side of the groove cam unit 161 of the torque limiter holder 151*a* (the center side in the width direction of the transfer roller 7). Thus, the torque limiter holder 151*a* does not rotate and stays on standby in the home position of the medium thick paper mode. As shown in FIG. 59 (*b*), when the groove-cam actuating pin 171*a* moves to the position P4, the torque limiter holder 151*a* starts rotation and continues to rotate to a state shown in FIG. 59 (*c*). In the state in FIG. 59 (*c*), the gap forming member 154 reaches a press-contact position on the back of the figure and a gap is formed between the counter roller 6 and the transfer roller 7. In a state shown in FIG. 59 (*d*), the gap forming member 154 completely exits the press-contact portion and this gap forming operation is completed. In a state in which the groove-cam actuating pin 171*a* is in the position P4, the rotation of the torque limiter holder 151*a* stops. However, as shown in FIG. 59 (*e*), when the groove-cam actuating pin 171*a* moves to the position P1, the torque limiter holder 151*a* moves to the right side in the figure and a position of the leading end of the gap forming member 154 moves from the small diameter portion to the large diameter portion of the taper ring 163*a* or 163*b*. In other words, a mode switches from the medium thick paper mode to the thick paper mode. Moreover, as shown in FIG. 59 (*f*), when the groove-cam actuating pin 171*a* moves to the position P1, the torque limiter holder 151*a* starts rotation again. As shown in FIG. 59 (*a*), the gap forming member 154 moves to the home position of the thick paper mode.

As described above, in this embodiment, the gap forming member 154 is moved in parallel to the axial direction of the transfer roller 7 according to the thickness of the sheet 8 to adjust a size of a gap formed. Thus, even when the thickness of the sheet 8 varies, it is possible to appropriately reduce a rotation load generated in the intermediate transfer belt 2.

Details of the gap forming member 154 are explained in detail with reference to FIGS. 60A to 63.

Figure 60A:
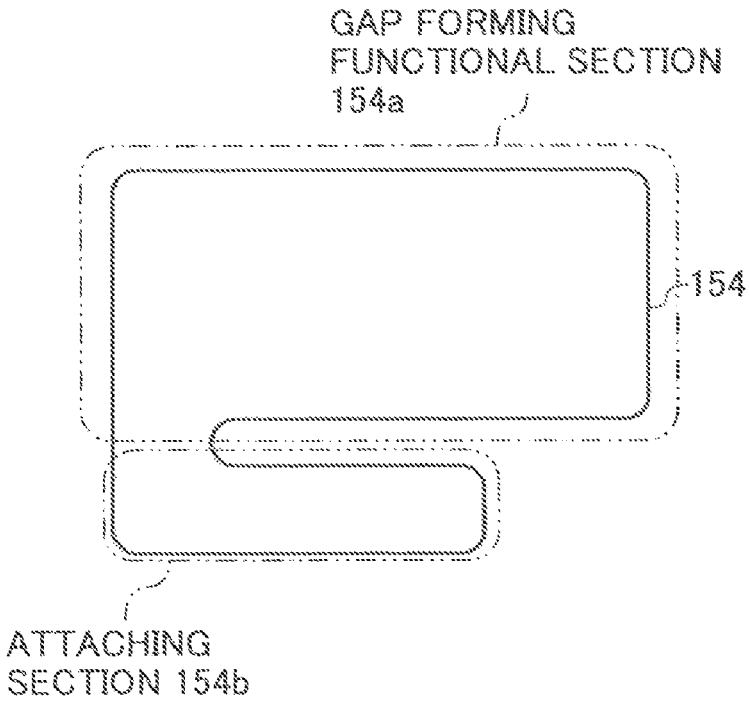
FIGS. 60A and 60B are plan view and a sectional view of a gap forming member of an image forming apparatus according to an embodiment of the present invention, respectively.
Figure 60B:
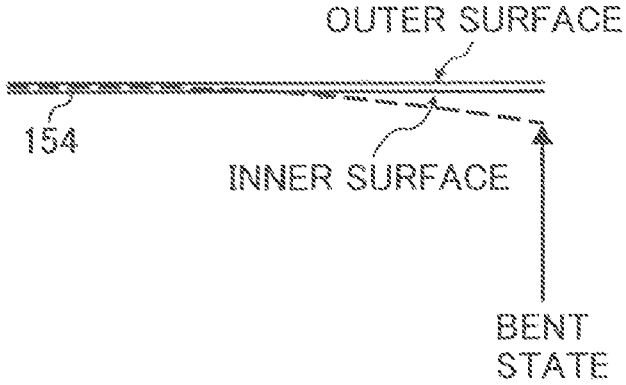

FIGS. 60A and 60B are a plan view and a sectional view of the gap forming member 154, respectively. The gap forming member 154 includes a gap forming functional section 154*a* that is nipped between the counter roller 6 and the transfer roller 7 and an attaching section 154*b* for attachment to the torque limiter holders 151 and 151*a*.

The transfer-unit-gap forming member 12 is required to have sufficient flexibility for adhering to both the counter roller 6 and the transfer roller 7 when the transfer-unit-gap forming member 12 is nipped by the rollers. The transfer-unit-gap forming member 12 has to keep a certain degree of planarity according to a restoring force in a standby state in which the transfer-unit-gap forming member 12 is not nipped by the counter roller 6 and the transfer roller 7. To cope with the two modes, i.e., the thick paper mode and the medium thick paper mode, the gap forming member 154 is required to be restored to its original state after a shape thereof is deformed into a different curvature radius. Therefore, the transfer-unit-gap forming member 12 is made of a flexible sheet material. As the flexible sheet material, for example, polymeric materials such as polyethylene terephthalate (PET), polycarbonate (PC), polyamide (nylon), and polyimide (PI) are suitable. In particular, polyimide (PI) is excellent in a mechanical characteristic and preferable. When a sheet material made of a metal material is used as the flexible sheet material, a phosphor bronze strip, a beryllium copper strip, and the like supplied to the market as metal thin plates are suitable. A stainless steel strip is more suitable because the stainless steel strip is excellent in a mechanical characteristic. As the stainless steel strip, SUS304-CSP is most excellent. As the stainless steel strip, there is precipitation hardening SUS631-CSP. However, taking into account repeated fatigue, it is preferable to use austenitic SUS631-CSP. It is also possible to manufacture the transfer-unit-gap forming member 12 with nickel foil according to electroforming that makes it easy to process the foil into a desired thickness.

The gap forming member 154 has different coefficients of friction on the front and the rear thereof. A coefficient of friction of a surface coming in contact with the counter roller 6 is set higher than that of a surface coming in contact with the transfer roller 7. Therefore, timing of the gap forming member 154 coming into contact with the counter roller 6 is predominant over timing of the gap forming member 154 coming into contact with the transfer roller 7. Consequently, a gap is surely formed immediately after the gap forming member 154 comes into contact with the counter roller 6 at desired timing without being delayed by slip.

Figure 61:
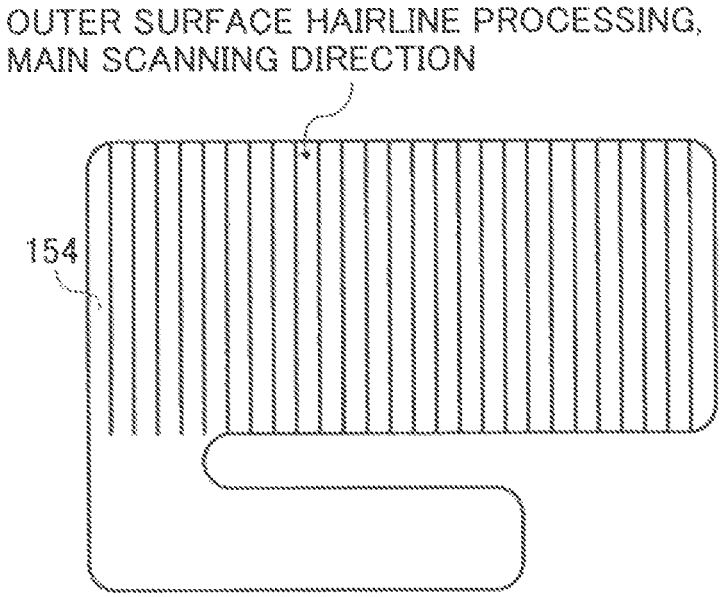
FIGS. 61 to 63 are plan views of the gap forming member shown in FIGS. 60A and 60B.

Specifically, as shown in FIG. 61, hairlining as machine work is applied to the surface of the gap forming member 154 coming into contact with the counter roller 6 in the main scanning direction (the axial direction of the counter roller 6 and the transfer roller 7). The coefficient of friction of the surface of the gap forming member 154 coming into contact with the counter roller 6 is increased according to a pattern of an uneven cross section formed by the hairlining. Therefore, it is possible to make it easy for the gap forming member 154 to be caught on the surface of the counter roller 6.

Figure 62:
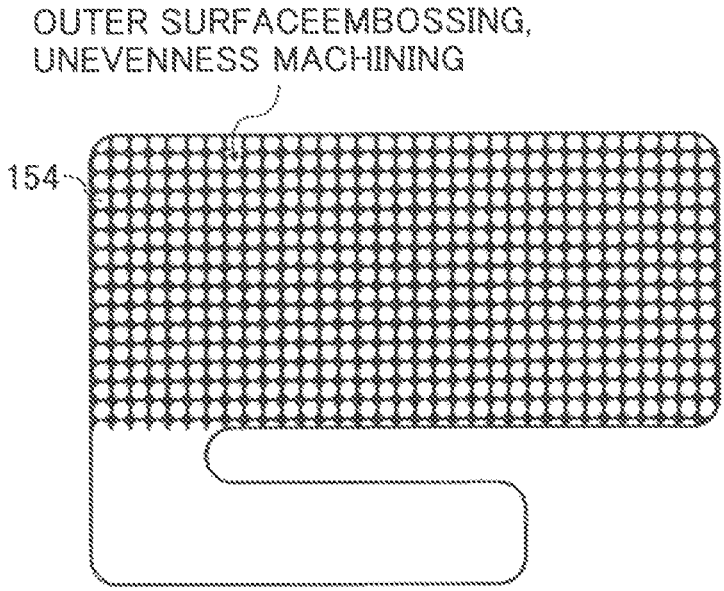

As shown in FIG. 62, embossing is applied to the surface of the gap forming member 154 coming into contact with the counter roller 6 to increase a coefficient of friction according to a pattern of an uneven cross section thereof. Therefore, it is possible to make it easy for the gap forming member 154 to be caught on the surface of the counter roller 6.

Figure 63:
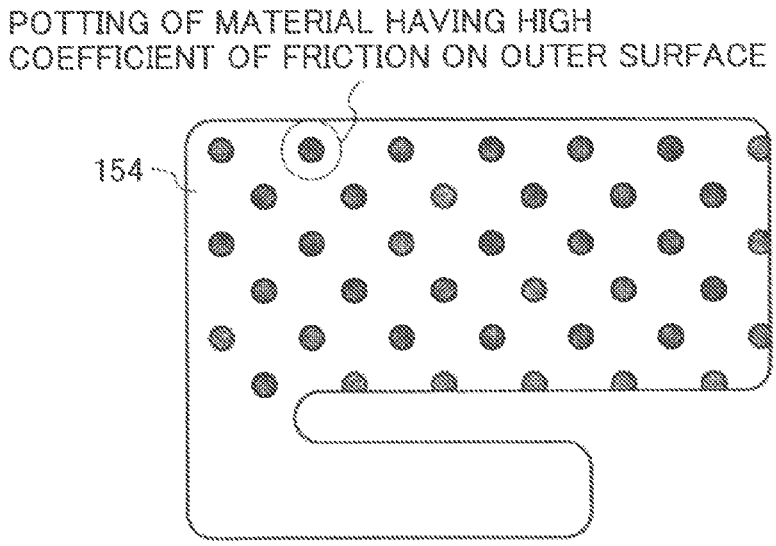
Figure 64:
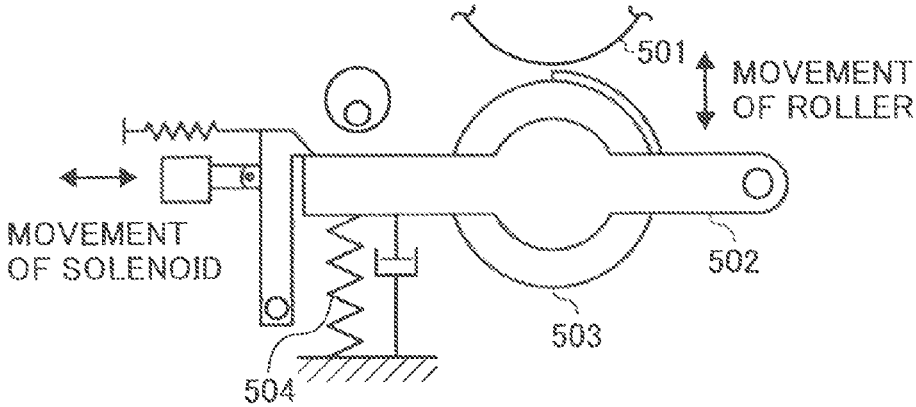
FIG. 64 is a side view of a transfer roller of a conventional image forming apparatus.
Figure 65:
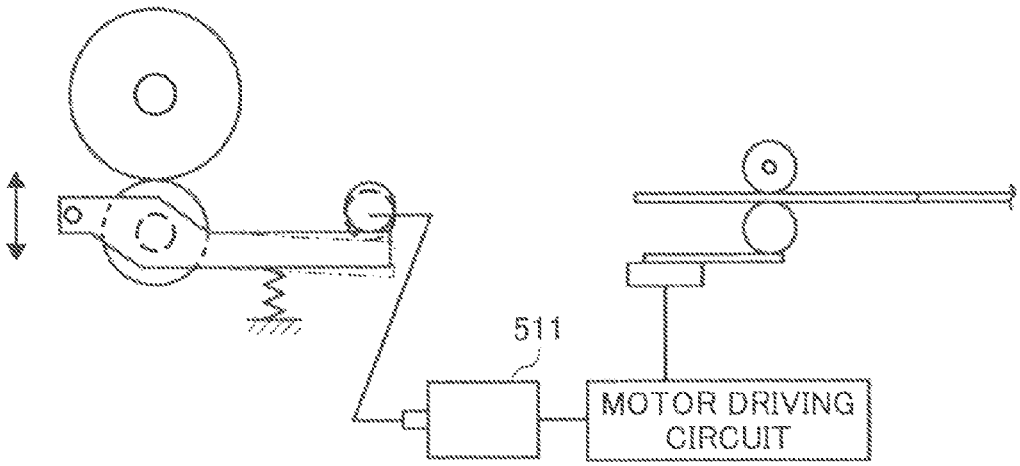
FIGS. 65 and 66 are side views of a transfer member of the conventional image forming apparatus.
Figure 66:
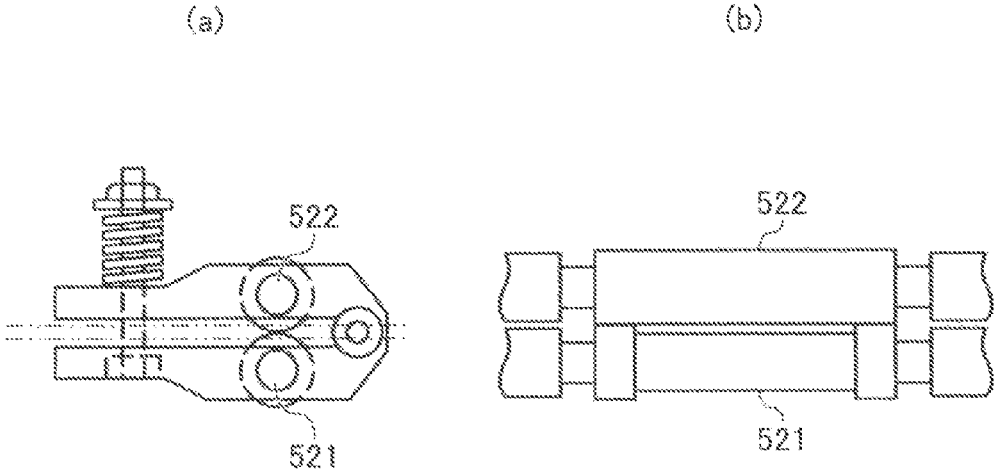
Figure 67:
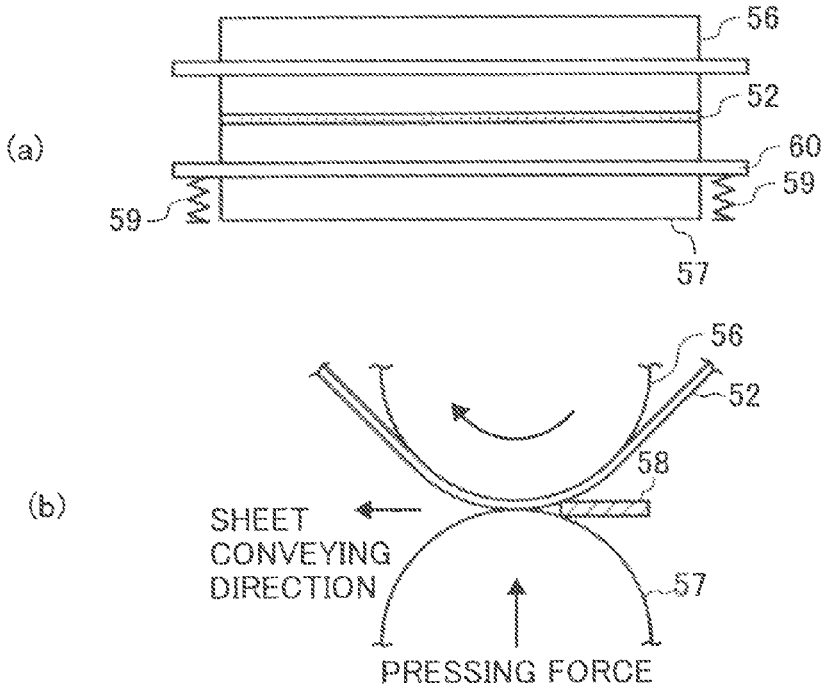
FIGS. 67 to 70 are sectional views of a transfer unit of the conventional image forming apparatus.
Figure 68:
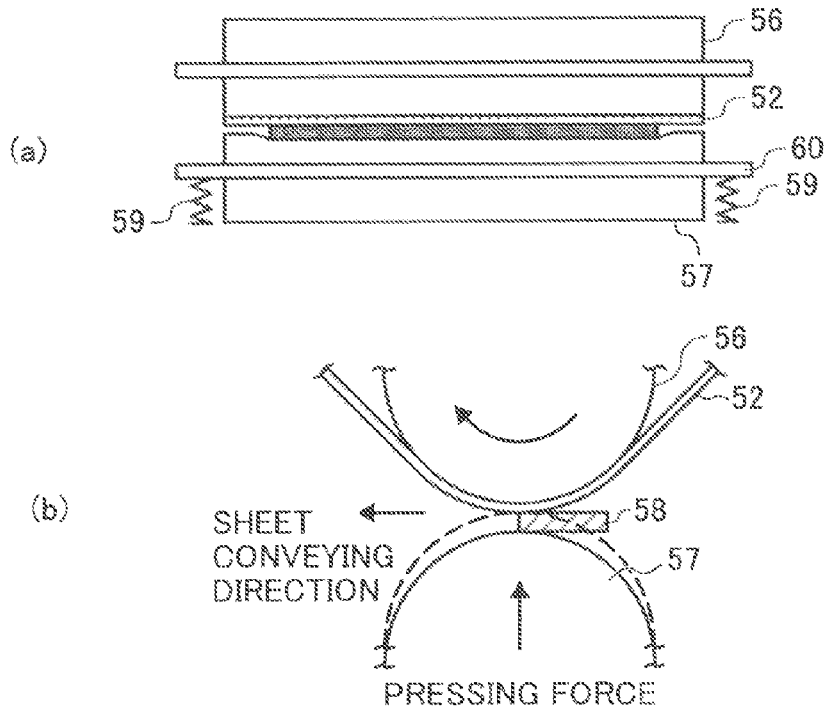
Figure 69:
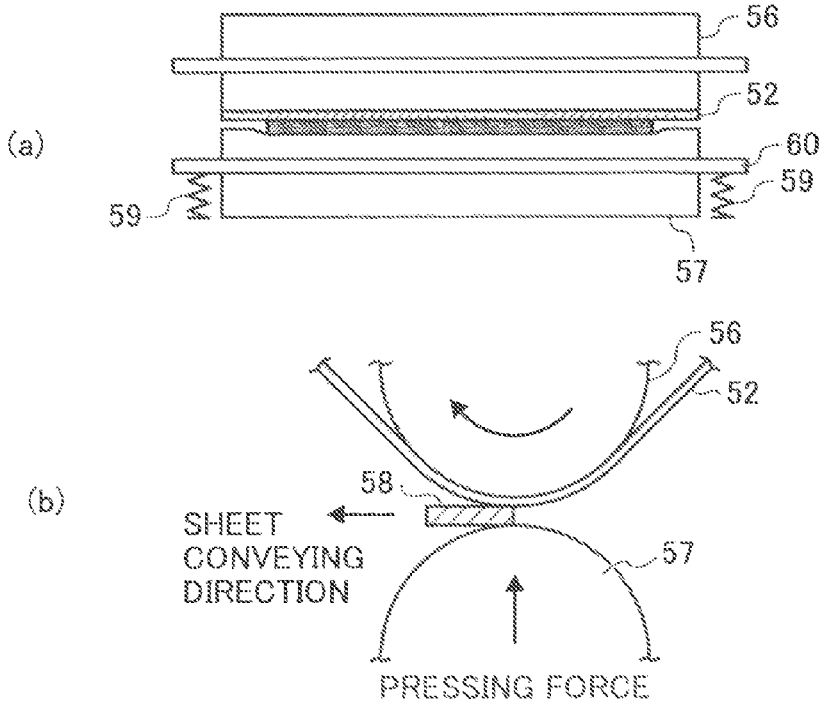
Figure 70:
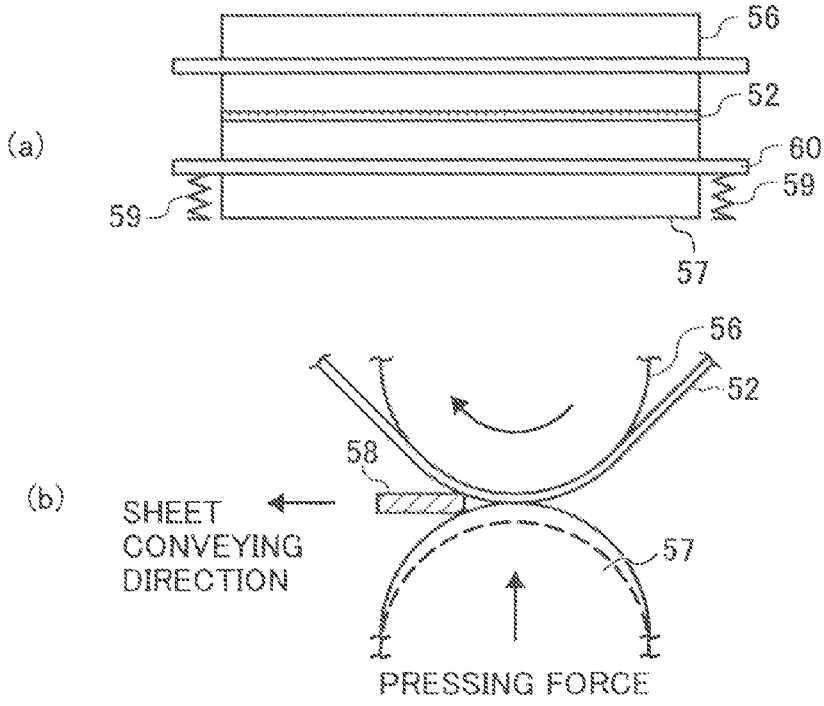
Figure 71:
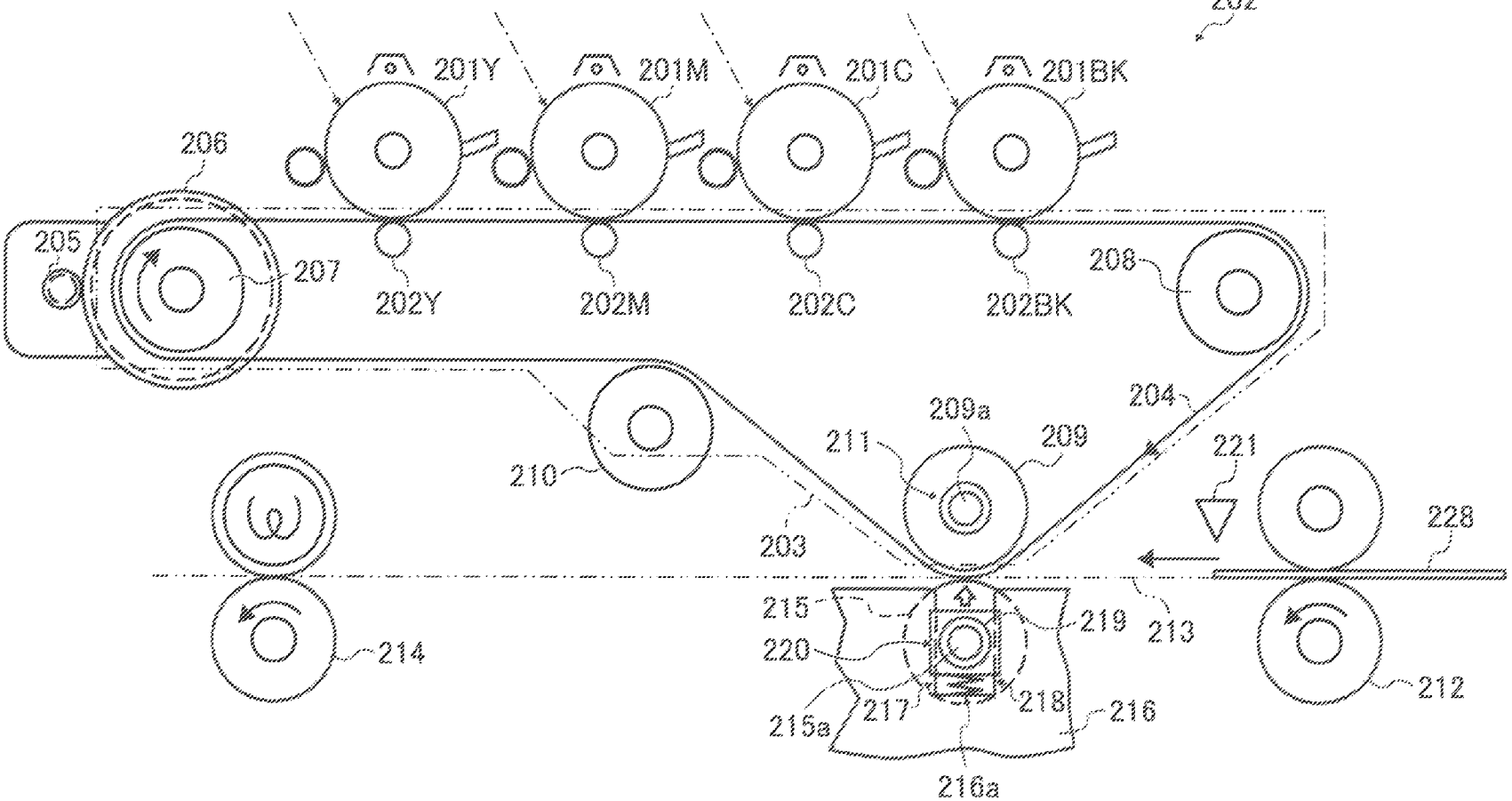
FIG. 71 is a sectional view of a printer unit of the conventional image forming apparatus.

Moreover, as shown in FIG. 63, potting, i.e., a method of locally concentrating stresses by potting a resin material having a high coefficient of friction at intervals, is applied to the surface of the gap forming member 154 coming into contact with the counter roller 6 to increase a coefficient of friction. Therefore, it is possible to make it easy for the gap forming member 154 to be caught on the surface of the counter roller 6 to improve an anchor effect.

Sandblasting, plating, or coating may be applied to the gap forming member 154. When the coating is applied to the gap forming member 154, elastomer having high elasticity at the room temperature and having tackiness is suitable as a coating material.

The respective kinds of machining for increasing a coefficient of friction only has to be applied to the gap forming functional section 154*a* of the gap forming member 154. The respective methods described above are methods of increasing a coefficient of friction of the surface of the gap forming member 154 coming into contact with the counter roller 6.

However, to reduce a coefficient of friction of the surface of the gap forming member 154 coming into contact with the transfer roller 7, the coating, the potting, the plating, the hairlining and the embossing as machine work, and the like may be applied. When the coating is applied, it is possible to reduce a coefficient of friction with fluorine coating. When the potting is applied, it is possible to reduce a contact area by potting a resin material having a low coefficient of friction at intervals and lifting potted portions of the resin material. When the plating is applied, as in the potting, it is possible to reduce a coefficient of friction by widening intervals of projected patterns and reducing a contact area. Moreover, when the machine work is applied, it is possible to make the gap forming member 154 slippery by applying the hairlining in the sub-scanning direction (the conveying direction of the sheet 8).

As described above, in this embodiment, since the gap forming member 154 is made of a flexible material, the gap forming member 154 has sufficient flexibility. It is possible to closely attach the gap forming member 154 to the transfer roller 7 during gap formation. In a standby state, a certain degree of planarity is secured according to a restoring force. Moreover, it is possible to prevent creases from being left on the gap forming member 154 when a shape thereof is deformed into a different curvature radius.

In this embodiment, since the gap forming member 154 is made of a polymeric material, when polyethylene terephthalate (PET), polycarbonate (PC), polyamide (nylon), or the like is used as the gap forming member 154, it is possible to prevent not only the gap forming member 154 but also the intermediate transfer belt 2 and the transfer roller 7 from being deformed.

In this embodiment, since the gap forming member 154 is made of a metal material, when a phosphor bronze strip, a beryllium copper strip, or a stainless steel strip is used as the gap forming member 154, it is possible to prevent not only the gap forming member 154 but also the intermediate transfer belt 2 and the transfer roller 7 from being deformed.

In this embodiment, when a coefficient of friction of a surface on the opposite side of the surface of the gap forming member 154 coming into contact with the transfer roller 7 is higher than a coefficient of friction of the surface coming into contact with the transfer roller 7, it is possible to form a gap immediately after the gap forming member 154 surely comes into contact with the counter roller 6 at desired timing without being delayed by slip.

In this embodiment, a coefficient of friction of the surface of the gap forming member 154 coming into contact with the transfer roller 7 is reduced by applying surface treatment including at least one of the coasting, the potting, the plating, and the machine work to the surface. Thus, it is possible to form a gap immediately after the gap forming member 154 surely comes into contact with the counter roller 6 at desired timing without being delayed by slip.

In this embodiment, when a coefficient of friction of the surface on the opposite side of the surface of the gap forming member 154 coming into contact with the transfer roller 7 is increased by applying surface treatment including at least one of the coasting, the potting, the plating, and the machine work to the surface, it is possible to form a gap immediately after the gap forming member 154 surely comes into contact with the counter roller 6 at desired timing without being delayed by slip.

As set forth hereinabove, according to an embodiment of the present invention, a rotation load generated in an image carrier can be reduced, which results in satisfactory image formation.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries an image and rotates;

an image forming unit that forms an image on a surface of the image carrier;

a transfer member that rotates in contact with the image carrier, and transfers the image formed on the surface of the image carrier to a recording medium;

a conveying unit that conveys the recording medium to a contact position where the image carrier and the transfer member come into contact with each other; and a gap forming unit that forms a gap between the image carrier and the transfer member at the contact position at a predetermined timing, wherein the gap forming unit includes a gap forming member that rotates in a direction in which the transfer member rotates, and wherein the gap forming member enters into the contact position between the image carrier and the transfer member from the direction in which the transfer member rotates.

2. The image forming apparatus according to claim 1, wherein the gap forming unit forms the gap immediately before the recording medium enters the contact position.

3. The image forming apparatus according to claim 1, wherein the gap forming unit forms the gap immediately before the recording medium passes through the contact position.

4. The image forming apparatus according to claim 1, wherein the gap forming unit forms the gap immediately before the recording medium exits the conveying unit.

5. The image forming apparatus according to claim 1, wherein the gap forming member comprises a flexible sheet gap forming member.

6. The image forming apparatus according to claim 5, further comprising a driving unit that drives any one of the image carrier, the transfer member, and the conveying unit, wherein the gap forming member is driven by the driving unit.

7. The image forming apparatus according to claim 5, wherein the gap forming member includes a first surface that comes into contact with the transfer member and has a first friction coefficient; and a second surface opposite to the first surface, which has a second friction coefficient higher than the first friction coefficient.

8. The image forming apparatus according to claim 1, further comprising:

an adjusting unit that adjusts a size of the gap by moving the gap forming member in parallel to an axial direction of the transfer member according to a thickness of the recording medium.

9. The image forming apparatus according to claim 1, further comprising a determining unit that determines whether to form the gap according to a thickness of the recording medium.

10. The image forming apparatus according to claim 1, further comprising an adjusting unit that adjusts a size of the gap according to a thickness of the recording medium.

11. The image forming apparatus according to claim 10, wherein the gap forming unit includes a plurality of gap forming members having different thicknesses, and the adjusting unit selects one of the gap forming members corresponding to the thickness of the recording medium, and inserts the gap forming member into the contact position.

12. The image forming apparatus according to claim 11, further comprising:

a driving unit that drives any one of the image carrier, the transfer member, and the conveying unit; and a driving-force control unit that controls a driving force transmitted from the driving unit, wherein the gap forming member is rotated by the driving unit through the driving-force control unit.

13. The image forming apparatus according to claim 12, further comprising:

a supporting member that supports the gap forming member; and a control unit that controls movement of the supporting member, and includes a detecting unit that detects passage of the recording medium, wherein the control unit controls rotational movement of the supporting member when the detecting unit detects no passage of the recording medium, and releases control over the rotational movement of the supporting member when the detecting unit detects passage of the recording medium.

14. The image forming apparatus according to claim 13, wherein a shape of each of the gap forming members in a conveying direction of the recording medium varies with respect to an image sub-scanning direction.

15. The image forming apparatus according to claim 14, wherein a thickness of each of the gap forming members in the conveying direction of the recording medium varies with respect to the image sub-scanning direction.

16. The image forming apparatus according to claim 15, wherein a widest width of a gap formed by the gap forming members is smaller than the thickness of the recording medium that enters the contact position.

17. The image forming apparatus according to claim 8, wherein the transfer member is a transfer roller, which includes a pair of large diameter parts and a pair of small diameter parts having diameters smaller than the large diameter parts, and wherein the adjusting unit adjusts the size of the gap by switching the gap forming unit to be nipped by the large diameter parts or the small diameter parts according to a thickness of the recording medium.

18. The image forming apparatus according to claim 1, further comprising a driving unit that linearly moves to drive the gap forming unit.

19. The image forming apparatus according to claim 1, further comprising a driving unit that rotates to drive the gap forming unit.

20. The image forming apparatus according to claim 1, wherein the image carrier is an intermediate transfer belt, the transfer member is a transfer roller that conveys the recording medium, and the conveying unit is a registration roller that conveys the recording medium.

* * * * *